United States Patent [19]

Leonard

[11] 4,335,645

[45] Jun. 22, 1982

[54] FLUIDIC REPEATER

[76] Inventor: Willie B. Leonard, 5902 Royalton, Houston, Tex. 77036

[21] Appl. No.: 962,858

[22] Filed: Nov. 22, 1978

Related U.S. Application Data

[60] Division of Ser. No. 772,560, Feb. 28, 1977, abandoned, which is a continuation-in-part of Ser. No. 622,760, Oct. 15, 1975, Pat. No. 4,094,229, which is a continuation-in-part of Ser. No. 521,036, Nov. 5, 1974, Pat. No. 4,046,059, which is a continuation-in-part of Ser. No. 489,829, Jul. 18, 1974, Pat. No. 3,988,966.

[51] Int. Cl.[3] ..... F15B 13/16

[52] U.S. Cl. ..... 91/388; 91/51; 91/461; 137/625.62; 172/413

[58] Field of Search ..... 91/51, 388; 137/625.62, 137/625.63

[56] References Cited

U.S. PATENT DOCUMENTS

| | | | |
|---|---|---|---|
| 2,841,168 | 7/1958 | Levetus et al. | 137/625.63 |
| 3,083,695 | 4/1963 | Stiglic | 91/51 |
| 3,211,182 | 10/1965 | Gyurik et al. | 137/625.63 |
| 3,548,876 | 12/1970 | Viersma | 137/625.62 |
| 3,919,923 | 11/1975 | Haigh | 91/51 |
| 3,988,966 | 11/1976 | Leonard | 91/388 |

FOREIGN PATENT DOCUMENTS 2532028 5/1976 Fed. Rep. of Germany .

*Primary Examiner*—Paul E. Maslousky
*Attorney, Agent, or Firm*—Murray Robinson; Ned L. Conley; David A. Rose

[57] ABSTRACT

A fluidic Repeater, includes a rotary transmitter, a responder, and a rotary feedback.

Various constructional features useful in conjunction with the system are disclosed.

18 Claims, 58 Drawing Figures

602
604
606
608
610
612
614
618
620
622
624
626
628
630
632
634
636
638
640
642
643
644
646
648
650
652
654
656
27
27

31
31

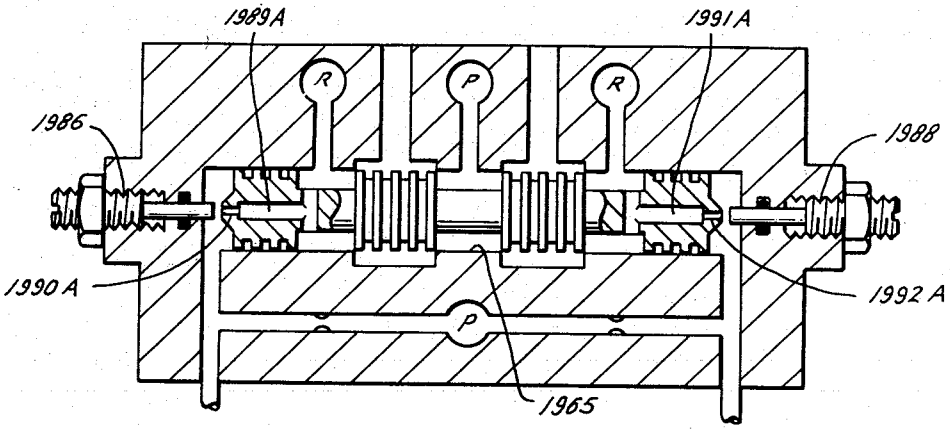
Fig. 47
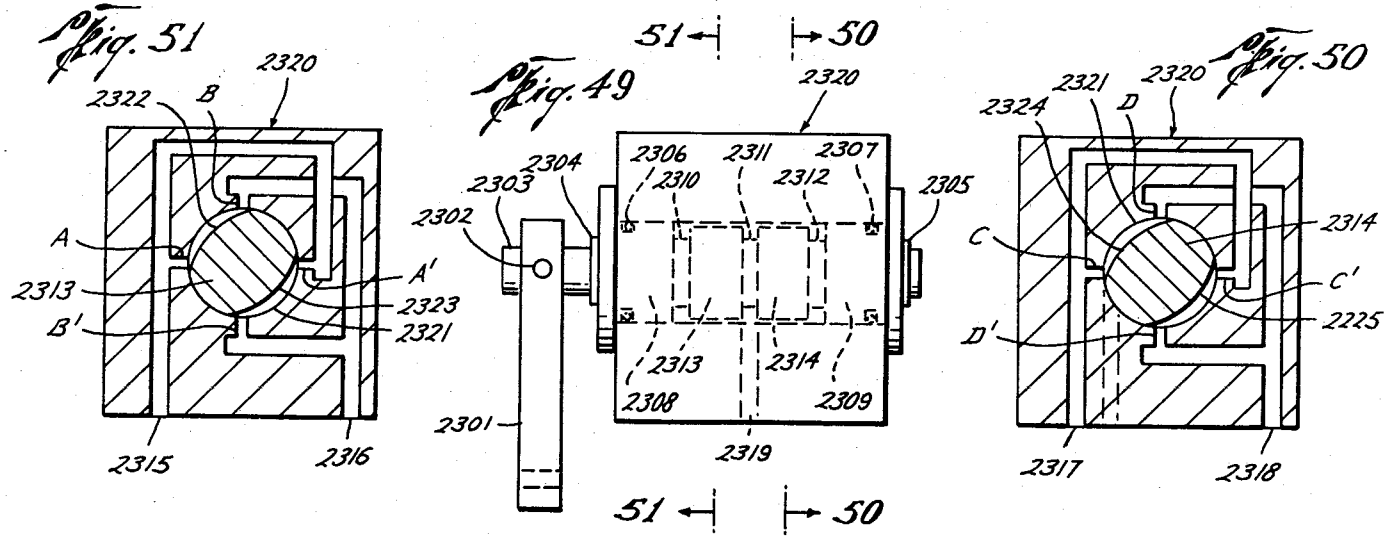
Fig. 50
Fig. 49
Fig. 51

5215
5200
5205
52A
5219
5224
5223
5210
5225
5220
5214
X
5216
5217
5221
5222
5218
5206
5207
R
5208
52A
5215
A
B
5251
5250
5252
5253
5223
5206
5205
5210
5211
5208
Q
L
5200
5209
5212
5213
5226
5227
5207'
K
5207
R 5203
5204
19
21
P
5202
5268
5201
105
5269
107
108
V
C
5228
5229
D
E
F
G
5262
5263
151
109
110
5260
5264
5266
R
5270
R
113
115
R
5271
R
5267
5261
5265
117
119
135
137

5407'
5405'
5411'
5413'
5409'
5404
B
A
R
6168
5412'
5410'
5405
5411
5413
5409
5407
5400
6166
5412
5410
5203
5204
5401
5403
5402
F.W.
R.W.
M
D
5423
5422
5421
5420

FLUIDIC REPEATER

CROSS REFERENCE TO RELATED APPLICATIONS

The present application is a division of application Ser. No. 772,560 filed Feb. 28, 1977 for a Fluidic Repeater, now abandoned, which is a continuation-in-part of the applicant's patent application Ser. No. 622,760 filed Oct. 15, 1975 for a Fluidic Repeater, now U.S. Pat. No. 4,094,229, which is a continuation-in-part of applicant's patent application Ser. No. 521,036 filed Nov. 5, 1974 for a Fluidic Repeater, now U.S. Pat. No. 4,046,059 which is a continuation-in-part application of Ser. No. 489,829, filed July 18, 1974 for a Fluidic Repeater now U.S. Pat. No. 3,988,966.

BACKGROUND OF THE INVENTION

This invention pertains to fluidic, e.g. hydraulic or pneumatic, repeaters useful as remote indicators and servo proportional controllers for either amplification or remote operation, e.g. in seismic generators, aircraft controls, boat steering, automobile wheel tracking, plow jerkers, and vibration test equipment.

Hydraulic devices employing mechano-hydraulic transmitters including an obstructor moving relative to two liquid ports connected to a liquid supply having a drooping pressure-load characteristic are known. It is also known to employ as a receiver or responder a double acting piston moving in a cylinder whose ends are connected by fluid conduits to the transmitter liquid supply upstream of the transmitter ports and to connect the piston mechanically or hydraulically to an output. Various feedbacks from the output to the transmitter are also known.

SUMMARY OF THE INVENTION

According to the invention, means for feedback control, whether incorporated directly in the double acting piston or mechanically connected thereto, comprises variable cross-section surface passages, e.g. tapered grooves. These grooves may be in the ends of a double acting piston cooperating with ports or side recesses of a cylinder. The piston moves to variably throttle fluid vented from the high pressure ends of the piston ends of the piston to lower pressure portions of the system. The invention further includes improved transmitter, responder and receiver means useful with the feedback means of the invention, e.g. systems in which the transmitter has a single line output for actuating the responder or receiver, systems in which the transmitter operates by variable throttling, and systems employing rotary type transmitters and systems with rotary type feedback means. Other features of the invention and objects and advantages thereof will appear hereinafter.

The feedback venting and the transmitter venting flow passages are in parallel so that the rate of venting effected by the feedback means is dependent solely on the position of the feedback means.

Various applications of the invention, e.g. to crane control, seismic generator drive, swasn plate angle control of a swash plate controlled motor-pump unit, four wheel drive, and master and slave systems are disclosed.

Furthermore, the double-acting piston may be a spool with lands at either end and acting about an internal annular flange extending from the surface of the cylinder to the surface of the hub portion of the piston spool. High pressure fluid ports, with pressure varied by the transmitter, are connected to axially-directed ports in the annular flange such that the pressure of the fluid in the conduits is directed against the inside wall of the respective piston land. The hub portion has variable cross section grooves that communicate with lower pressure portions of the system through a passage in the annular flange of the cylinder whereby the piston moves to variably throttle the fluid moving from the high-pressure conduits to the lower pressure portions.

Additionally, the transmitter includes an improved rotary transmitter that varies the pressure of the fluid in two conduits, but varies the pressure of the fluid in only one conduit at a time. Such an improved transmitter has numerous applications and can be used to control a swash plate pump/motor unit in such a way that as the pressure of the fluid in one conduit is varied, the motor rotates at varying speeds in a clockwise direction, and as the pressure of the fluid in the other conduit is varied, the motor rotates at varying speeds in a counterclockwise direction.

BRIEF DESCRIPTION OF THE DRAWINGS

For a more detailed description of several preferred embodiments of the invention reference will now be made to the accompanying drawings wherein:

FIG. 47 is a sectional view of an amplifier forming part of a system according to the invention;

FIG. 49 is an elevation showing a dual rotary transmitter in accordance with the invention;

FIGS. 50, 51 are sections taken on planes 50—50 and 51—51 of FIG. 49;

DESCRIPTION OF PREFERRED EMBODIMENTS

Figure 1:
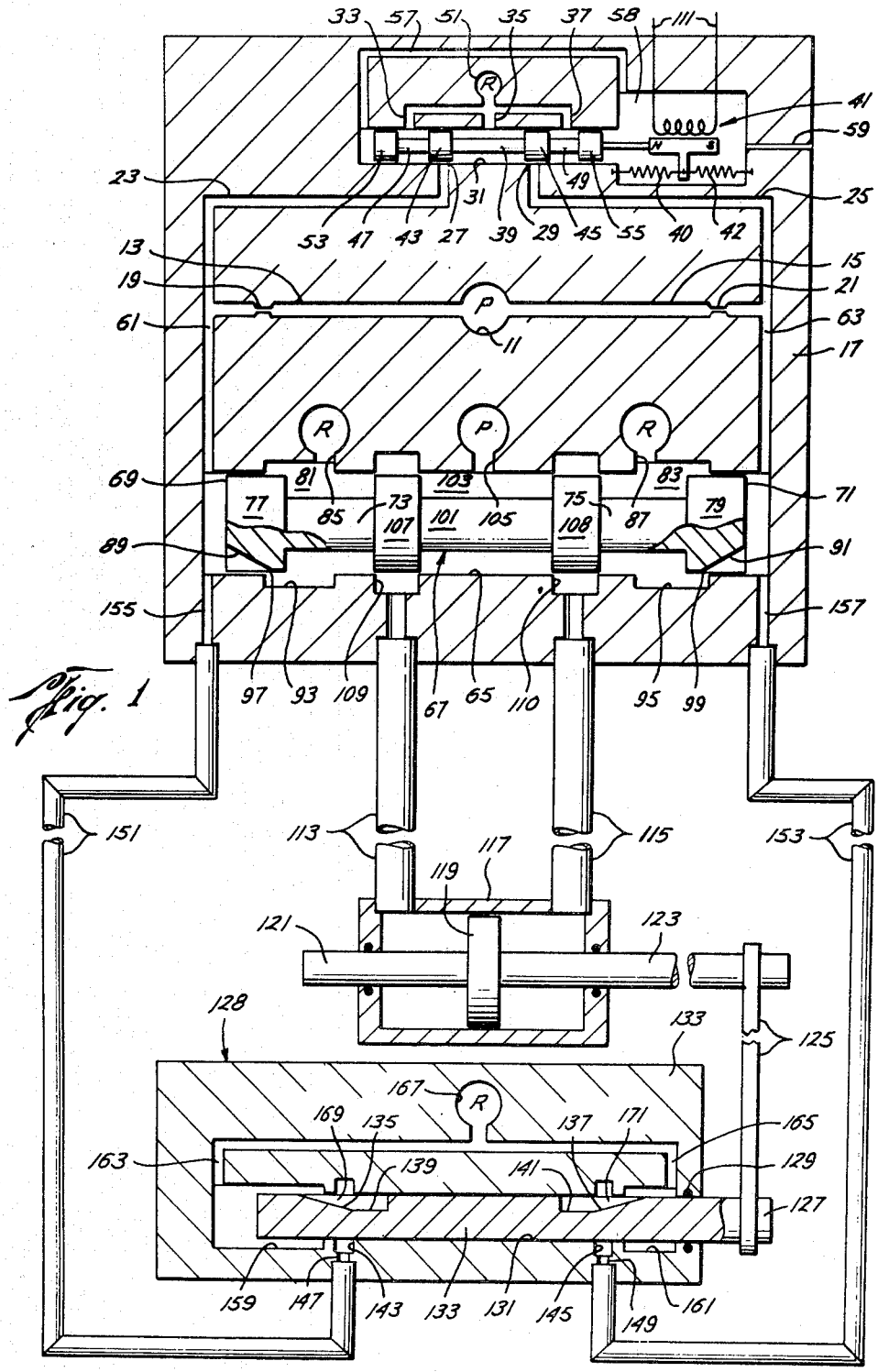
FIG. 1 is a largely schematic sectional view illustrating a fluidic repeater according to the preferred embodiment of the invention.

Referring now to FIG. 1, a fluidic repeater comprises a pump or source (not shown) of fluid under pressure connected to conduits marked P and a sump or low pressure fluid reservoir (not shown) connected to conduits marked R. Usually the system will be hydraulic and use a liquid, e.g. mineral oil, as working fluid, but the following description refers to all embodiments of the invention and is also applicable to pneumatic systems wherein a gas, e.g. air, is the system fluid.

Fluid from pressure source conduit 11 flows through passages 13, 15 in transmitter body 17, through restrictions or orifices 19, 21 to passages 23, 25, and thence out through ports 27, 29. The ports empty into the interior of cylinder 31 formed in transmitter body 17. Cylinder 31 is vented to reservoir 51 by three ports 33, 35, and 37. A four landed spool 39 is moved axially back and forth in cylinder 31 by electromagnetic solenoid 41, which may also be a short stroke torque motor. The solenoid is biased to its midposition, as shown, by springs 40 and 42. When spool 39 is biased to mid position, as shown in FIG. 1, lands 43 and 45 fully or substantially block ports 27 and 29. This reduces the transmitter's idle power requirements. In a modulating system both ports will be partially open in the mid-position of the spool.

Operationally, electric signals applied to solenoid or electric motor 41 move spool 39 toward one end of cylinder 31. This opens either port 27 or 29 an amount whose magnitude is dependent upon the spool's movement. In a modulating system, the port not opened will be closed an amount also dependent upon the spool's axial movement. If one port is opened, e.g. port 27, pressure in passage 23 drops due to the increased fluid flow from the source through the flow restrictor or orifice 19, while closure of the other port, e.g. port 29, will cause a pressure rise in passage 25 due to the reduced flow through orifice 21. Flow passage 13 with orifice 19 and the flow passage 15 with orifice 21 thus provide fluid supplies of drooping pressure-load characteristics. Connected to this supply are ports 27, 29, and spool 39 with lands 43, 45. These provide a variable obstructor for opening and closing the ports thus variably venting the fluid supplies to provide variable pressure outputs that vary in accordance with the obstructor's position. Since obstructor position is controlled by an electric motor, the system thus far detailed provides an electrofluidic transducer transmitter.

To prevent hydraulic locking of spool 39 because of the inherent slight leakage past lands 43, and 45, the spools are relieved by providing annular spaces 47 and 49 beyond lands 43 and 45 that communicate with ports 33 and 37. These ports lead to conduit 51 that is connected to the reservoir. Spool 39 is provided with additional guidance by providing it with end lands 53 and 55. The ends of cylinder 31 are connected by fluid passage 57 that leads to chamber 58. Chamber 58 contains motor 51 and is vented to the atmosphere by passage 59.

The transmitter's varying fluid pressure outputs are conducted by fluid passages 61 and 63 to a responder, which is in this case an amplifier, comprising cylinder 65 formed in transmitter body 17. A double acting free piston 101 floats in cylinder 65, being free to move axially in response to pressure differentials at its ends 69, 71. Fluid passages 61 and 63 from the transmitter are connected to the ends of cylinder 65 so their pressures can act on the free piston's ends. The outer periphery of the piston is relieved by annular grooves 73 and 75, leaving lands 77 and 79 at the ends of the piston. Annular spaces 81 and 83 formed by grooves 73 and 75 are vented to the reservoir by fluid passages 85, 87. Lands 77 and 79 are provided with sloping grooves 89 and 91, respectively, whose depth decreases progressing from the ends of the piston toward grooves 73 and 75. Sloping grooves 89 and 91 vent pressure fluid from passages 61 and 63 past lands 77 and 79 to recesses 93 and 95 in the cylinders' sides and hence to the reservoir through passages 85 and 87. Suitable means, not shown, such as a key and slot, are provided to maintain grooves 89 and 91 in azimuthal alignment with recesses 93 and 95. The size of vent openings 97 and 99 connecting grooves 89 and 91 with recesses 93 and 95 increase and decrease when piston 67 is moved axially. This venting causes negative feedback to fluid passages 61 and 63. Higher pressure at one of passage 61 or 63 than at the other moves free piston 101 in the correct direction to increasingly vent this higher pressure to a reservoir through either groove 89 or 91. Relatively lower pressure in passage 61 or 63 than in the other moves free piston 101 in a direction to reduce venting of such lower pressure to the reservoir. Due to this variable negative feedback, piston 67 moves proportionally in response to the degree of movement of spool 39 and then comes to rest.

Free piston 101 could be connected mechanically to a suitable output such as an indicator, valve or other load. Cylinder 65 and piston 101 would then constitute parts of a receiver connected to the previously described transmitter. Passages 61 and 63 could be replaced by hoses, pipes, or other extended fluid conduits. The system would then constitute a remote indicating or proportional control system.

As shown in FIG. 1, however, piston 101 and cylinder 65 form parts of a fluidic amplifier. Piston 101 is relieved at its mid portion by annular groove 67. Annular space 103 formed by groove 67 is connected by fluid passage 105 leading to a source of fluid pressure. Lands 107 and 108 between groove 67 and grooves 73 and 75, cover outlet ports 109 and 110 in cylinder 65 when piston 101 is in mid position, as shown. When piston 101 moves axially toward one end of cylinder 65 in response to electric signals supplied to conductors 111 of motor 41, then output ports 110 and 109 are uncovered in proportion to the piston's movement. One of the fluid conduits (hoses) 113 or 115 is thus connected to a source of pressure fluid through space 103 and passage 105 while the other of the conduits is connected to reservoir through either space 81 and passage 85 or space 83 and passage 87. Hoses 113 and 115 are connected to opposite ends of load cylinder 117, which, together with piston 119 therein, forms a remote receiver.

When hose 113 or 115 is connected to the source of pressure fluid and the other to the reservoir, piston 119 moves in the direction of the flow from high pressure to low pressure. Piston rods 121, 123 extend through opposite ends of the cylinder 117, leaving equal areas of piston 119 exposed to pressures in cylinder 117. Piston rod 123 is extended to contact to a mechanical load, e.g. a valve, not shown.

Piston rod 123 is also connected mechanically by bar 125 to stem 127 of feedback valve 128. For easier viewing, valve 128 is drawn to a larger scale than load cylinder 117, but it is to be understood that the areas exposed to fluid pressure in the feedback valve are negligibly small compared to those of load cylinder 117.

Stem 127 extends through sealed opening 129 into cylinder cavity 131 of valve body 163 and connects to cylindrical valve closure 133. Closure 133 is provided with two sloping grooves 135 and 137 of increasing depth progressing axially from the ends toward the midportion of the closure. The deepest portions of the grooves being continued axially at constant depth for a certain extent as shown at 139 and 141. When the closure 133 is in midposition, as shown in FIG. 1, sloping portions of grooves 135 and 137 are in register axially with annular recesses 143 and 145 in the sides of cylindrical cavity 131. Recesses 143 and 145 communicate with ports 147 and 149, respectively, which, in turn, are connected to fluid conduits (hoses) 151 and 153. Conduits 151 and 153 are connected to ports 155 and 157, respectively, leading to the ends of amplifier cylinder 65.

The ends of cylindrical valve body cavity 131 are enlarged at 159 and 161 providing annular spaces communicating both with grooves 135 and 137 and also with passages 163 and 165 leading to conduit 167 connecting with the reservoir. When closure 133 moves axially, openings 169 and 171 between grooves 135 and 137 and the sides of cylindrical valve body cavity 131 are opened or closed in proportion to the degree of axial movement. This increases the venting to the reservoir of one of the feedback conduits 151, 153 and decreasing the venting of the other.

Operationally, when a pressure differential across the ends of amplifier piston 101 causes the piston to move right or left, then load piston 119 moves in the opposite direction carrying with it attached feedback valve closure 133. This creates a pressure differential between conduits 151 and 153 opposite to that across piston 101. The feedback from valve 128 is therefore negative and tends to cancel out the pressure differential caused by movement of spool 39. This cancellation causes piston 101 to return to neutral or midposition. This discontinues the pressure differential across load piston 119, which then comes to rest in a displaced position proportional to the displacement of spool 39 that in turn was proportional to the signal strength applied to motor 41 at input 111.

Although motions of the various parts; e.g. transmitter spool 39, amplifier piston 101, load piston 119, and feedback valve closure 133; have been said to be proportional to the signal applied to the input 111 of motor 41, this is to be understood to mean only that there is a direct function between signal amplitudes and mechanical positions with an increase in signal strength causing an increase in mechanical travel. However, by appropriately shaping grooves 89, 91, 135 and 137, the proportionality may be made to approach closely a linear function. Other groove shapes than the simple sloping grooves 89, 91, 135 and 137 may be employed.

Figure 2:
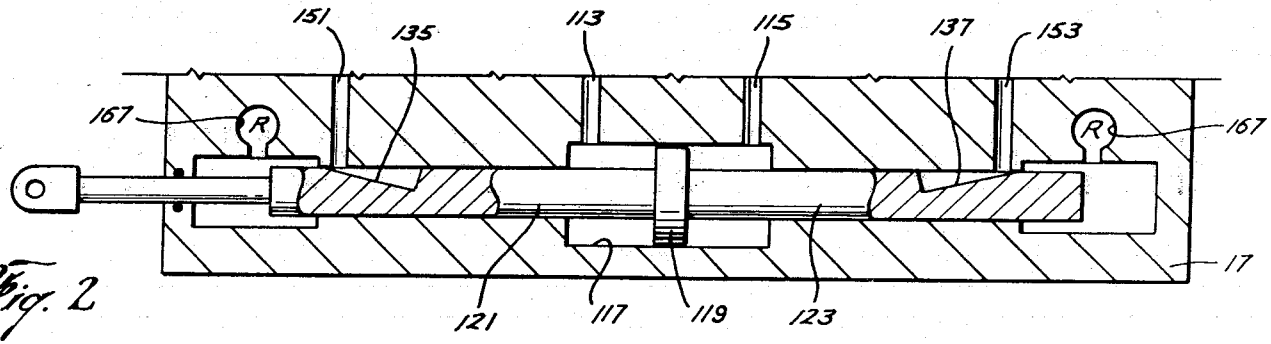
FIGS. 2 and 3 are fragmentary views similar to FIG. 1 showing modifications.
Figure 3:
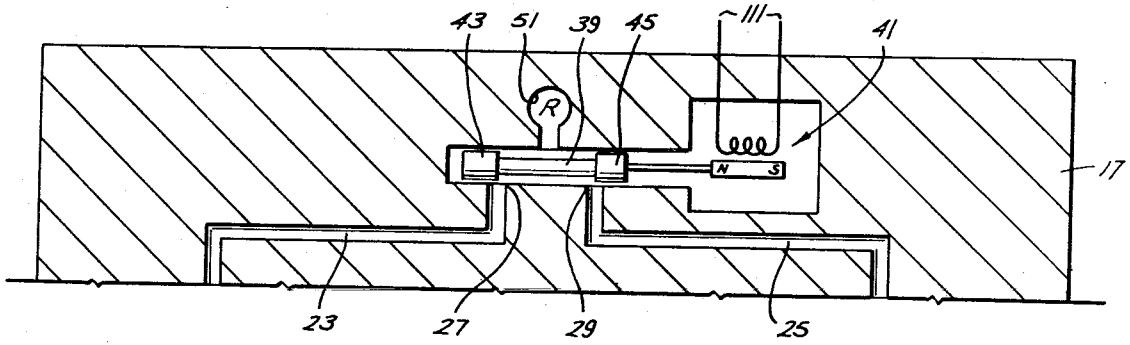

Referring now to FIGS. 2 and 3 there are shown modifications of the FIG. 1 construction. FIGS. 2 and 3 show only a portion of the apparatus shown in FIG. 1; the remainder of the FIGS. 2 and 3 apparatus being the same as that of FIG. 1. Parts that are the same as those in FIG. 1 are given like reference numbers and their description will not be repeated. An examination of FIGS. 1 and 3 will reveal that in FIG. 1 lands 43 and 45 are disposed so as to substantially block ports 27 and 29 when spool 39 is in midposition; whereas in FIG. 3 lands 43 and 45 are disposed to leave both ports 27 and 29 partly open when spool 39 is in midposition. In other respects FIGS. 1 and 3 are the same.

FIGS. 2 and 3 differ from the FIG. 1 construction in two additional respects. First, guide lands 53 and 55 are omitted from spool 39, as are leakage return ports 33 and 37 and atmosphere vent passages 57 and 59. There of course can be used whenever it is found necessary or desirable. Secondly, and most important, in FIGS. 2 and 3 separate feedback valve 128 is omitted. Instead feedback valve means comprising grooves 135 and 137 controlling fluid conduits 151 and, respectively, 153 are provided directly on the ends of piston rods 121 and 123.

Figure 4:
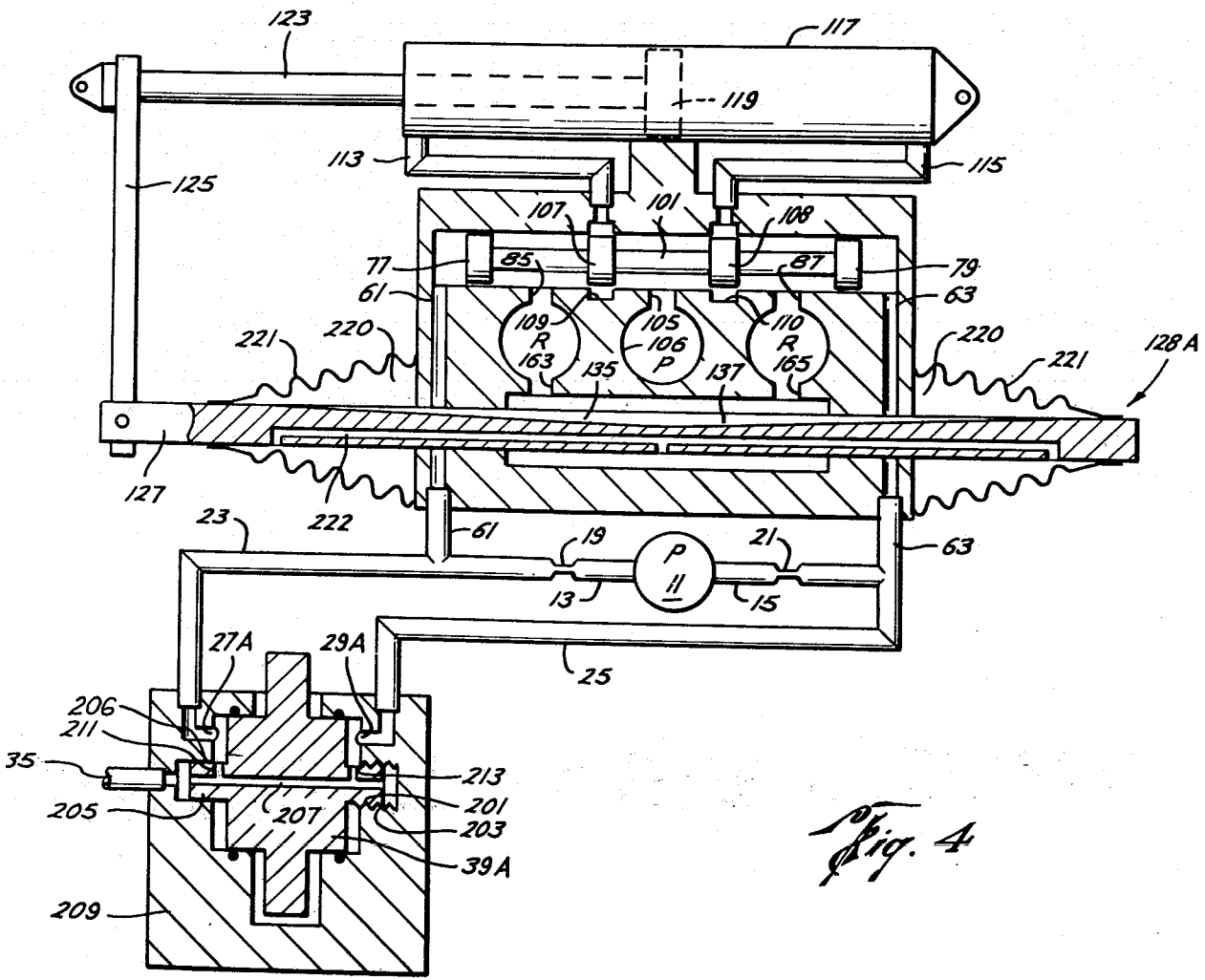
FIGS. 4 and 5 are views similar to FIGS. 1–3 showing two further modifications.

Referring now to FIG. 4 there is shown another modification of FIG. 1 system. Again like parts are given like reference numbers and will not again be described.

The primary difference between the embodiments of the invention shown in FIGS. 1 and 4 is that in FIG. 4 the spool controlled ports 27 and 29 of FIG. 1 are replaced by nozzles 27A and 29A whose flow is controlled by obstructor 39A. The latter is a hand operated wheel, as distinguished from the electric motor actuated spool 39 of FIG. 1. Bearing 201 is at one side of cylindrical obstructor 39A is internally threaded to receive threaded pin 203 on which the obstructor pivots. As the obstructor is rotated it moves axially approaching one or the other of nozzles 27A or 29A and moving farther away from the nozzle not approached. By this means the fluid pressure in conduits 23 and 25 is varied. Obstructor 39A is provided with unthreaded pivot pin 205 received in bearing 206 in obstructor support body 209. Nozzles 27A and 27B discharge into the interior of body 209. Radial passages 211 and 213 in pins 203 and 205, respectively communicate with the interior of body 209 and connect with axial fluid passage 207 which discharges into return line 35 leading to the fluid resevoir.

Another difference between the construction of FIGS. 1 and 4 lies in the construction of the feedback valve 128A that is mechanically linked to load piston rod 123.

Feedback valve 128A variably vents fluid passages 61 and 63 via grooves 135 and 137, which, in this case, are connected together to form one long groove. Venting through grooves 135 and 137 can also be outwardly into the spaces 220 inside annular sealing boots 221 and thence through groove 222 back to the reservoir. When feedback valve 128A has moved far enough to equalize the pressure in fluid passages 61 and 63, piston 101 moves back to neutral position. Load piston 119 remains in its new position as controlled by the setting of manual obstructor 39A.

Another difference between the embodiments of FIGS. 1 and 4 lies in the fact that in the FIG. 4 construction the amplifier piston 101 is not provided with feedback grooves in its ends like the grooves 89 and 91 of the FIG. 1 embodiment.

Figure 5:
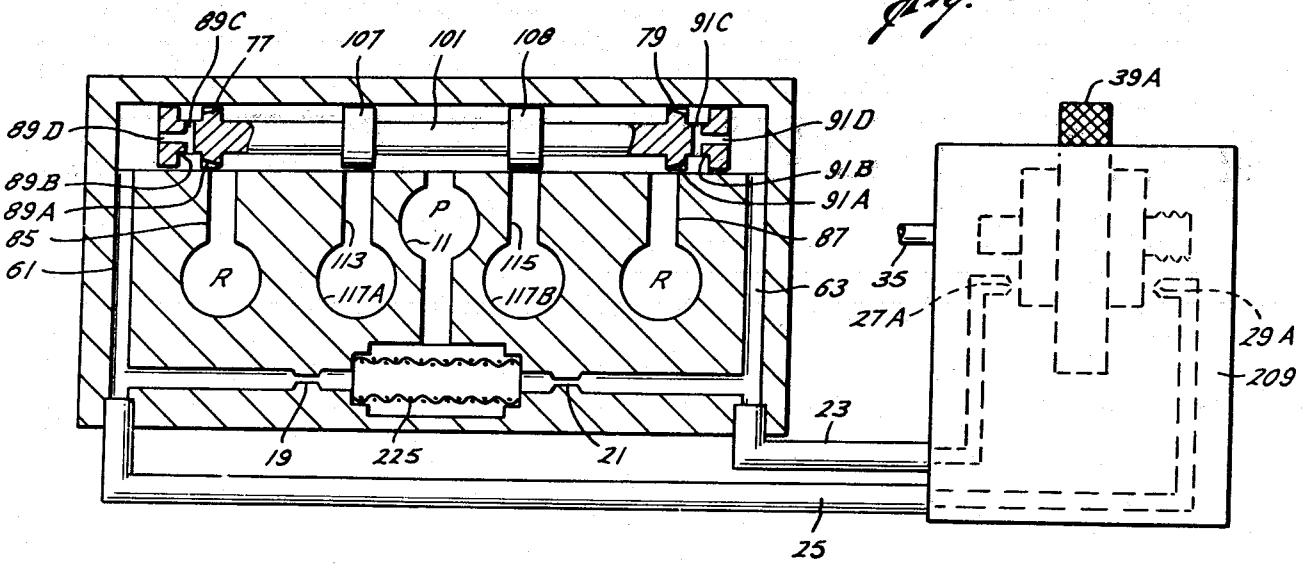

Referring now to FIG. 5 there is shown a further embodiment similar to the embodiments of FIGS. 1–4 wherein like reference numbers refer to like parts that will not be redescribed. As in the FIG. 4 construction, the FIG. 5 embodiment includes a manually actuated hand wheel type obstructor 39A cooperating with nozzles 27A and 29A, rather than an electric motor actuated spool 39 cooperating with ports 27 and 29 as in FIGS. 1–3. However, as in FIGS. 1–3, the amplifier piston is provided with feedback means. In the FIG. 5 construction instead of providing the ends of amplifier piston 101 with sloping grooves as at 89, 91 extending all the way to the outer ends of the piston as in FIGS. 1–3, the sloping grooves 89A and 91A of the FIG. 5 construction terminate where they run into and communicate with annular grooves 89B and 91B around the lands 77 and 79 respectively. Grooves 89B and 91B in turn communicate with the piston's ends via radial and axial flow passages 89C, 89D and 91C, 91D. Shape of grooves 89A and 91A is shown more clearly in larger scale detail views of FIGS. 6, 7 and 8. Short grooves 89A and 91A cooperate with annular grooves 89B and 91B to provide non-linear feedback correlative to the nonlinear input of nozzle obstructor 39A. This effects a more nearly linear proportionality between hand wheel movement and amplifier piston movement.

Figure 9:
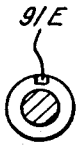
FIG. 9 is a view similar to FIG. 8 showing another embodiment.
Figure 8:
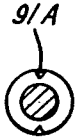
FIGS. 6, 7, and 8 are elevational, sectional and end views respectively of the end of the amplifier piston of the FIG. 5 embodiment.

FIG. 9 shows feedback groove 91E of rectangular cross section as an alternative to the V-shape cross section of groove 91A of FIG. 8.

No load cylinder and piston are shown in the FIG. 5 construction, but it is to be understood that amplifier output passages 113 and 115 connect via passages 117A and 117B leading to a suitable load cylinder which usually will be provided with further feedback means as in FIGS. 1–4. Without a load feedback the load piston will ultimately move to the limit of its travel regardless of the magnitude of the input at obstructor 39. The rate of this movement of the load piston will vary in proportion to the magnitude of the input at obstructor 39A. In some applications the load feedback means of the FIGS. 1–4 embodiments could also be omitted.

FIG. 5 illustrates the use of a filter screen 225 between conduit 11 leading to the source of pressure fluid and the orifices 19 and 21. This is desirable to prevent blockage of the orifices by foreign matter. This construction detail, though not shown in FIGS. 1–4, is to be understood as being applicable to all embodiments of the invention.

Figure 10:
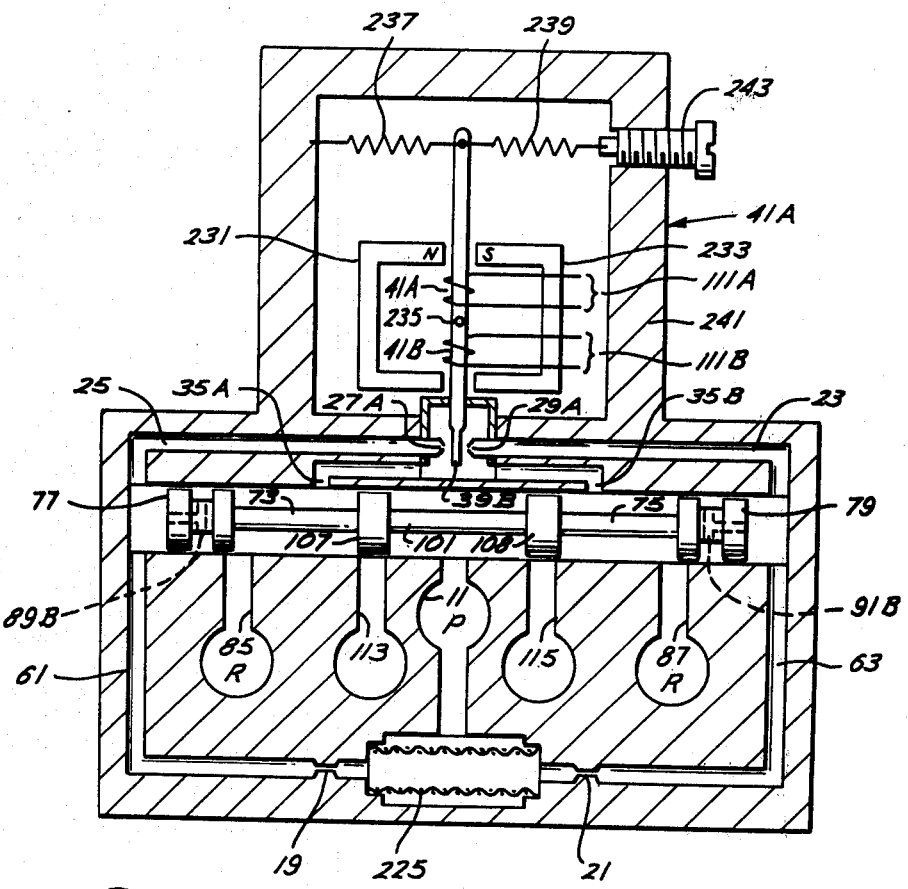
FIG. 10 is a cross-sectional schematic view of a mechanical to fluidic translator according to the invention.

FIG. 10 shows an embodiment of the invention that is much the same as that of FIG. 5. Differences include modification of the feedback groove system in the amplifier piston and the use of an electric "flapper" in place of hand wheel obstructor 39A. Like parts are given like reference numbers and their description will not be repeated.

The amplifier piston feedback groove system in FIG. 10 is similar to the system illustrated by FIG. 5 except short sloping grooves 89A and 91A are omitted. An initial axial motion of the piston 101 sufficient to communicate annular groove 89B or 91B with vent passage 85 or 87 is required before any feedback will occur. Thereafter, further movement of the piston 101 in the same direction will cause increasing venting.

Figure 11:
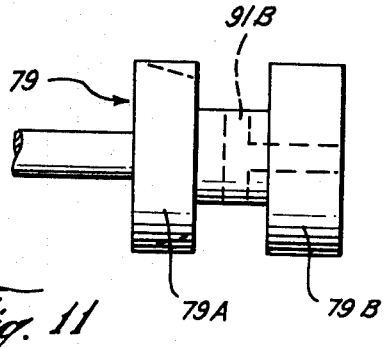
FIG. 11 is a sectional view of part of the spool valve shown in FIG. 10.

If desired, lands 77 and 79 can be inwardly flaring or tapered, e.g. conically or in other manner annularly relieved between annular grooves 73 and 89B along one end and between angular grooves 75 and 91B at the other end, as shown in FIG. 11. This will effect a result similar to that attained by the embodiment illustrated in FIG. 5. The outermost parts of the lands will be cylindrical, for guide purposes, as shown at 79B.

Electric flapper 41A shown in FIG. 10 driving flapper type obstructor 39B includes horseshoe magnets 231 and 233 disposed opposite pole to opposite pole with flapper 39B pivoted therebetween at 235. Tension springs 237 and 239 connected to one end of the flapper and to motor housing 241 and adjustment screw 243 normally center the other end of the flapper between nozzles 27A and 29A. When an electric signal is applied to either input 111A or 111B of solenoid 41A or 41B the flapper is magnetized a proportional amount. This moves it toward or away from nozzle 27A or 29A. This variably vents passages 23 and 25. Fluid leaving nozzles 27A and 29A returns to the fluid reservoir through passages 35A and 35B.

Figure 14:
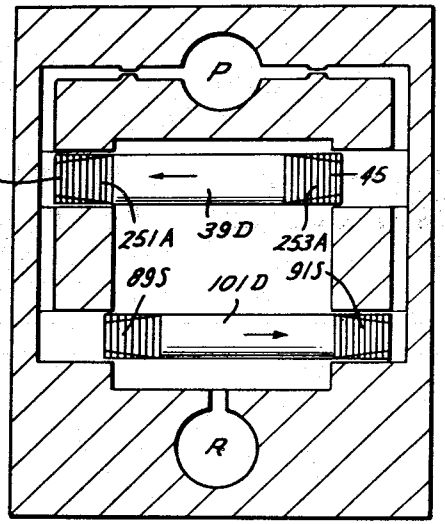
FIGS. 12, 13 and 14 are largely schematic sectional views showing further embodiments of the invention.
Figure 13:
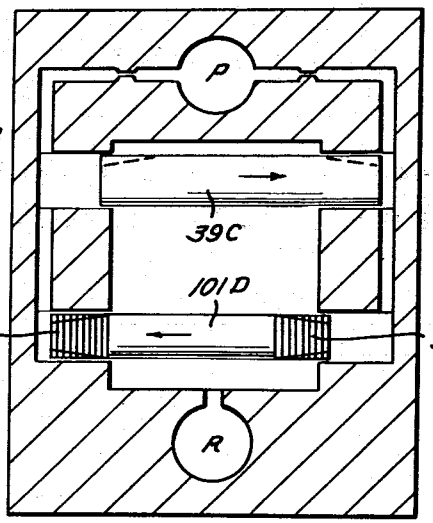
Figure 12:
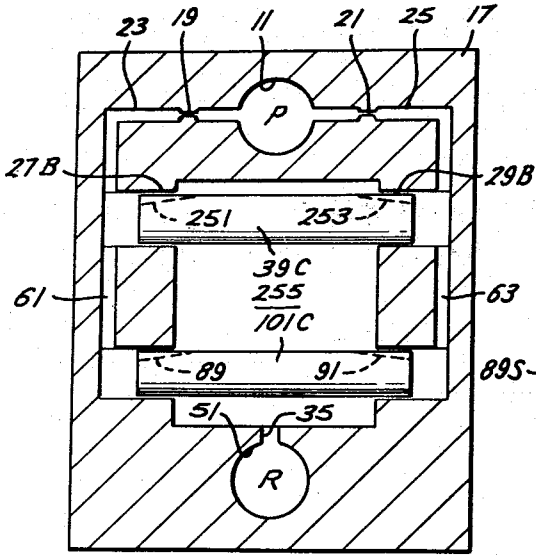

FIGS. 12–14 show rudimentary fluidic repeater apparatus according to an embodiment of the invention in which transmitter obstructor 39C or 39D is of the needle valve type rather than the spool valve type shown in FIGS. 1–3 or the jet interference types shown in FIGS. 4, 5, and 10. In FIG. 12 obstructor 39C is a cylindrical plug axially movable relative to cylindrical ports 27B and 29B. Plug 39C is provided with sloping grooves 251 and 253 similar to grooves 89 and 91 of the amplifier piston of FIG. 1. According to the axial position of plug 39C more or less fluid is vented from fluid source passages 23 and 25 to chamber 255 and then through passage 35 to reservoir return conduit 51. No means for moving plug 39C is shown, but it is to be understood that any suitable means can be used, e.g. any of the manual or motor means used in the previously described embodiments.

Figure 16:
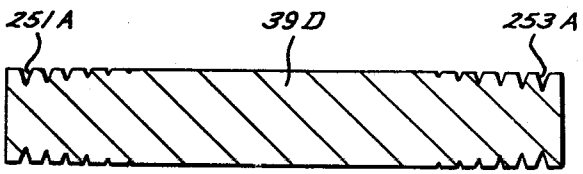
FIGS. 15 and 16 are sectional views of feedback elements of the embodiments shown in FIGS. 12 through 14.
Figure 15:
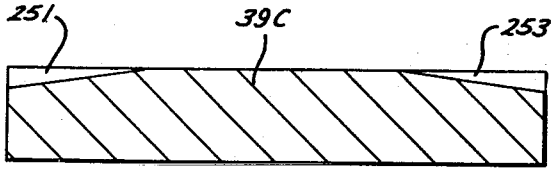

The transmitter obstructor shown in FIG. 13 is the same as that in FIG. 12. The transmitter obstructor shown in FIG. 14 is the same as in FIGS. 12 and 13 except that the ends of the obstructor plug 39D are provided with spiral helical grooves 251A, 253A spiraling inward and progressing axially towards the plug ends, rather than the sloping grooves 251, 253 of the embodiments of FIGS. 12 and 13. The two groove constructions are further illustrated in FIGS. 15 and 16.

Referring once more to FIG. 12, receiver piston 101C is provided with a sloping feedback grooves 89 and 91 similar to those shown in the embodiments of FIGS. 1–3 whereby axial motion of piston 101C due to difference in pressure between fluid passages 61 and 63 causes such venting through chamber 255 and passage 35 to reservoir return conduit 51 as to eliminate the pressure differential. The receiver piston constructions of FIGS. 13 and 14 are the same as that of FIG. 12 except that instead of sloping grooves 89 and 91 of configuration like transmitter grooves 251 and 253, the receiver pistons of FIGS. 13 and 14 are provided with spiral helical grooves of configuration similar to the grooves 251A and 253A.

No amplification is effected between transmitter plugs 39C and 39D and receiver pistons 101C and 101D. No load is shown connected to pistons 101C or 101D, but it is to be understood that they can be connected fluidically to load cylinders and pistons as are the amplifier pistons in the other embodiments, or mechanically, the same as feedback piston 133 in FIG. 1, for example, or pistons 101C and 101D could be connected to indicator or display means of minimum load power requirements.

The various vent groove configurations described herein as applicable to the transmitter plug (FIGS. 15 and 16), the amplifier or receiver piston (FIGS. 1–3, 5–14) and the load feedback piston (FIGS. 1–4) may be interchanged between the various embodiments described hereinabove or hereinafter, as may be desired or required for any reason, for example to correlate the transmitter obstructor position-vent function, the amplifier piston position-vent function, and the load feedback valve position-vent function.

Comparing the several embodiments of the invention thus far described it will be seen that operationally in each case a transmitter obstructor moves relative to a pair of openings. These may be side ports in a spool valve as in FIG. 1, jet nozzles as in FIGS. 4 and 10, or needle valve ports as in FIGS. 12–14. In each case the pair of openings open to some form of chamber means, e.g. a cylinder (FIG. 1), cylindrical spaces in a hand wheel block (FIG. 4), a chamber in the transmitter block (FIG. 10), or a cylindrical chamber (FIG. 12–14). In each case flow from the pair of openings is controlled by some form of barrier means, e.g. piston lands (FIG. 1), hand wheel obstructor (FIG. 4), flapper (FIG. 10), or needle valve plugs (FIG. 12–14). The obstructor and openings provide means to variably vent a pair of pressure fluid passages downstream from flow restrictors. Responder means, e.g. amplifier and/or load cylinders, are connected to the fluid passages. Feedback means from the amplifier and/or load cylinder variably vent the pair of fluid passages opposite to the variation by the obstructor. The feedback means comprises variable cross section surface passages in the amplifier or load or receiver piston or several of these or in the walls of the cylinders surrounding these pistons.

The responder means of the invention can be actuated by other forms of transmitter than those described above in which the transmitter variably vents a pair of fluid passages downstream from flow restrictors therein, the fluid passages upstream from the restrictors leading to a source of constant fluid pressure, and the pressures downstream from the restrictors being conducted by two fluid lines to the responder. Instead of variable venting, variable pressures can be generated by making the restrictors variable and conducting the downstream pressures by two lines to the responder. Furthermore, the transmitter may be modified to effect change in only one pressure. A single line may then be used between transmitter and responder. These various modifications will be described next.

Figure 17:
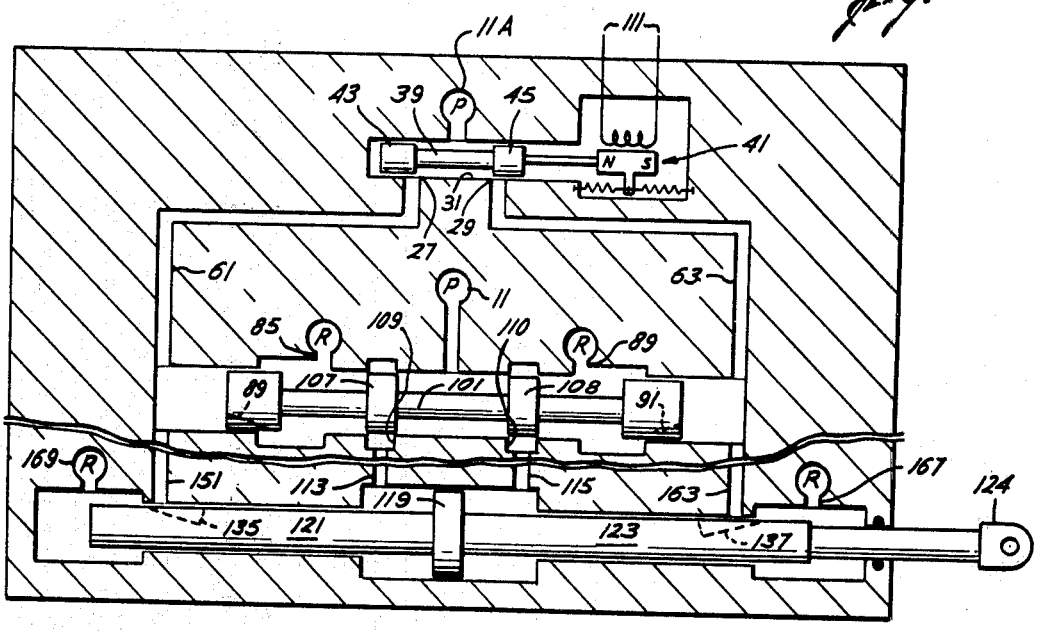
FIG. 17 is a largely schematic cross-sectional view illustrating a fluidic repeater according to an embodiment of the invention.

Referring now to FIG. 17 there is shown an embodiment to the invention, the same as that of FIGS. 1 and 2 respectively insofar as the amplifier and receiver are concerned, but employing a modified form of transmitter. Like parts are given like reference numbers. In this embodiment, motor 41 acts to move spool 39 axially in cylinder 31 to vary the position of lands 43 and 45 relative to ports 27 and 29, as in FIGS. 2 and 3. However, conduit 11A connected to cylinder 31 leads to a pressure source rather than to a reservoir. The pressure in lines 61 and 63 leading to amplifier piston 101 are varied in accordance with the degree of throttling, or obstruction, produced by spool 39. Thus this is an example of control by variable obstruction of a pressure source. There is always a sufficient flow from lines 61 and 63 to the return reservoir conduit, for example 85, 89, and 167, to prevent the pressure in lines 61 and 63 from building up to supply pressure despite the throttling effect of spool 39.

The operation of the embodiment illustrated in FIG. 17 is the same as that of the embodiment illustrated by FIG. 1, in that electric signals inputted through electric motor 41 move spool 39 to vary the pressure in lines 61 and 63. This differential pressure in turn moves amplifier piston 101, causing ports 109 and 110 to be opened to the reservoir and pump pressure, respectively. The differential pressure thus applied to load piston 119 causes it to move axially, moving connected clevis 124 to actuate a load (not shown). Negative feedback, in accordance with the preferred embodiment of the invention, is effected by grooves 89 and 91 in the amplifier and by grooves 135 and 137 in the load piston. The feedback provided by these grooves limits the travel of both the amplifier and load pistons so the load pistons movement varies in an amount directly related to the amount of electrical imput to motor 41. The precise relationship, linear or otherwise, between the signal strength and load movement depends on the size and shape of the feedback grooves.

It should also be noted that, due to the fact that the end areas of piston rods 121 and 123 that are exposed to reservoir pressure are different, piston 119 comes to rest at a balance of forces, not pressures. If, however, the reservoir pressure is atmospheric pressure, then the pressure on clevis 124 will effect a precise compensation and piston 119 will come to rest with a balance of pressures in lines 113 and 115, (assuming the load on clevis 124 exerts no force when the clevis is a rest).

Figure 18:
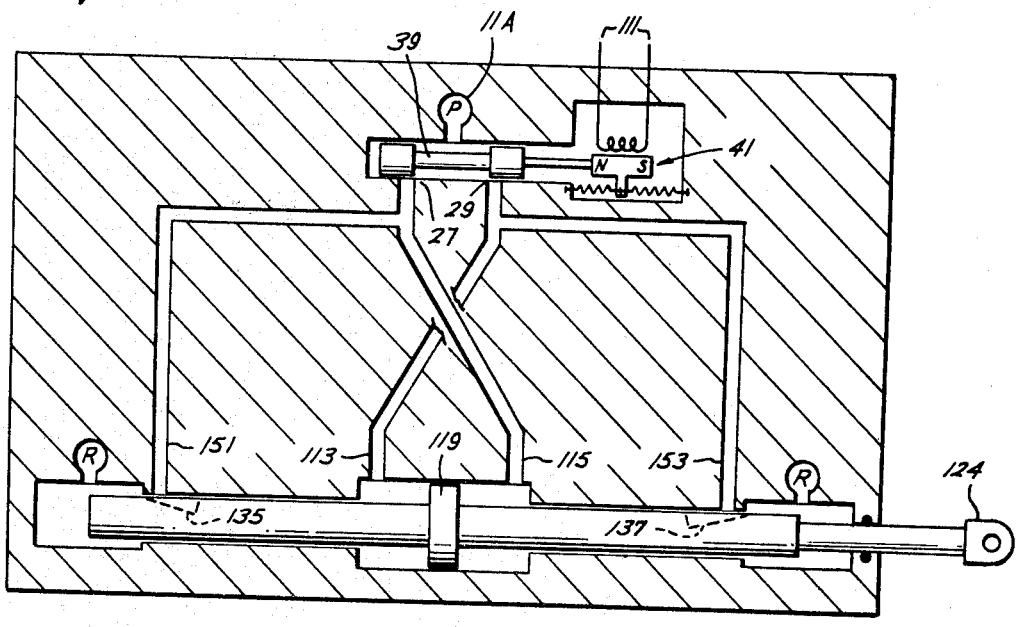
FIG. 18 is a view similar to FIG. 17 showing another embodiment.

Referring now to FIG. 18, there is shown a construction similar to that of FIG. 17 except no amplifier is employed. Like parts bear like reference numbers. It will be seen that variable pressures downstream of throttling spool 39 at port 27 and 29 are applied directly to loan piston 119 through lines 113 and 115. Negative feedback in accordance with the invention is effected by grooves 135 and 137 in the load piston. These grooves are always in position to vent some of the pressure fluid back to the reservoir so there will be no buildup of hydraulic fluid in lines 113 and 115 sufficient to lock the system.

Figure 19:
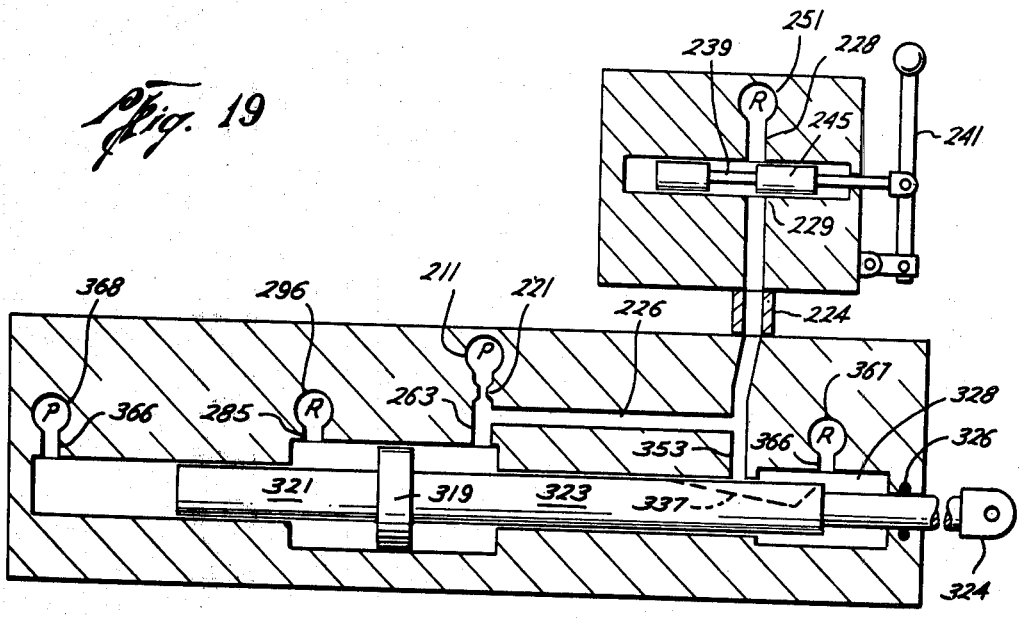
FIG. 19 is a view similar to FIG. 18 showing an embodiment of the invention using only a single pressure line for control.

Referring now to FIG. 19, there is shown another embodiment of the invention adapted for a single line connection between the transmitter and receiver. The construction is similar to that of FIG. 18 in that no amplifier is used and similar to that of FIG. 2 in that the transmitter functions by variably venting the working fluid rather than by variably throttling it to effect pressure change. Reference numbers for parts similar to those of FIG. 2 will be employed, increased by 200.

The transmitter of FIG. 19 employs a manual input in the form of lever 241, which moves spool 239 axially. By this means single line 224 is variably vented to return-to-reservoir conduit 251. Venting varies in accordance with the position of land 245 relative to ports 228 and 229.

Load piston 319 is connected on one side by fluid passage 263 and flow restrictor 221 to conduit 211, which leads to the source of pressure fluid. Fluid passage 224 is connected to passage 263 by branch line or passage 226. The flow of fluid in this branch passage is used to vary the pressure of the fluid in passage 263 applied to one side of load piston 319. Pressure on the opposite side of piston 319 is maintained constant, e.g. by connection through passage 285 leading to a conduit connected to a reservoir. Similarly, the area at the end of piston rod 321 is connected by passage 366 to conduit 368. This conduit leads to a source of fluid pressure that may or may not be the same pressure source as is connected to conduit 211.

By varying the pressure on the constant pressure end of load piston 319 and piston 321, the pressure required on the right of load piston 319 and piston rod 323 can be adjusted required to make the system responsive to movement of transmitter actuator 241.

Piston rod 323 is connected to clevis 324 for actuating a load (not shown). The aperture through which the clevis extends out of the receiver housing is sealed by 0-ring 326. This prevents leakage from chamber 328 at the end of piston rod 323. The chamber is connected by passage 366 to conduit 367. This conduit leads to a reservoir. In accordance with the invention, negative feedback is achieved by the use of groove 337 in piston rod 323 that variably connects chamber 328 to fluid passage 353. Fluid passage 353 is connected to line 224 and passage 226.

When actuator 241 is moved to allow venting to increase in line 224, fluid pressure drops in passage 226 causing piston 319 to move to the right as illustrated in the drawing. Such movement causes groove 337 to also move to the right whereby only its shallow left end portion connects passage 353 to chamber 328. Venting, by passage 353, is thereby reduced, raising the pressure in passage 226 and bringing piston 319 to rest.

When actuator 241 is moved to the left as shown in the drawing, venting is decreased in line 224. This results in a pressure rise in passage 226 causing piston 319 to move to the left. Such movement causes groove 337 to also move to the left whereby its deeper right ended portion connects passage 353 to chamber 328. This increases venting through passage 353, lowering pressure in passaage 226 and bringing piston 319 to rest.

While the use of a single line connecting the transmitter and receiver has the advantage of structural simplicity, its operation is dependent upon the maintenance of predetermined pressure in the supply and reservoir conduits 251, 211, 296, 286, and 367. On the other hand, with the two line system previously described, only the pressure differential between the two lines is significant. Both single and dual line systems are described herein in order to illustrate the scope of the invention that is directed primarily to the negative feedback means that allows a load piston's movement to be a function of the movement of the transmitter actuator. This is true whether the actuator variably blocks a pressure source, blocks venting to a reservoir, or differentially changes the pressure in two lines.

Figure 20:
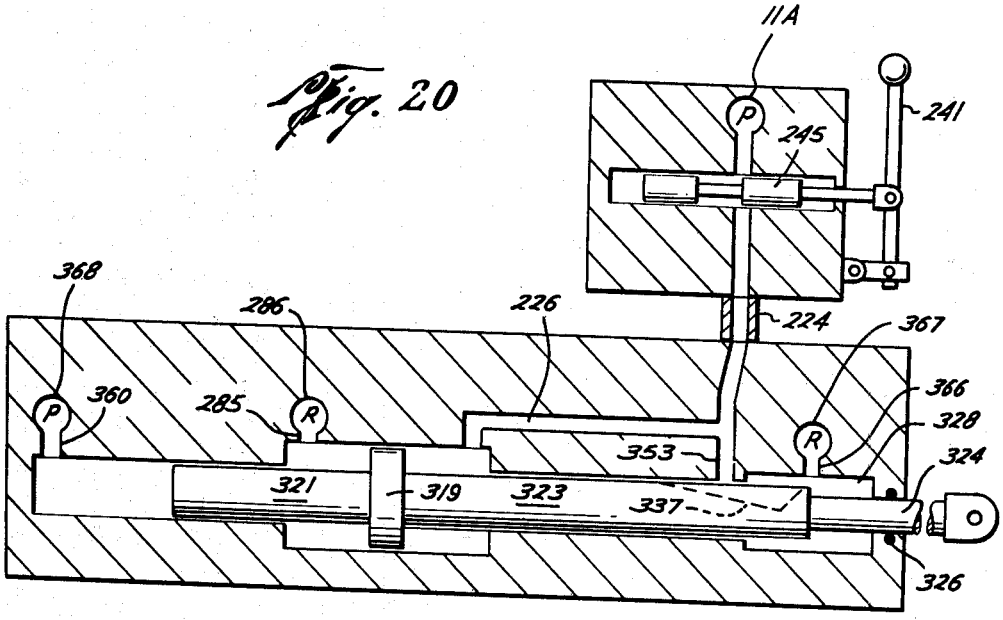
FIGS. 20 and 21 are views similar to FIG. 19 showing other embodiments of the invention using single control lines.

Referring now to FIG. 20 there is shown an embodiment to the invention that is the same as that of FIG. 19, except the transmitter functions by variable throttling as in FIG. 18 instead of by variable venting as in FIG. 19. Like parts are given like numbers to the constructions shown in FIGS. 18 and 19, whereby the operation will be obvious and repeated description rendered unnecessary.

Briefly, movement of manual actuator 241 moves variable restrictor means 245 to variably throttle pressure fluid flowing from conduit 11A to line 224 and passage 226 to the right of piston 319. This causes piston 319 to move to the right or left according to whether pressure falls or rises. Negative feedback by groove 337 causes the initial pressure change in passage 226 to be eliminated, bringing the load piston to rest in a new position.

Figure 21:
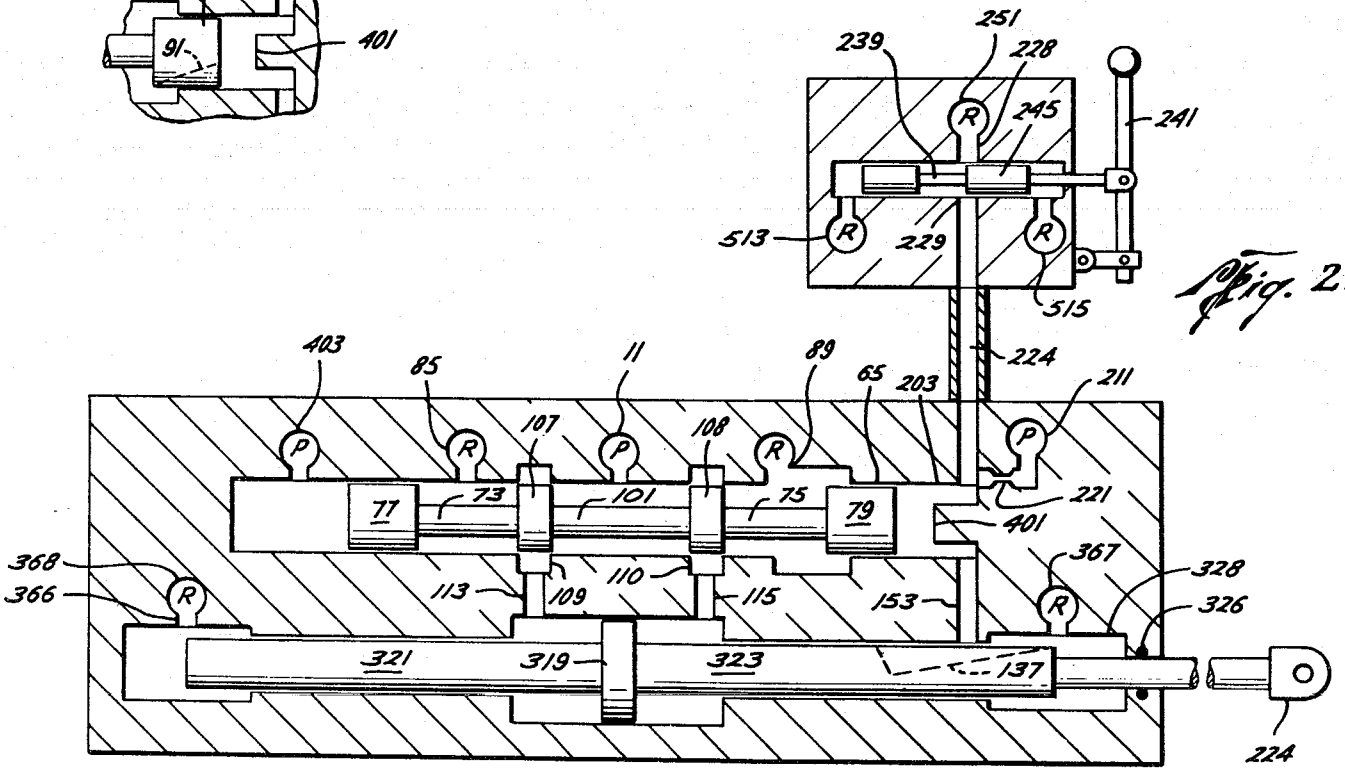

Referring to FIG. 21 there is shown an embodiment of the invention similar to that shown in FIG. 19. In this embodiment a single line is employed between transmitter and receiver and the transmitter functions by variable venting to create the desired pressure change. However, an amplifier is employed in this embodiment of the invention as was illustrated in FIGS. 2 and 17. As in FIG. 4, the amplifier, in this construction, is not provided with feedback means. Like parts are given like reference numbers.

Operationally, movement of manual actuator 241 to the left or right causes pressure to rise or fall respectively in line 224. This causes amplifier spool 101 to move to the left or right, which in turn causes load piston 319 to move to the left or right. Feedback groove 137 increases or decreases the venting of passage 153 when the piston rod 323 moves to the right or left, thereby producing negative feedback to return amplifier spool 101 to its original position and bring the load piston to rest.

It may be pointed out at this time that the feedback groove tapers in different directions according to the requirements of the particular embodiment of the invention so as to always yield negative feedback in the system. If groove 137 in FIG. 21 tapered in a direction opposite to that shown in the illustration, positive feedback would be created that would accelerate the movement of the load piston toward its limiting position in one direction or the other; instead of producing a load piston position that is a direct known function of the movement of the manual actuator.

To insure that feedback passage 153 is never blocked off completely by land 79 on the amplifier spool, a pin 401 is provided at the end of cylinder 65 in which moves the amplifier spool and limits its travel.

Figure 22:
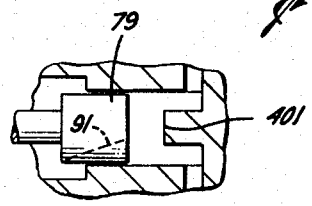
FIG. 22 is a sectional view of elements of the embodiments shown in FIGS. 20 and 21.

Referring now to FIG. 22 there is shown a variation of the amplifier piston illustrated by FIG. 21, constructed to incorporate a negative feedback groove 91. Negative feedback on the amplifier may be used in addition to or in place of negative feedback on the load piston. Preferably, negative feedback is employed with the load piston whether or not it is included in the amplifier. This prevents the load piston from tending to move toward the limit of its range of possible movement as soon as the transmitter activator is moved marginally.

Figure 23:
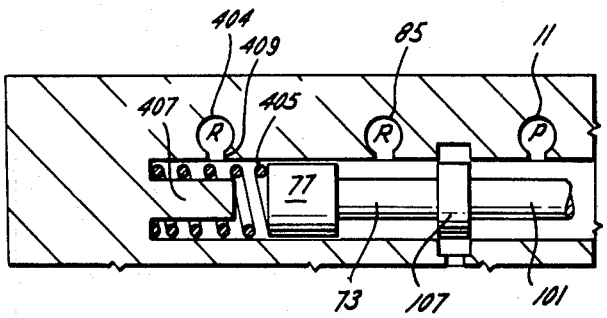
FIG. 23 is a fragmentary schematic sectional view of a portion of an embodiment of the invention.

Referring to FIG. 23, there is shown a further variation of the amplifier shown in FIG. 21. In the embodiment of the invention illustrated by FIG. 21 amplifier spool 101 is exposed to pressure by conduit 403 from a constant pressure source that is at a lower pressure than the pressure in conduit 211. This pressure opposes the variable pressure received by passage 203, which is responsive to the transmitter and causes the amplifier piston to move.

In the variation of the embodiment of the invention illustrated by FIG. 23, left end of amplifier spool 101 is exposed to reservoir pressure received through passage 404. A helical compression spring 405 is added to provide some of the reaction force on the amplifier spool needed to bring the spool into balance with transmitter pressure. This spring eliminates the need for an additional constant pressure source by providing a bias on piston 101. It also changes the system's response characteristics, since the reactive force provided by the spring varies with its degree of compression according to Hooke's Law. The spring is disposed concentrically around a pin 407, which centers the spring and functions like pin 401 (FIG. 21) to keep land 77 at the end of spool 101 from blocking passage 409 to conduit 404. If desired, the variation of the preferred embodiment of the invention illustrated by FIG. 23 can be used in conjunction with those novel features disclosed in FIG. 22.

Figure 24:
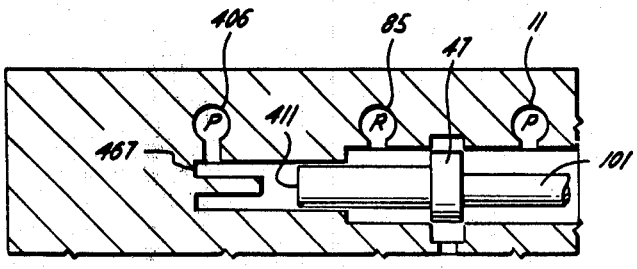
FIG. 24 is a view similar to FIG. 23 showing a portion of another embodiment.

Referring now to FIG. 24 there is shown a further variation of the amplifier initially illustrated in FIG. 21. In this construction, end 411 of amplifier spool 101 has a reduced end area so forces on the ends of the spool can be balanced by pressure acting on the left end of the piston from conduit 406. Conduit 406 is at the same pressure as conduits 211 and 11. This modification eliminates the need for spring 405 and provides a system having a different response characteristic because the pressure on spool end 411 remains constant. This construction can be used in combination with the feedback constructions illustrated in the embodiment of the invention shown in FIG. 22.

Figure 25:
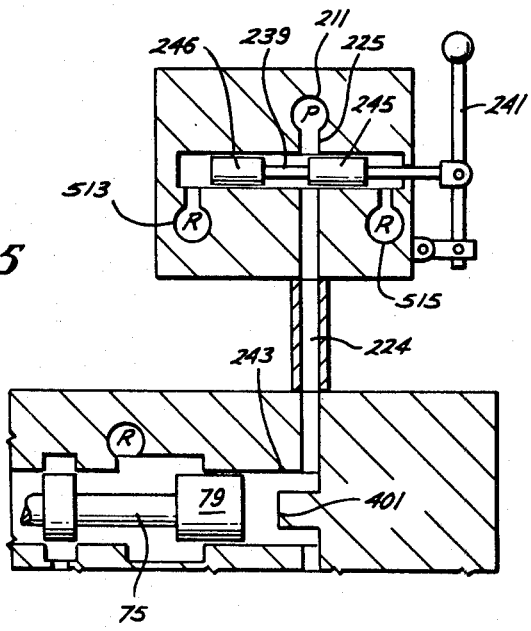
FIG. 25 is a fragmentary, largely schematic sectional view showing a portion of an embodiment of the invention.

The embodiment of the invention illustrated in FIG. 21 can be modified for use with a variable restrictor or throttling type of transmitter. Such a variation is illustrated by FIG. 25. The operation of this type of transmitter is the same, operationally, as the embodiment shown in FIG. 20. It may be noted, however, that to prevent the possibility of hydraulic locking due to leakage around control land 245 and guide land 246 the ends of the transmitter cylinder are vented to reservoir pressure by conduits 513 and 515. A similar constructin is used in the embodiment of the invention illustrated in FIG. 21. This variation of the preferred embodiment of the invention's transmitter illustrated by FIG. 25 can be used with any of the amplifier constructions illustrated by FIGS. 21 through 24.

Figures 26, 28, 29:
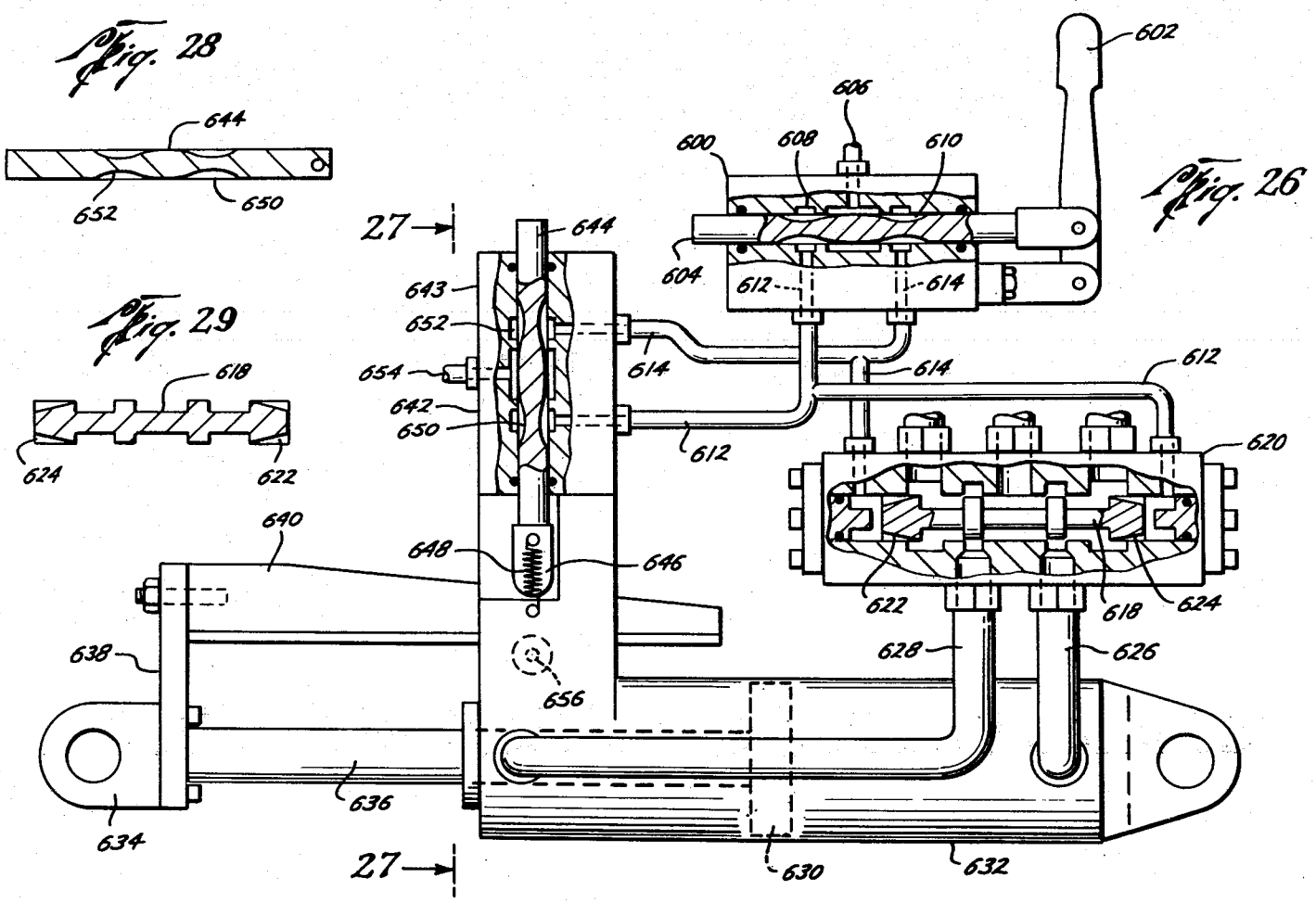
FIG. 26 is a fragmentary sectional view of a commercial embodiment of the invention.
FIGS. 28 and 29 are sectional views of valves used in the invention's embodiment depicted in FIG. 26.

FIG. 26 illustrates a commercial embodiment of the invention. In this embodiment transmitter 600 has a lever 602 connected to grooved valve rod 604 and adapted to move the valve rod to variably obstruct the flow of fluid from pressure conduit 606 through grooves 608 and 610, thus creating a pressure differential between lines 612 and 614. Differential pressure moves spool valve 618 in amplifier 620. Spool valve 618 is supplied with feedback grooves 622 and 624. Movement of the amplifier's spool valve creates a pressure imbalance between conduits 626 and 628. This imbalance of forces moves piston 630 in load cylinder 632 as has been described earlier. Piston 632 is connected to clevis 634 by rod 636. The clevis is attached to a plate 638, which is provided with a cam 640 used to actuate feedback 642. Feedback 642 has a body 643 in which is mounted a grooved valve 644. The valve is attached to a wheel 646 and constrained by spring 648 to move to a position dependent on the position of cam 640 and thus on the position of piston 630 and clevis 634. As the valve's position is varied by movement of load piston 630, lines 612 and 614 are variably vented via grooves 650 and 652 in valve rod 644 to return line 654. This venting tends to reduce the pressure imbalance acting on the amplifier's spool valve causing it to return to a neutral position and stopping movement of the load piston. Hence the clevis and the load attached to it will come to rest at a position dependent on the displaced position of the transmitter's control lever 602.

In this commercial embodiment, the amplifier spool valve and load piston both incorporate feedback means taught by the preferred embodiment of the invention. These feedback means are shown working in cooperation to produce a final clevis position that is a known function of the control lever's position.

Figures 27, 30, 31:
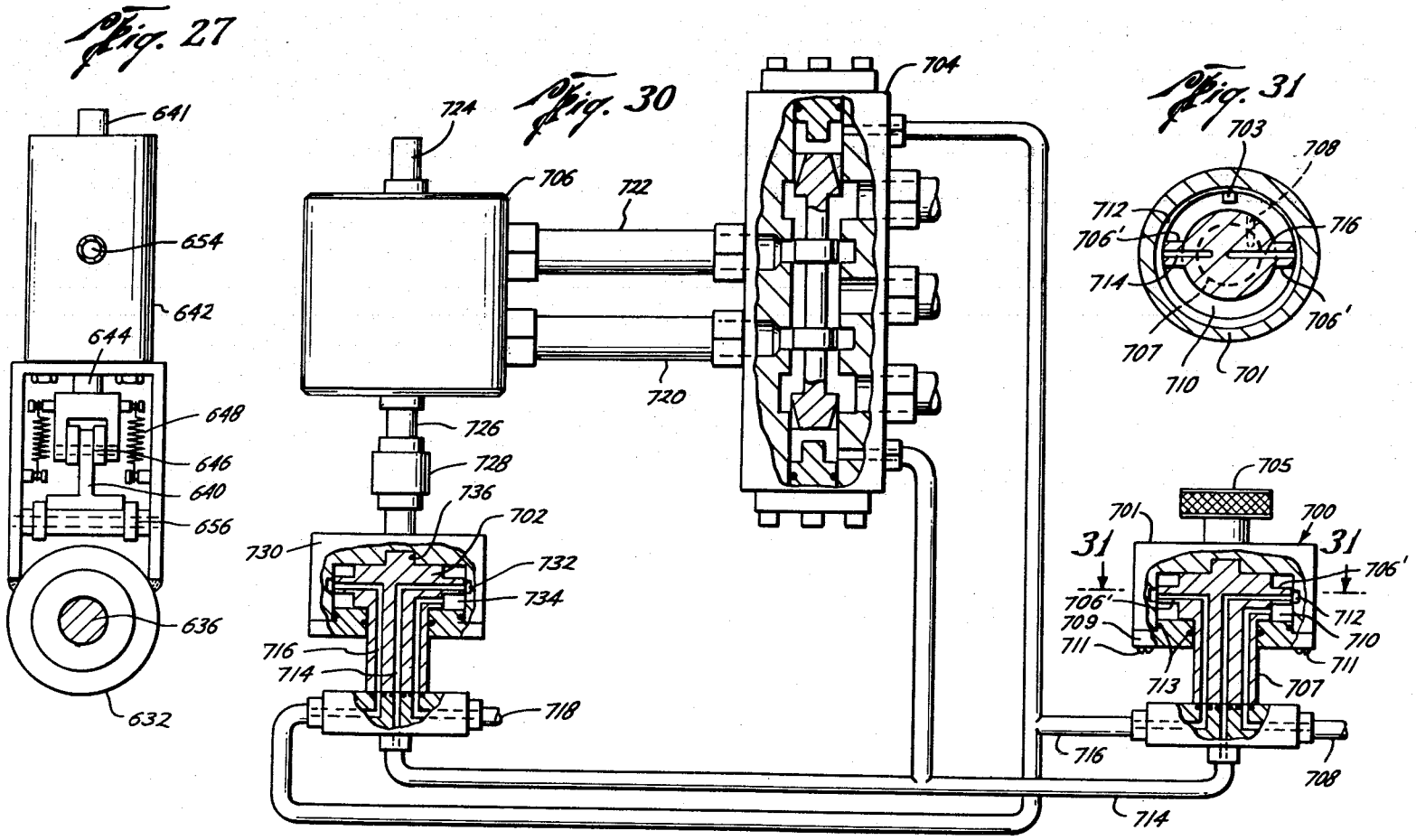
FIG. 27 is an elevational view of a section of FIG. 26 taken along lines 27—27.
FIG. 30 is a partially sectional view of another commercial embodiment of the invention.
FIG. 31 is a sectional view of the transmitter illustrated in FIG. 30 taken along lines 31—31.

FIG. 27 shows an isometric view of feedback 642 along lines 27–27 of FIG. 26. Springs 648 are shown biasing roller 646, which is attached to valve rod 644, into contact with inclined form 640. The cam which is shown as being "T" shaped in this illustration, rests on lower roller 656, which is a guide roller.

FIGS. 28 and 29 illustrate sectional views of the feedback valve rod and amplifier spool valve, respectively, clearly showing the feedback grooves taught by the preferred embodiment of the invention.

FIG. 30 illustrates a second commercial embodiment of the invention. In this embodiment a rotary transmitter 700 and a rotary feedback 702 operate with an amplifier 704, which is substantially the same as amplifier 620 illustrated and described in FIG. 26, and hydraulic motor 706 to produce a rotary fluidic servo system.

Transmitter 700 has a rotatable head 701 constrained by stop 703 (see FIG. 31) to be rotatable by wheel 705 through 180 degrees. Head 701 is mounted concentric to and rotatably on control shaft 707 so as to define therebetween an annular space 710. Inside of head 701 there is an eccentric circular groove 712. Bottom plate 709 is affixed to head 701 with screws 711. Seal rings 713 maintain the pressure integrity of the transmitter.

Fluid under pressure is introduced from a source, not shown, to conduit 708. This pressurizes annular space 710 that is in fluid communication with eccentric groove 712. This eccentric groove, which is clearly illustrated in FIG. 31, differentially pressurizes conduits 714 and 716 that extend to the ends of radially projecting arms 706' on shaft 707, and are connected to the control inputs of fluidic amplifier 704. As conduits 714 and 716 are differentially pressurized by fluid flowing under pressure through their respective sections of groove 712, amplifier 704 acts to control hydraulic motor 706 by establishing differential pressures in output conduits 720 and 722. Motor 706 has a two ended output shaft. End 724 is connected to a load or indicator as may be appropriate. End 726 is connected through coupling 728 to the rotary head 730 of feedback 702. Feedback 702 is structurally identical to transmitter 700. In the feedback differentially pressurized conduits 714 and 716 are variably vented via eccentric groove 732 through communicating chamber 734 to conduit 718, which is connected to a fluid reservoir, not shown. Variable venting tends to equalize pressures in conduits 714 and 716, causing the rotation of shaft 724 of hydraulic motor 706 to cease at a position that is a known function of the rotational displacement of transmitter 700's control knob 705. Stop 703 is adapted to prevent the rotation of eccentric groove 712 in head 701 past its point of greatest difference in flow with respect to the conduits opening into said eccentric groove from control shaft 707. A similar stop, not shown, performs the same function with respect to venting these conduits in feedback 702.

FIG. 31 is a sectional view of transmitter 700 taken along line 31—31. It illustrates the fluid communication of conduits 714 and 716 with eccentric groove 712 and shows the differential variable obstruction provided by the groove between conduit 708 and each of conduits 714 and 716. The geometry of this eccentric groove may be varied in both the transmitter and the feedback to obtain a desired feedback function between the transmitter and the load in the illustrated servo system.

Figure 32:
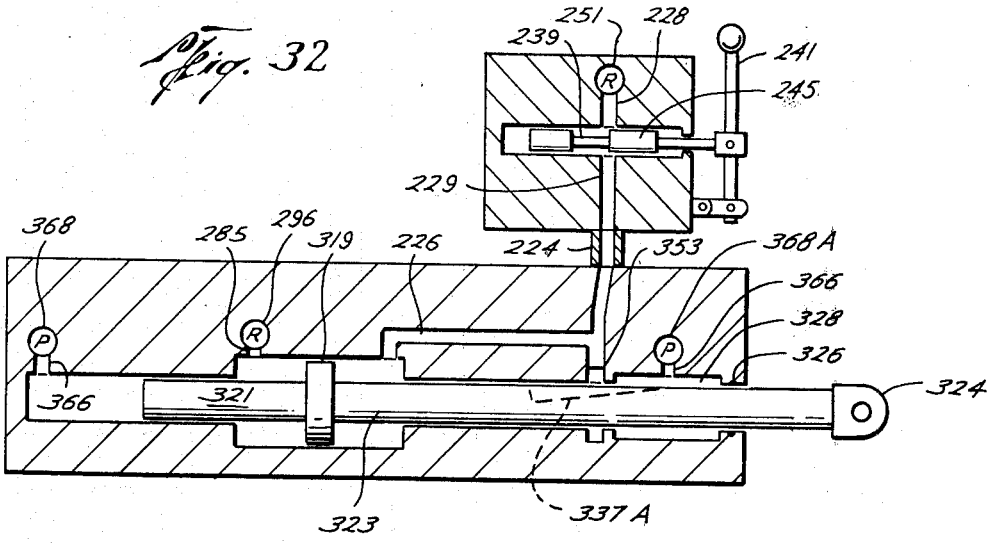
FIG. 32 is a largely schematic sectional view illustrating another embodiment of the invention somewhat similar to the embodiment of FIG. 19.

Referring now to FIG. 32 there is shown a single line fluidic repeater which is similar to that shown in FIG. 19 and like parts are given like reference numbers. However, feedback is effected by variable throttling of the fluid from pressure source 368A, which may be the same as source 368 or a different source at the same or different pressure, rather than variable venting to reservoir 367 as in FIG. 19. This effects a simplification in the number of fluid passages required as compared with the FIG. 19 construction. This also illustrates that the feedback need not always be effected by variable venting as in the previously described embodiments. The feedback groove 337A of FIG. 32 has a reverse slope compared to that of FIG. 19 due to the fact it is operating by throttling instead of venting.

Figure 33:
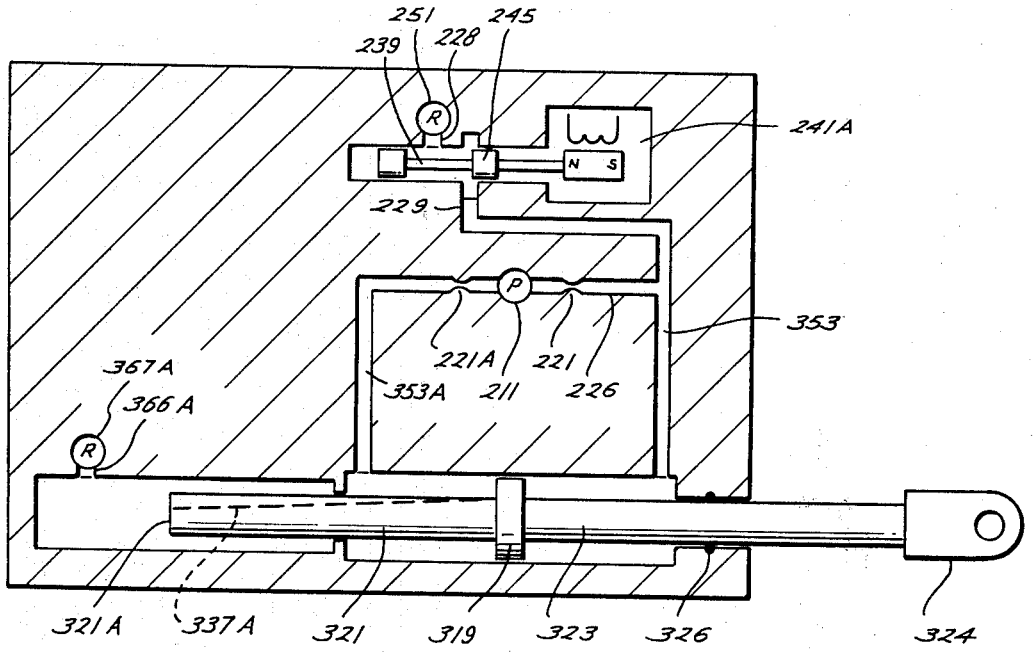
FIG. 33 is a view similar to that of FIG. 32 showing a further modification.

Referring to FIG. 33 there is shown a single line fluidic repeater which is similar to that shown in FIG. 19, like parts being given like reference numbers. A minor difference is that a torque motor 241A serves as an actuator in the FIG. 33 embodiment, taking the place of the manual actuator 241 of FIG. 19. More importantly, the feedback means including groove 337A and reservoir return line 366A is on the opposite side of the load piston from the variable pressure line 353 coming from the transmitter. Also, in FIG. 33 the piston end 321A is exposed to reservoir pressure rather than the reverse as in FIG. 19. In the FIG. 33 arrangement, the two sides of the piston 319 are both exposed to vented pressure fluid, vented by the transmitter on one side and vented by the feedback on the other side, and equal end areas of the piston are exposed to atmospheric or reservoir pressure, so that a balance is easily achieved without the need for a pressure source at the end of the piston rod as on FIG. 19.

Figure 34:
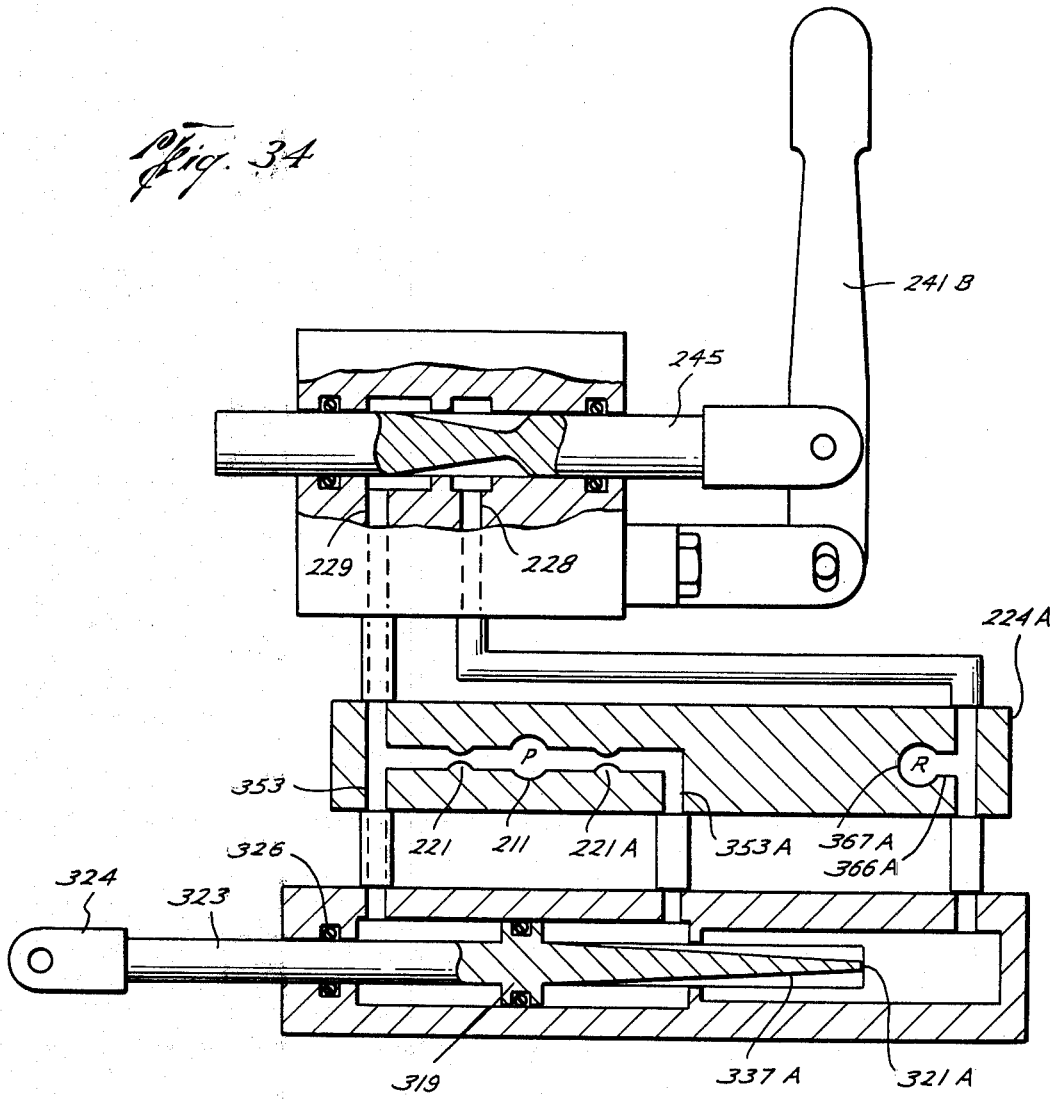
FIG. 34 is a view largely in section showing a commercial embodiment and slight modification of the apparatus shown in FIG. 32.

FIG. 34 is the same system as is shown in FIG. 33 but illustrates a commercial embodiment as distinct from the schematic showing in FIG. 33. Like parts are given the same numbers. Also, in FIG. 34 sink and source manifold 224A is provided to which connections are made as required for both reservoir pressure and for pump pressure.

Figure 35:
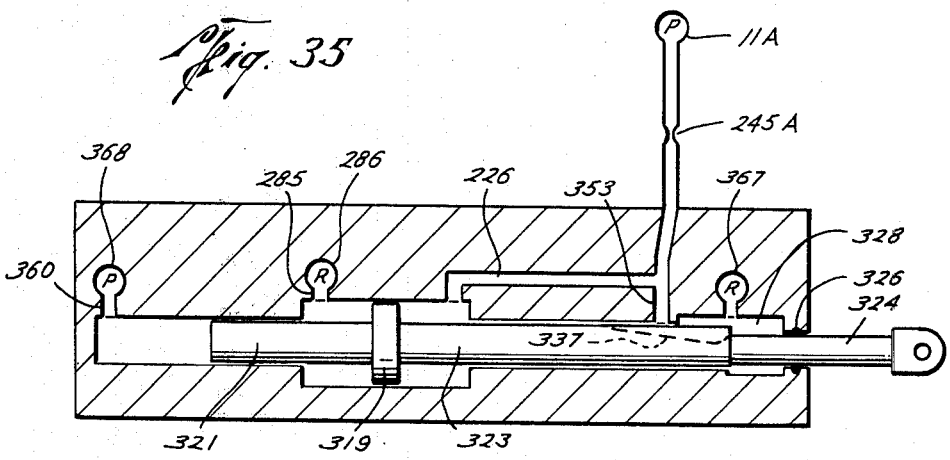
FIG. 35 is a largely schematic sectional view illustrating a modification of the invention shown in FIG. 20.

FIG. 35 illustrates a single line system the same as that shown in FIG. 20 except that the transmitter has a fixed choke 245A instead of a variable throttle valve 245. By changing the size of the choke 245A movement of this load piston can be effected. Operation would be in distinct steps rather than continuous.

Figure 36:
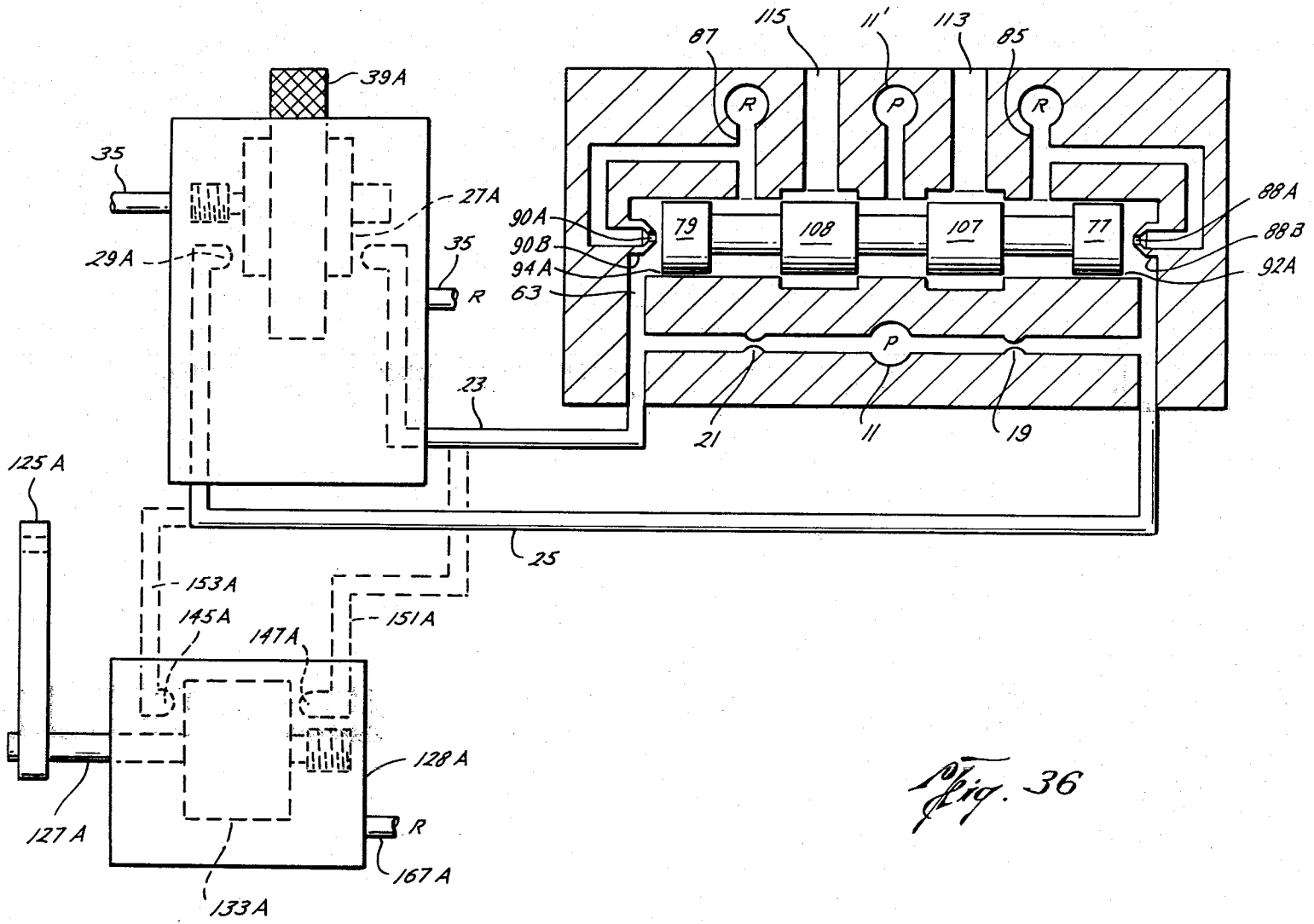
FIG. 36 is a largely schematic view partly in section illustrating a modification of a form of the invention shown in FIG. 5.

FIG. 36 illustrates an embodiment of the invention which is similar to that of FIG. 5, and like parts are given like numbers. However, instead of providing feedback grooves in the pistons 77, 79 as in the FIG. 5 embodiment, feedback vent ports 88A, 90A are provided in the tips of tubes 88B, 90B in the ends of the amplifier cylinder leading back to the reservoir via passages 85, 87. The ends 92A, 94A of the amplifier piston restrict flow through ports 88A, 90A to varying degrees according to the proximity of the piston ends to the ports, thereby providing variable venting according to the position of the amplifier piston. The tubes 88B, 90B provide stops limiting axial travel of the amplifier piston, preventing it from blocking the passages 61, 63 from the transmitter.

FIG. 36 also illustrates the addition of a load feedback means inside of housing 128A (compare FIG. 1) actuated by the load via bar 125A. As the load piston, not shown but similar to that of FIG. 1, travels axially, the bar 125A connected thereto causes axial travel of bolt 127A and disc 133A secured thereto. Disc 133P variably restricts flow vent nozzles 145A, 147A according to the position of the disc relative to the nozzles. The nozzles are connected by fluid lines 141A, 153A to lines 23, 25, thereby to vent the ends of the amplifier cylinder. Disc 133A and nozzles 145A, 147A are located inside the housing 128A which is vented to the reservoir via passage 167A. The operation is like that of FIG. 1 embodiment.

Figure 37:
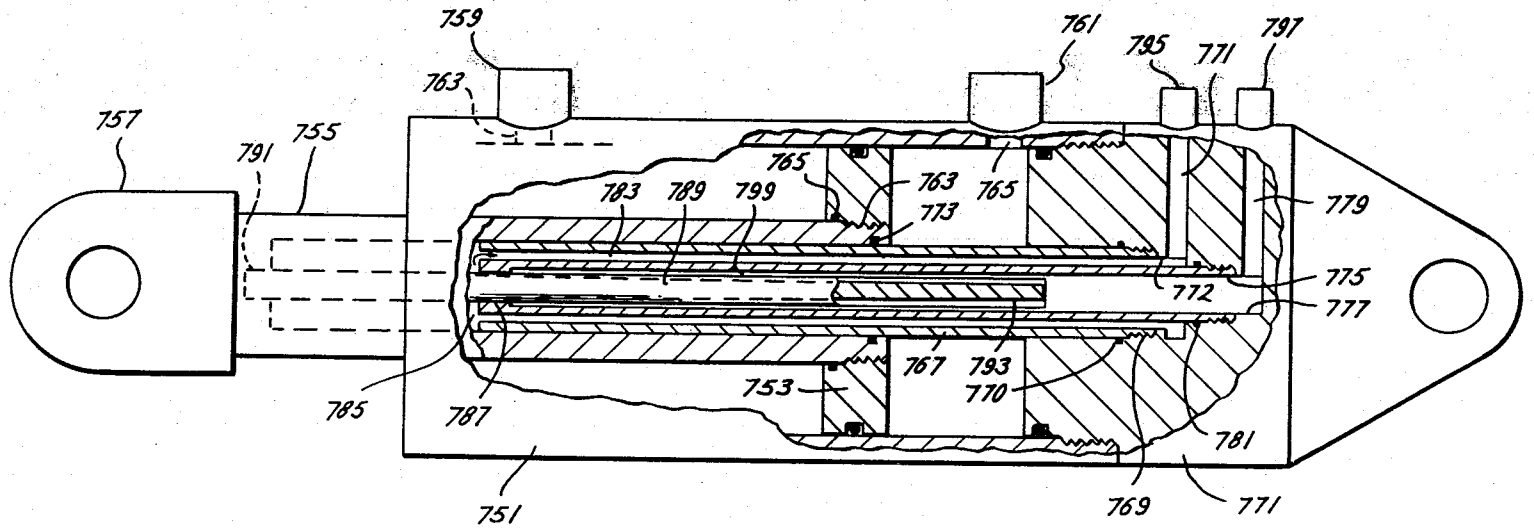
FIG. 37 is a side elevation, largely in section, of a load cylinder with a feedback means incorporated therein in accordance with one form of the invention.

Referring now to FIG. 37 there is shown a load cylinder 751 in which moves piston 753 to which is connected piston rod 755. A clevis 757 on the end of the road provides means for making connection with a load to be driven. Fluid for moving the piston in the cylinder is supplied via fluid lines 759, 781 connected to ports 763, 765 in the side wall of the cylinder. For example, fluid lines 759, 761 could be connected to lines 113, 115 of the FIG. 21 construction in place of the piston and cylinder there shown. However, in addition to such substitution the load feedback means of the FIG. 21 construction would also be omitted for the load feedback means of the FIG. 37 construction, now to be described, would take its place. In the FIG. 37 construction the load feedback means is incorporated into the load piston and cylinder.

Referring once more to FIG. 37, piston rod 755 is tubular and is threadedly connected to a threaded hole 763 in piston 753, being sealed thereto by O-ring 765. A tubular stinger 767 is threadedly connected to a threaded socket 769 in cylinder head 771 and is sealed thereto by O-ring 770. Bore 772 at the bottom of socket 769 communicates with radial passage 771 in the cylinder head. Stinger 767 extends into piston rod 775 through the end thereof that is screwed into hole 763. Stinger 767 is sealed to piston rod 755 by O-ring 773 which provides a sliding seal.

Valve tube 775 is screwed into a threaded socket 777 beyond bore 772 in the cylinder head 771. Bore 777 in the bottom of socket 777 communicates with radial passage 779 in the cylinder head. Tube 775 is sealed to socket 777 by O-ring 781. Tube 775 extends concentrically inside stinger 776 and being of smaller outer diameter than the inner diameter of the stringer forms as annular fluid passage 783 therebetween. Passage 783 opens into the space 785 in piston rod 755. The free end of tube 767 is provided with an annular inturned radial flange whose inner periphery provides a needle valve seat 787. A needle 789 is screwed into a socket 791 in the closed end of the piston rod adjacent clevis 757. The needle is provided with one or more tapered grooves 793 on its outer periphery variably by-passing seat 787. It will be apparent that fluid lines 771, 779 in the cylinder head 771 will be interconnected via annular passage 793 in the stinger and the interior passage 799 in the valve tube, and that flow through such connection will be variably throttled or restricted by needle 789 and seat 787 according to the axial position of piston 753 in cylinder 751. When incorporated into the FIG. 21 construction, fluid lines 795, 797 would connect to fluid passage 153 and return conduit 367, and the needle valve controlled fluid path from lines 795 to 797 would provide the desired variable negative feedback means.

Referring now to FIG. 37 there is shown an application of the invention to a crane to be used for loading a floating vessel, the motion of the vessel being compensated whereby the crane operator can load the vessel much the same as if the vessel were stationary. The general system of such compensation is already known, e.g. from U.S. Pat. No. 3,309,065—Prudhomme et al, so that is need be described only briefly. Crane 801 includes a support means 803 which may be a fixed or mobile platform but in any case affixed to land or sea floor. A cab 805 is pivotally mounted on the platform for rotation about vertical axis. A boom 805 is pivotally mounted on the cab for swinging up and down about a horizontal axis. Motor means not shown are provided for rotating the cab and moving the boom up and down. A cable 807 is wound on a power winch (not shown) mounted in the cab. The free end of the cable passes over pulleys 809 811 on the end of the boom and thence down to a hook 815 supporting load 817 over floating vessel 817.

Hydraulic servo motor 819 includes therewithin a piston 821 having a rod 823 extending up toward cable 807. The rod 823 is provided at its upper end with a pulley 825 adapted to pull a bight in the cable as shown at 827 in dashed lines. The length of the bight is controlled in accordance with the up and down motion of the vessel 817 by means of transmitter 829.

Transmitter 829 is mounted on arm 831 pivotally mounted at 833 on a bracket 834 for swinging up and down about a horizontal axis, this bracket being mounted on platform 803 to be turnable about a vertical axis at 835. Servo cylinder means 837 is provided for adjusting the elevation of arm 831.

The transmitter has a drive stem 839 which is moved axially in accordance with the vertical position of vessel 817 by line 841. One end of line 841 is connected to arm 831. The line passes between pulleys 843, 845 mounted on drive stem 839 and a pole 847 affixed to arm 831. The line extends down and is attached at its other end to weight 849 resting on vessel 817. As the vessel falls, the weight 849 tensions the line, moving drive stem 839 out from transmitter 847. As the vessel rises, the tension in the line is reduced and the stem 830 moves back into the transmitter under the action of bias springs.

Figure 38:
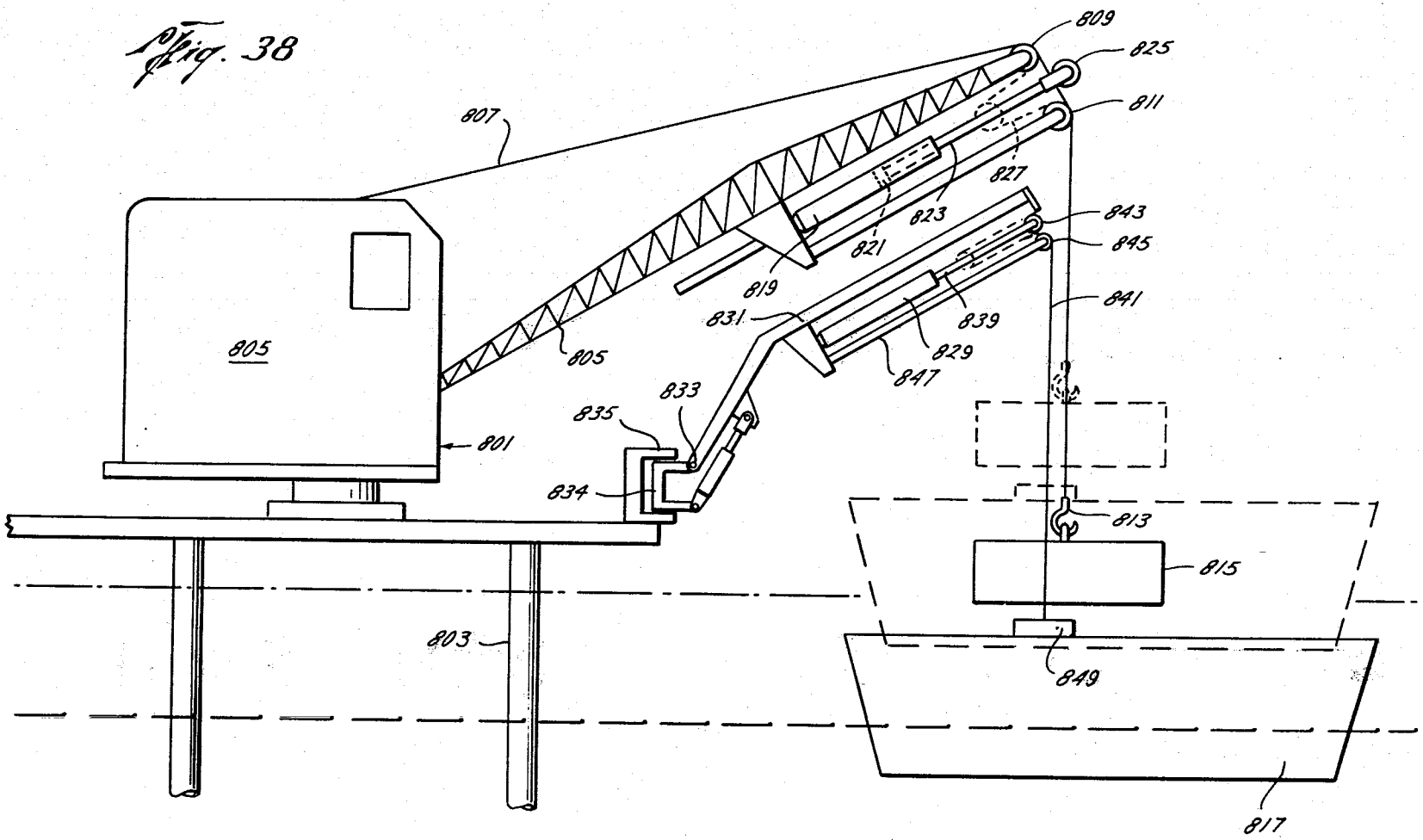
FIG. 38 is a side elevation, partly schematic, showing the invention incorporated in apparatus for loading a floating vessel by a crane located on a pier.
Figure 39:
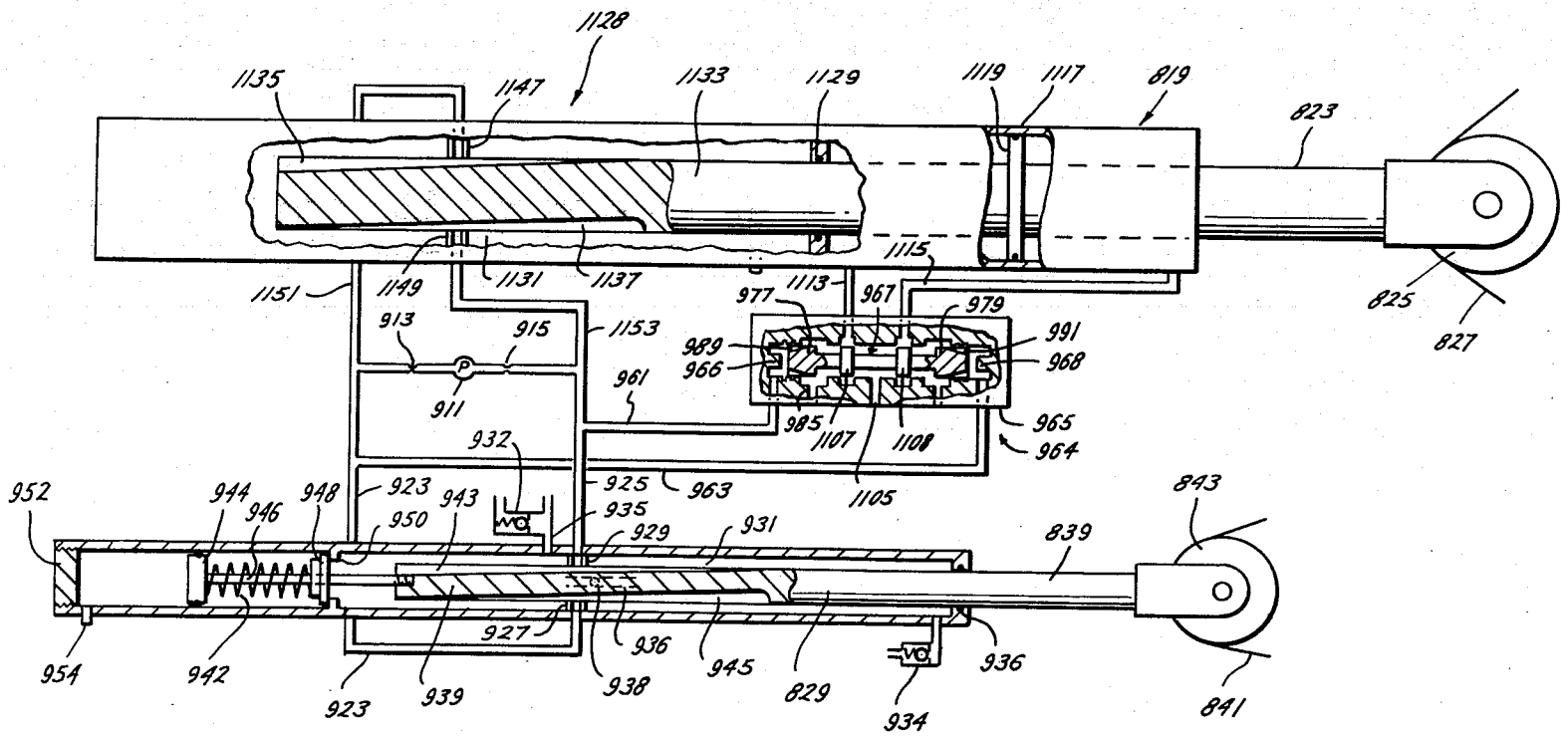
FIG. 39 is a largely schematic elevation, partly in section, of the hydraulic system and related parts of the apparatus shown in FIG. 38.

Referring now to FIG. 39 there are shown the details of the transmitter 829 and the servo motor 819 and the means connected therebetween, all in accordance with the invention. The system of FIG. 39 is operationally generally similar to that of FIG. 1 in that it includes a transmitter 829, amplifier with feedback, and load piston and cylinder 819 with feedback, for which reason the like parts will be given the same numbers as in FIG. 1 plus 900. Thus there is a source of pressure fluid 911, flow restricting orifices 913, 915, and output lines 961, 963. Vent lines 923, 925 lead to vent ports 927, 929 in transmitter cylinder 931. The ports open at the side of valve rod 939. Rod 939 has oppositely tapering longitudinal grooves 943, 945 extending along the length thereof aligned with ports 927, 929 whereby flow out of vent ports 927, 929 is variably restricted according to the axial position of valve stem 839 in accordance with the rise and fall of the vessel 817 (FIG. 38). Two spring loaded relief valves 932, 934 venting to the hydraulic sump prevent excessive pressure build up in cylinder 931. A seal 936 is provided at the end of cylinder 931 where valve stem 839 enters. A key-way 936 disposed at ninety degrees from grooves 943, 945 extends longitudinally of valve rod 939 the same distance as grooves 943, 945 and receives pin or key 938 extending inwardly from cylinder 93 to prevent rotation of rod 939, thereby keeping grooves 943, 945 aligned with ports 927, 929.

Suitable biasing means such as compression spring 940 bearing at one end against sealed piston 944 carried by extension rod 946 urges valve stem 939 to the left from the neutral position illustrated in which both vent ports 927, 929 are equally open or restricted. Spring 942 bears at its opposite end against washer 948 resting against pins 950. Travel of piston 944 is limited by screw plug 952 in the end of cylinder 931. A vent 954 to the hydraulic sump prevents pressure build-up in the cylinder 931 between plug 952 and sealed piston 944. When valve stem 839 moves from the position shown, ports 927, 929 are unequally opened or restricted, thereby creating a pressure differential between transmitter output lines 961, 963.

Lines 961, 963 lead to amplifier cylinder 965 in which moves free piston 967 between stops 966, 968 which prevent the piston from blocking the lines 961, 963 where they enter the cylinder. The details and operation of the amplifier 964 are the same as those of the amplifier of FIG. 1 and need not be described further. It may be noted, however, that because there are pairs of vent grooves 989, 991 at each end of piston 967, radial play is balanced out, radial movement tending to close up one of vent grooves 989 causing opening of the companion groove 989, and the same holds true for vent grooves 991. Instead of pairs of diametrically opposite vent groove, other numbers of azimuthally spaced vent grooves could be employed such as three at 120 degrees, four at 90 degrees, etc., to effect balancing out of the effects of radial play.

Output lines 1113, 1115 lead from the amplifier to servo motor 819 comprising load cylinder 1117 and load piston 1119. These function the same as the load cylinder 117 and piston 119 of the FIG. 1 embodiment, moving piston rod 822 back and forth in accordance with the movement of transmitter valve rod 839, thereby shortening and lengthening bight 827 to compensate for up and down motion of vessel 817 (FIG. 38).

The load feedback means 1128 is similar to that of FIG. 1 except that vent grooves 1135, 1137 are formed on opposite sides of an extension 1133 of piston rod 823, the cylinder 1131 in which the extension moves being an extension of the load cylinder 1117. The cylinder chambers are separated by seal 1129. Similar to the construction of transmitter 829, ports 1147, 1149 through the wall of cylinder 1131 cooperate with vent grooves 1135, 1137 and connect to lines 1151, 1153 leading back to the transmitter. The load piston 1119 is positively positioned hydraulically so no venting springs are required.

It will be noted that all of the various vents for the transmitter output lines 961, 963 are in parallel. In particular, the transmitter vents, the amplifier feedback vents, and the load feedback vents are all in parallel. Fluid being vented by the amplifier feedback vents does not flow through the flow restrictions of the transmitter vent system or those of the load feedback system. Fluid being vented by the load feedback vents does not flow through the restrictions of the transmitter or the amplifier feedback vents. Fluid being vented by the transmitter does not flow through the amplifier feedback restrictions or the load feedback restrictions. This makes possible multiple feedbacks which otherwise would be very difficult if not impossible to design. This independence of the several venting systems is an important feature of this invention.

Figure 40:
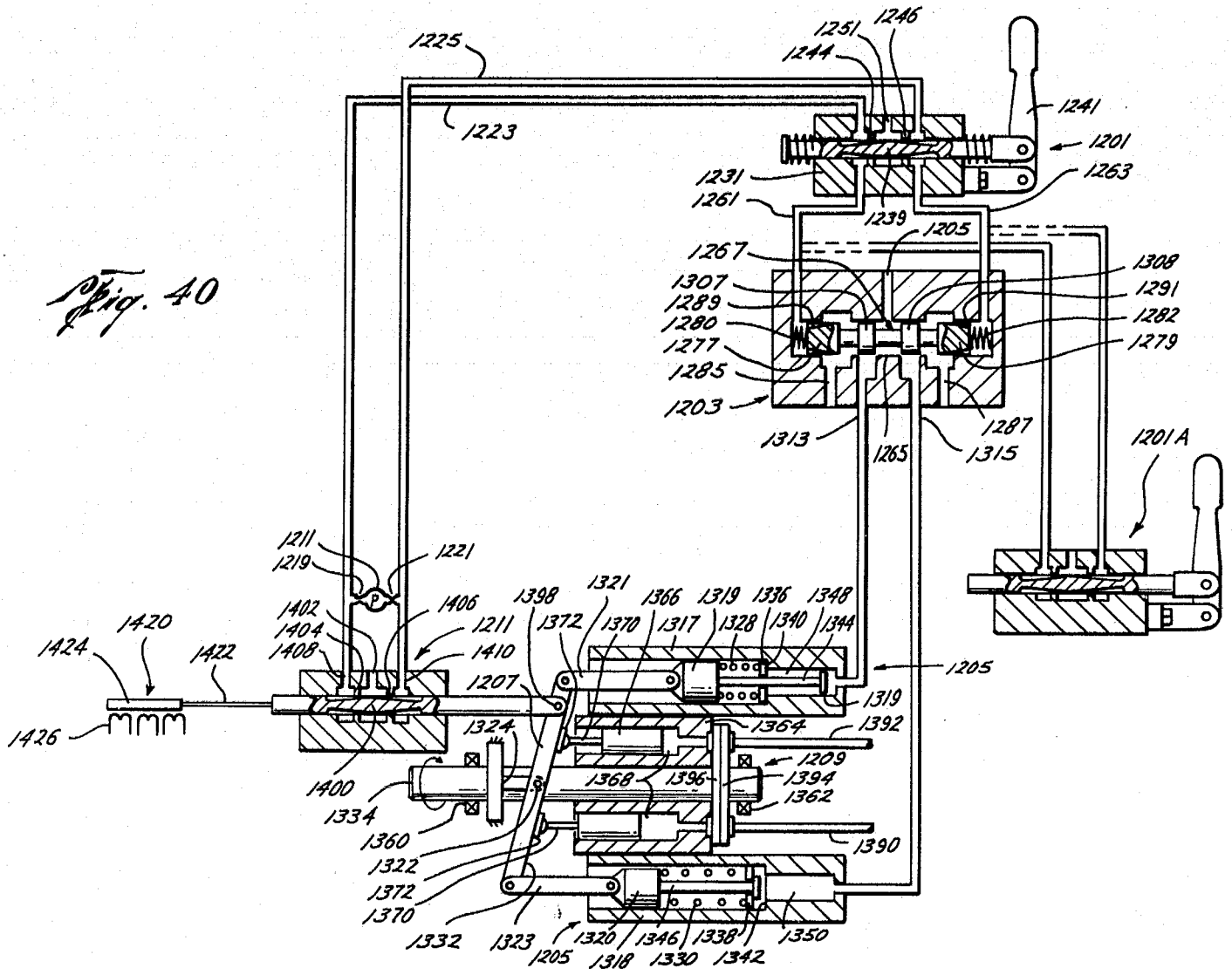
FIG. 40 is a sectional view of apparatus according to the invention incorporated into a system for varying the angle of a swash plate controlled motor-pump unit.

Referring now to FIG. 40 there is shown an embodiment of this invention in a servo control for a swash plate, e.g. a swash plate controlling a pump or motor. Servo controls for swash plates broadly stated are already known, for example, as disclosed in U.S. Pat. No. 3,302,585 to Adams et al, so that the swash plate pump need not be disclosed in great detail. The system disclosed herein will serve, however, to illustrate certain further variations of the subject servo system as well as the particular applicability of the subject system and its parallel independent feedback system for control of the angle of a swash plate.

The system includes a transmitter 1201, an amplifier 1203, servo motor means 1205, swash plate 1207, motor/pump 1209, and load feedback 1211. Except for the swash plate load, the system is similar to that of FIG. 1 and analogous or like parts will be given the same number as in FIG. 1 plus 1200.

The transmitter includes valve body or cylinder 1231 in which moves double tapered needle 1239. Needle 1239 is actuated manually by lever 1241 although motor means, e.g. as employed in FIG. 1 could be used if desired. The needle is urged to central or neutral position by springs 1240, 1242 disposed around the ends of the needle, the ends being enlarged to guide the needle in its axial travel within cylinder 1231. Suitable sealing means, not shown, is employed to seal between the ends of the needle and the cylinder. If desired, the centering springs could be omitted in which case the transmitter would be like that of FIG. 26.

According to the position of actuator lever 2141 and the resultant axial position of needle 1239, its tapered portions enter more or less into the valve seats 1244, 1246 to variably obstruct or throttle fluid flow from pressure fluid lines 1223, 1225 to reservoir port 1251. Lines 1223, 1225 are supplied from from pressure fluid source 1211 through flow restrictors 1219, 1221. The transmitter output lines 1261, 1263 are connected to amplifier 1203.

Amplifier 1203 includes cylinder 1265 within which moves free piston 1267. The ends of the piston are exposed to the pressures in lines 1261, 1263. Two lands 1277, 1279 at the ends of the piston are each provided with one, preferably two or more equiazimuthally spaced tapered grooves 1289, 1291 which vent pressure fluid from transmitter output lines 1261, 1263 to the reservoir through ducts 1285, 1287 in an amount varying according to the axial position of piston 1264. Helical compression springs 1289, 1291 urge the piston 1264 to its midposition. If the piston is displaced by pressure differential between lines 1261, 1263, it moves only an amount sufficient to restore balance. Balance is restored by reduced pressure differential caused by venting through feedback vent grooves 1289, 1291 and by increased and opposing differential spring force from springs 1289, 1291. The relative magnitude of these two balance restoring effect will depend on the spring constants and degree of precompression, if any, and on the size and shape of the vent grooves and the like. The spring could be omitted altogether, in which case the construction would be like that of the amplifier of FIG. 26.

It is to be noted that the venting of the lines 1261, 1263, by the feedback grooves 1289, 1291 is in parallel with the venting effected by the transmitter. Fluid passing from lines 1261, 1263 going through the restrictions of transmitter needle 1239 to the passage 1257 for return to the reservoir does not pass through the restrictions of feedback grooves 1289, 1291. This parallel arrangement is advantageous over systems such as shown in U.S. Pat. No. 2,709,421 to Avery wherein the amplifier feedback is in series with the transmitter. In the series arrangement, the effect of the feedback depends on the amplitude of the transmitter input. Like light bulbs in series, if one is out, the whole string is out. With the parallel arrangement herein disclosed, an additional transmitter 1201A may be provided in parallel with the transmitter 1202 across lines 1261, 1263, enabling the system to be controlled from either of two spaced apart stations whereat are located the respective transmitter. As many paralleled transmitters can be employed as desired.

The piston 1207 of amplifier 1302 has two loads 1307, 1308 which, as in a spool valve, control flow pressure fluid from duct 1205 to ducts 1313, 1315 leading to the swash plate 1205 constituting the load. At this point the system differs somewhat from the system of FIGS. 2 and 26 in that the output lines from the amplifier do not go to opposite sides of one load piston of a simple piston and cylinder means but instead go to two cylinders 1317, 1318 in which travel pistons 1319, 1320. However, pistons 1319, 1320 are interconnected by piston rods 1321, 1323 pivotally connected to the pistons and to flat circular disc or swash plats 1207. The swash plats 1207 is pivotally mounted at diametrically opposite points, e.g. as at 1322, in a fixed supporting frame or trunnion cradle 1324. The load in the system therefore includes a compound piston and cylinder means wherein the action of the two pistons 1319 and 1320 is not independent, the pistons being linked together via the swash plate.

Absent any pressure differential between lines 1313 and 1315, the helical centering springs 1328, 1330 disposed in cylinders 1317, 1318 position the swash plate with its face plane 1332 perpendicular to the axis of shaft 1334. The springs each bear at one end against one of the pistons and at the other end against a washer or ring 1336, 1338 which in turn are adapted to bear against shoulders 1341, 1342 in the cylinder walls. The springs may be under a certain amount of precompression effected by screws 1344, 1346 which are screwed into the pistons and whose heads engage the washers. The cylinders are provided with extensions 1348, 1350 into which the screws can extend when the associated spring is compressed, as shown in the case of spring 1328. On the other hand, if the swash plate displacement exceeds the precompressed length of the spring, the associated screw and washer keep the spring in contact with the piston as shown in the case of spring 1330.

The motor/pump unit 1209 includes the aforementioned shaft 1334 mounted for rotation in bearings 1360, 1362. A cylinder block 1364 is keyed to shaft 1334. A plurality of pistons 1366, e.g. two, four, six, or eight or even an odd number such as one or three are mounted each in one of plural bores 1368 in the cylinder block. Piston rods 1370 connect the piston 1366 with pivoted shoes or cam followers 1372 bearing against the face of 1332 of the swash plate or end cam 1207. As the rotating shaft 1334 turns the cylinder block, the pistons 1366 are moved in and out and function as a pump with respect to fluid in lines 1390, 1392. For example fluid would be drawn in through line 1390 and expelled through line 1392 via valve plates 1392, 1394. Ported valve plate 1394 is stationary and connected to lines 1390, 1392. Valve plate 1396 is affixed to the cylinder block and rotates with it. The ports in rotating plate 1396 communicating with the several cylinder 1368 are at appropriate times in register with the appropriate ones of the ports in the stationary valve plate 1394 that communicates with the respective lines 1390, 1392 so as to effect the desired pumping action. By pumping fluid in at 1392 and out at 1390, the device becomes a motor. Whether operating as a motor or a pump, adjustment of the swash plate angle varies the volume of piston displacement. In addition to the feedback from the amplifier, load feedback 1211 is provided. The feedback valve 1211 is the same as that shown at 642 in FIG. 26, but it is driven by swash plate 1207 to which it is pivotally connected at 1398. The load feedback 1211 is in parallel with the amplifier feedback. As feedback needle 1400, which is double tapered or else provided with multiple tapered grooves, is moved axially by the swash plate, the degree of restriction at ports 1404, 1406 between port 1402 that goes in the fluid reservoir and ports 1408, 1410 that go to the transmitter output lines 1201, 1203, is varied in a direction to negate pressure changes caused by the transmitter, the same as in the case of the amplifier feedback, thereby to bring the swash plate to rest. Absent the load feedback, the swash plate would be balanced only by the action of the springs 1328, 1330, even with the amplifier balanced by its own feedback, but with the additional load feedback reliance upon the springs is not necessary.

A previously known swash plate control similar to that above described but using mechanical or electrical feedback is disclosed in catalog 625 believed to have been published about 1973 by MOOG Inc. Controls Division, Pioneer Airport, East Aurora, New York, entitled MOOG Electric Controller For Sundstrand Hydrostatic Drives; see especially pages 7–10. See also U.S. Pat. No. 3,065,735—Charles Jr. et al and U.S. Pat. No. 3,228,423 to Moog, Jr. However, the Moog catalog is not believed to teach rebalancing of the amplifier and load by negative feedback of fluid pressure as herein disclosed, and such fluid feedback is believed to be advantageous e.g. in allowing greater distance between load or amplifier and transmitter, than is feasible mechanically, and in being more reliable than electrical feedback, especially in certain environments.

Optionally, indication of the position of the swash plate may be provided by driving an indicator 1420, e.g. from the load feedback valve needle. As shown, a rod 1422 connected to the valve needle moves core 1424 relative to the coils 1426 of a linear voltage differential transformer (LDVT) to produce a voltage proportional to displacement. The voltage can drive a galvanometer to indicate swash plate position.

Figure 41:
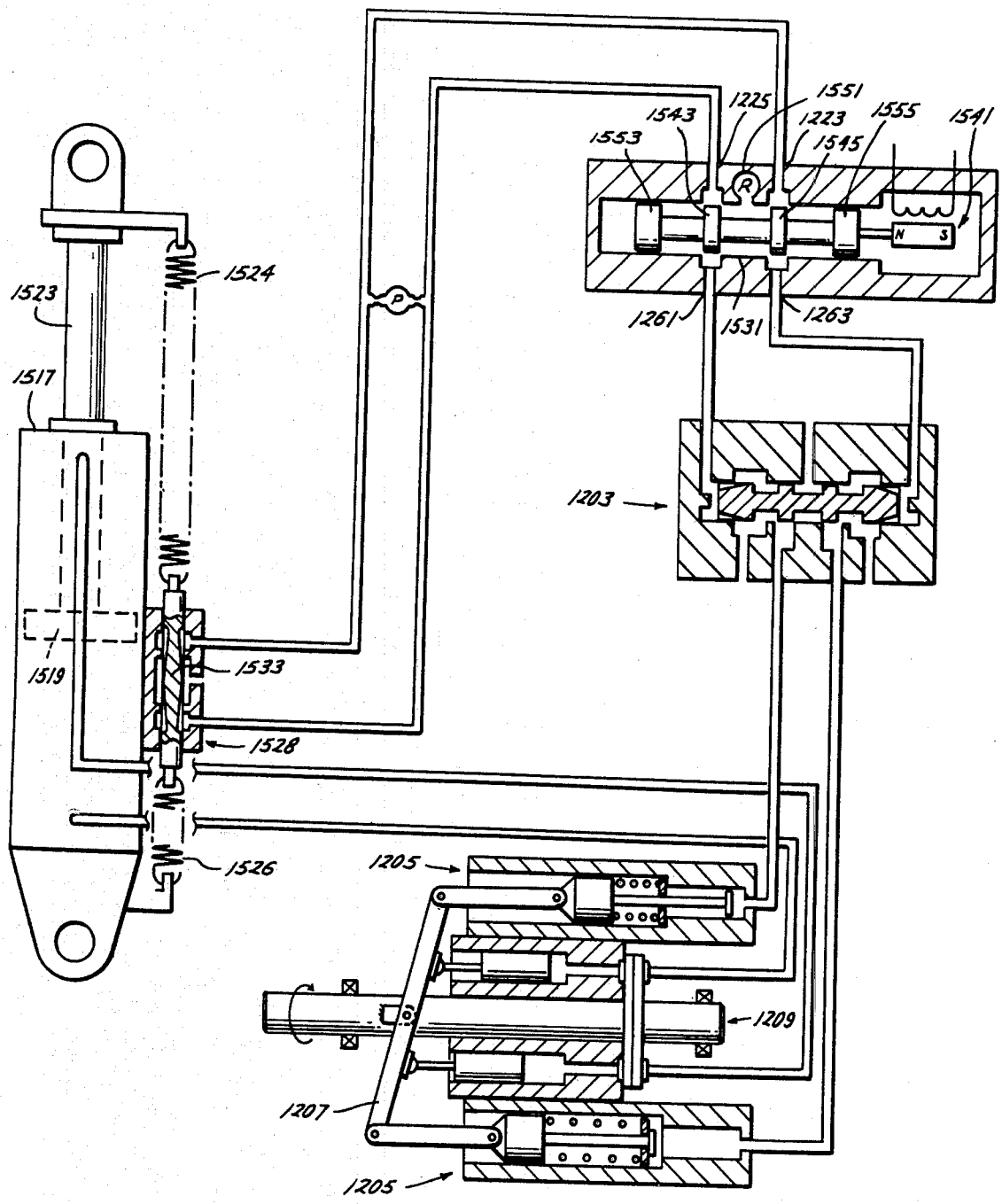
FIG. 41 is a view similar to FIG. 40 showing a modification.

A modified form of swash plate angle control system is shown in FIG. 41. The system is similar to that of FIG. 40 except for the transmitter and load feedback, and ports the same as in FIG. 40 are given like numbers.

Instead of using manual actuation for the swash plate angle control system as shown in FIG. 40, an electric actuator is used in FIG. 41. Such actuator is the same functionally as that shown in FIG. 1, in view of which like parts on given the same numbers plus 1500, and further description rendered unnecessary. The connecting fluid passages are given the same numbers as in FIG. 40. It is to be observed in comparing the various embodiments, that in same cases, e.g. as in FIGS. 40 and 41, the fluid passages, e.g. from the pump, feed not only one devise, e.g. the transmitter, but also feed another devise, e.g. the amplifier, by using enlarged annular passages in the valve block, e.g. of the transmitter, as manifolds for transmitting fluid around the transmitter the amplifier instead of having separate lines for transmitter and amplifier as in FIG. 1, but there are all functionally equivalent.

In the embodiment of FIG. 41, the swash plate controlled motor/pump unit is connected to a load cylinder 1417 similar to cylinder 17 of FIG. 1 and to cylinder 632 of FIG. 26. If desired, the cylinder could be exactly like that shown in FIG. 26 in that the cylinder could be connected to a cam actuated feedback valve like feedback 643. Instead, however, the load piston rod 1523 is connected by swivel 1524 to tension spring 1524. Spring 1524 is connected to the core or needle 1533 of feedback valve 1528. The other end of needle 1533 is connected to lines or spring 1526, which is shorter than spring 1524. The other end of spring 1526 is connected to cylinder 1517. By this arrangement the travel of needle 1533 is proportional to but less than that of piston 1523. Except for the manner in which it is driven, feedback valve 1528 is the same as feedback valve 643 of FIG. 26.

In the system of FIG. 41, the swash plate motor/-pump unit functions as a variable hydraulic amplifier or servo motor controlling load piston 1519 in load cylinder 1517. The swivel connection between the load feedback valve 1528 and load piston rod 1523 allows whatever is connected to rod 1523 to rotate about the rod axis without interference from the load feedback.

Although two servo motor means 1205 are shown, in the preferred embodiments, for moving the swash plate, it is to be understood that a single servo motor means could be employed, eg. the device 117 of FIG. 1 could be connected to the swash plate via piston rod 123.

Figure 42:
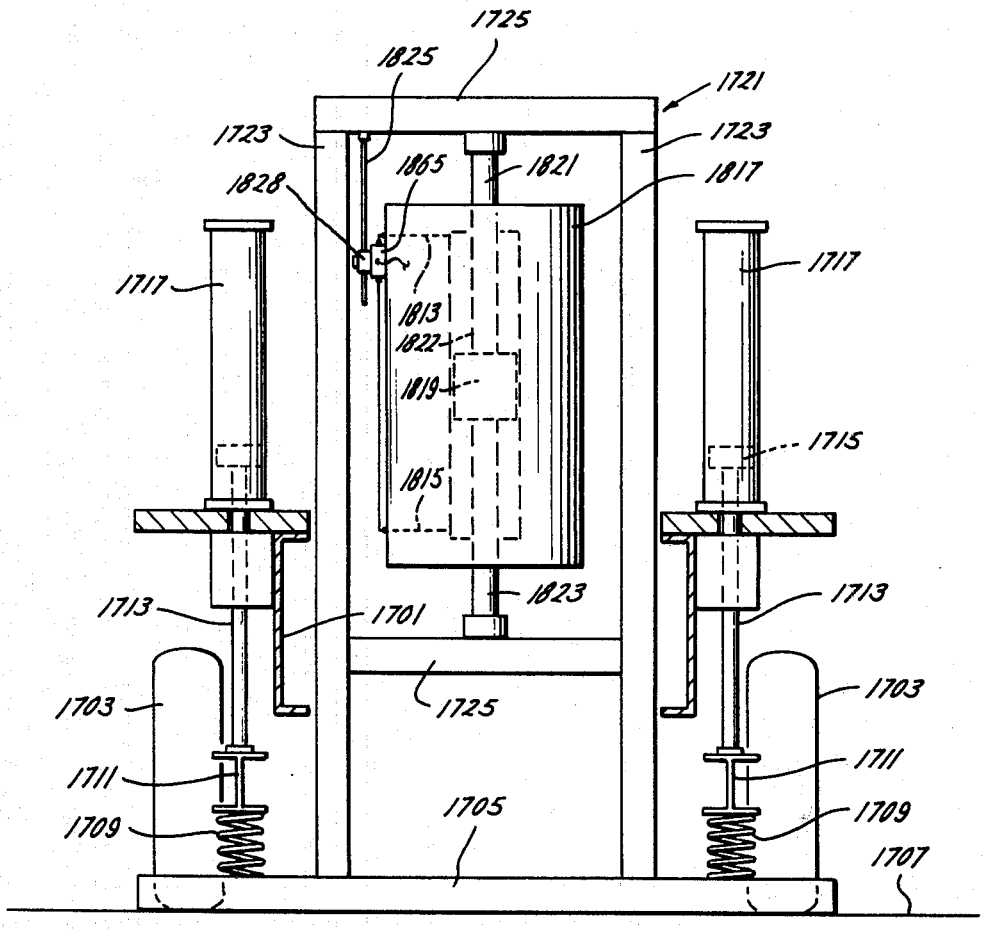
FIG. 42 is an elevation, partly in section, showing apparatus incorporating the invention forming part of a seismic generator.

Referring now to FIG. 42 there is shown an application of the invention to the drive mechanism for a seismic generator of the type known to the trade under the trade-mark Vibroseis. For disclosure of the details of method and apparatus employed in the Vibroseis system see U.S. Patents number:

System

U.S. Pat. No. 2,688,124-Doty et al

Trucks

U.S. Pat. No. 3,024,861-Clynch
U.S. Pat. No. 3,306,391-Bays
U.S. Pat. No. c.f. 3,306,392-Kilmer Couplers U.S. Pat. No. 3,143,181-Bays
U.S. Pat. No. 3,159,232-Fair
U.S. Pat. No. 3,159,233-Clynch et al
U.S. Pat. No. 3,205,971-Clynch
U.S. Pat. No. 3,329,930-Cole et al
U.S. Pat. No. 3,286,783-Cherry et al
U.S. Pat. No. 3,291,249-Bays
U.S. Pat. No. 3,365,019-Bays Vibrators U.S. Pat. No. 3,059,483-Clynch
U.S. Pat. No. 3,282,372-Brown
U.S. Pat. No. 3,372,770-Clynch Servo System U.S. Pat. No. 3,361,949-Brown Referring to FIG. 42 there is shown the rear portion of an automobile or truck having a chassis or body frame 1701 and rear wheels 1703 which are connected to the truck frame by conventional means not shown. A ground engaging plate 1705 is resiliently pressed against the earth's surface 1707 by coil springs 1709 which react against I-beams 1711 carried from the truck frame by piston rods 1713. The piston tods are connected to pistons 1715 which move in compressed air cylinders 1717. By means of the piston and cylinder means 1715-1717, the truck chassis can be jacked up to place any desired amount of the truck weight on the springs 1709, or the plate 1705 can be elevated off the ground 1707 to enable the truck to move to a new location.

Connected to plate 1705 is a rigid framework 1721 including vertical posts 1723 and horizontal struts 1725. The struts are connected to the ends 1821, 1823 of a load piston rod 1822 like the ends 21, 23 of the load piston rod of FIG. 1. The piston rod 1822 carries a piston 1819 affixed thereto which moves in load cylinder 1817. The load cylinder is connected by hydraulic lines 1813, 1815 to cylinder 1865 of an amplifier which is the same as the amplifier including cylinder 65 of FIG. 1. A transmitter, not shown, like the transmitter of FIG. 1, applies pressure differentials to the amplifier in response to an electrical input like input 111 of FIG. 1. By applying an oscillating electrical input to the transmitter actuator, the amplifier and load piston respond to cause struts 1725 to move up and down. Cylinder 1817 is unattached to the truck frame, being supported only by air pressure in the cylinder at the opposite sides of piston 1818. The cylinder is sufficiently massive that a desired amount of movement of piston 1819 and plate 1705 is created by the variation of pressure differential in the cylinder on opposite sides of the piston.

The amplifier cylinder 1805 is affixed to the load cylinder 1817. A load feedback means or unit 1828 like load feedback means or unit 128 of FIG. 1 is affixed to the amplifier and is driven by a load feedback rod 1825 like rod 125 of the FIG. 1 embodiment. The feedback stabilizes the operation of the servo amplifier, controlling the load oscillations to be proportional to at least some degree to the amplitude of the electrical oscillations fed to the transmitter input.

Heretofore, Vibroseis units have been driven with electro-hydraulic systems similar to that shown in the aforementioned MOOG catalogue. The present improvement relates to the utilization of the FIG. 1 system in conjunction with a Vibroseis seismic generator.

Figure 43:
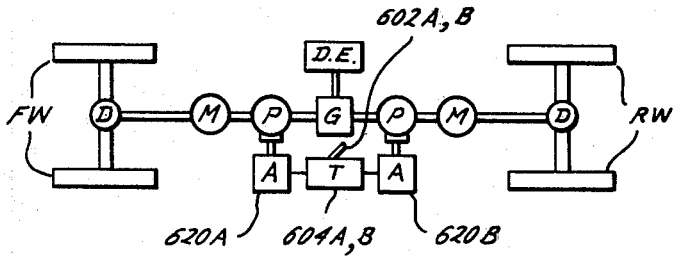
FIG. 43 is a schematic plan view of apparatus according to the invention employed for driving a four wheel drive vehicle.
Figure 44:
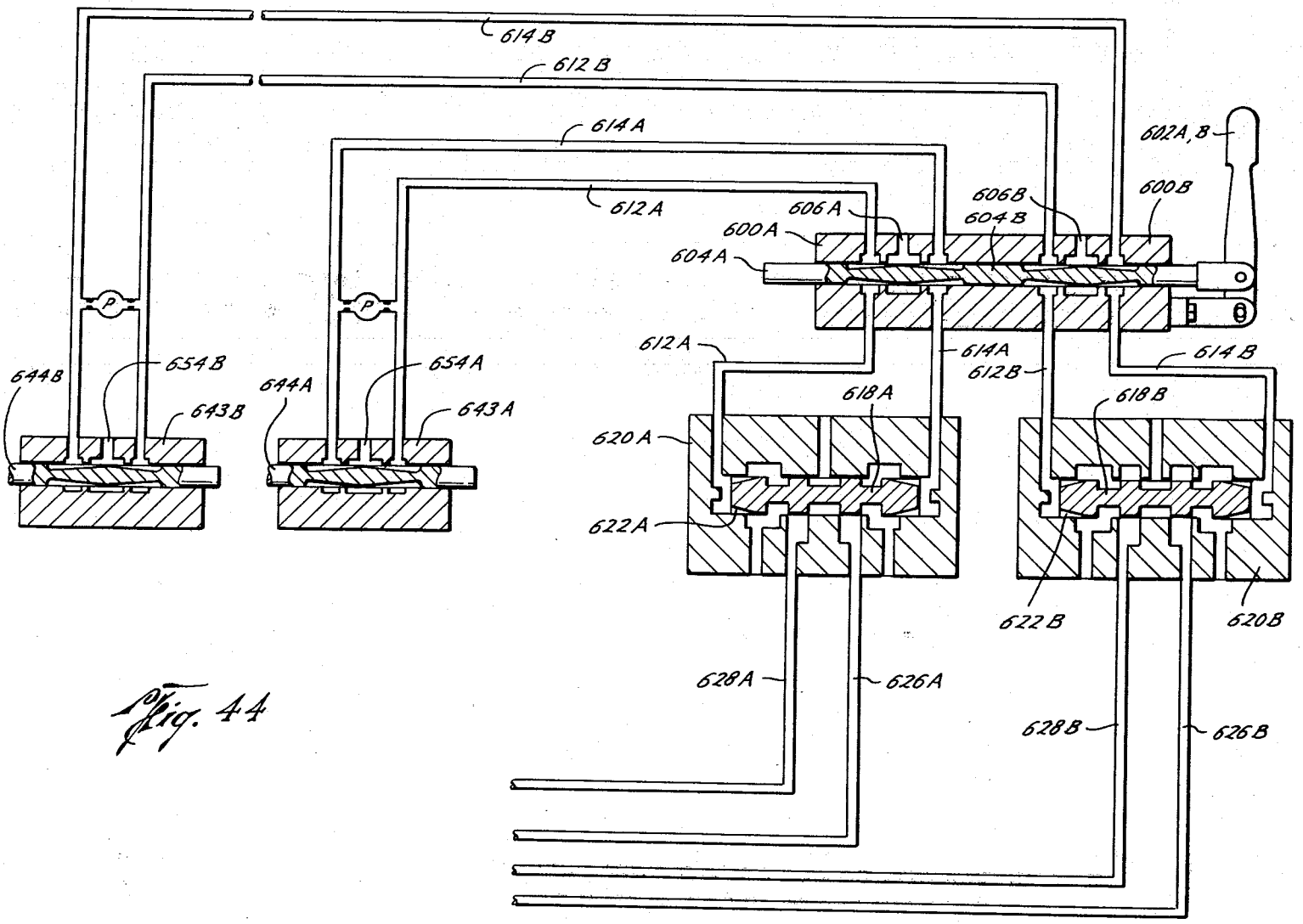
FIG. 44 is a largely sectional view of apparatus according to the invention suitable for dual parallel, control, e.g. as in FIG. 43.

Referring now to FIG. 43 and 44 there is shown another modification of the apparatus shown in FIG. 1 suitable for simultaneous control of two servo systems. Such an arrangement is useful in four wheel drive trucks, for example, as shown in FIG. 43. A diesel engine D.E. may drive a gear box G which in turn drives two hydraulic pumps P which in turn drive hydraulic motors M. One motor may drive the two front wheels FW and the other the two rear wheels RW, in each case through a differential D. The pumps may be of the swash plate type shown in FIG. 40 and 41, with variable angle swash plates, the angle of the swash plate of each pump being controlled by a separate amplifier A, the two amplifiers being controlled by the two outputs of one dual transmitter T.

Referring now more particularly to FIG. 44, the dual transmitter comprises two transmitter valves having a common valve core and valve cylinder with a single actuating means and is otherwise the same as the constructions previously described, e.g. as described in connection with FIG. 26. Therefore the same reference numbers are used as in FIG. 26 with the addition of A or B for the two system. Based on the foregoing and remembering that P stands for pump or pressure and that R stands for reservoir or return where marked on the drawing and having references to the usual hydraulic system, it is believed the operation of the system will be clear.

In operation, movement of manual actuator 602AB will shift both transmitter valve cores 604A and 604B to create differential pressures between both pairs of output lines 612A, 614A and 612B, 614B. In turn the two amplifier spools 618A, 618B will be shifted to control their output lines 626A, 628A and 626B, 628B. The loads connected to the two pairs of amplifier output lines will then be shifted, e.g. two sets of swash plates of the type shown in FIG. 40 or two load pistons of the type shown in FIG. 26 at 632. Feedback from the amplifiers is effected by vent grooves at 622A and 622B. Load feedback is effected by each load, e.g. swash plate or piston rod, being connected to one of the load feedback valve cores 644A or 644B, thereby variably venting lines 612A and 614A and lines 612B and 614B in parallel with the amplifier vent grooves.

Since the two transmitters are tied together mechanically, the two servo systems will follow in unison.

Figure 45:
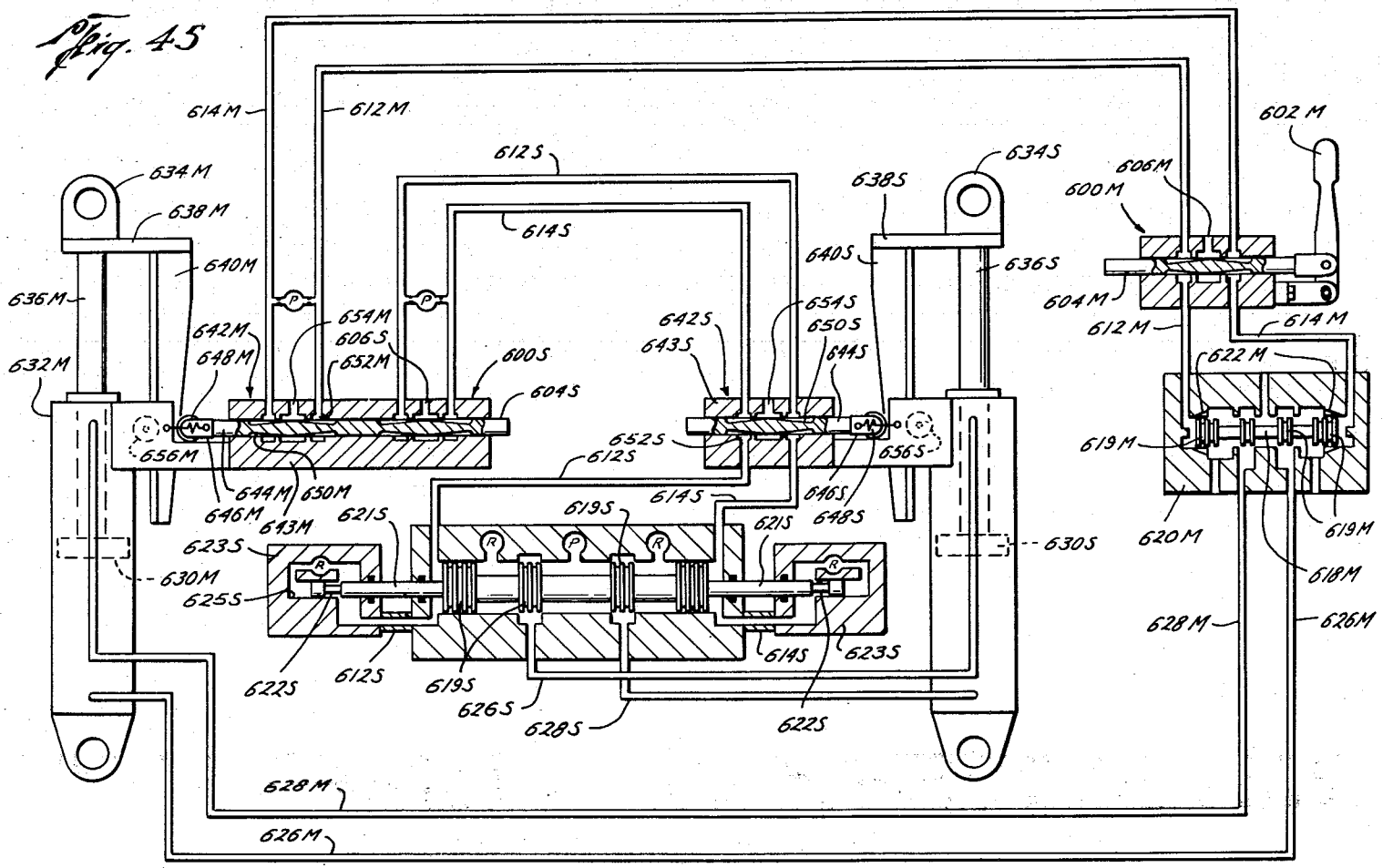
FIG. 45 is a largely sectional view of apparatus according to the invention for dual control of the master and slave type.

Another example of the utility of two servo systems working together is the case of twin rudders on a ship. Also in connection with shipboard use is the case of two or more Davits or booms operating to haul in a long object. In some dual load applications it may be desirable to ensure that one load does not move until the other is out of the way. In such case a master and slave system as shown in FIG. 45 may be employed. In general the servo systems, both master and slave, are like those shown in FIG. 26, so the same reference numbers are used in FIG. 45 except for the addition of M or S to indicate master or slave unit. However, opportunity is taken in FIG. 45 to illustrate two modified forms of amplifier feedback in one of which the feedback grooves are in the cylinder rather than in the piston and in another of which the feedback vent control is external to the amplifier, in either case making it possible to provide pressure equalization grooves around the pistons or lands of the amplifier valve.

In operation, actuator 602M is moved to change the position of the master transmitter 600M. The differential pressure between lines 612M, 612S thus created shifts master amplifier spool valve 618M. The latter is brought to equilibrian by its own master feedback provided by vent grooves 622M and by the master load feedback. The shifted amplifier valve varies the fluid supplied to the master load cylinder 632M causing it to move the load connected at 634M. At the same time the master load feedback 624M driven by cam 640M varies the venting of lines 612M 614M to assist in restoring balance to the amplifier. When the load feedback is sufficient, the amplifier returns to its neutral position and further fluid flow to the load cylinder ceases, the load piston then coming to rest.

Meanwhile, movement of the load piston 630 M, working through cam 640M, also varies the position of slave transmitter 600S whose valve core is an extension of the valve core or needle of the master load feedback 624M.

Motion of the slave transmitter moves the spool of slave amplifier 618S which in turn varies the fluid flow to slave load cylinder 630S. The initial motion of the slave amplifier is proportional to the motion of the slave amplifier due to the slave amplifier feedback provided by external vent valves 622S. When the load has moved a proportional distance, the slave load feedback 642S, driven via cam 640S will have brought the slave amplifier back to neutral by restoring pressure balance between lines 612S and 614S. At this time the slave load piston will stop moving, having shifted a distance equal or proportional to or any other desired function of the movement of the master piston.

Note that both the master and slave amplifier valve spools are provided with annular pressure equalizing, antistick grooves 619M, 619S. Such grooves are previously known, per se, but this use is difficult if the feedback is effected by tapering grooves in the amplifier piston. By putting the feedback grooves in the cylinder as in the master amplifier, or by providing external feedback valves 622S as in the slave amplifier, it seems possible to provide the amplifier spool with the desired pressure equalizing grooves.

Referring to the feedback on the slave amplifier, it may be added that the amplifier spool is provided with extensions 621S which extend through sealed apertures in the ends of the spool valve cylinder and through apertures in feedback valve bodies 623S. The annular grooves 622S on the extensions 621S permit fluid flow to the reservoir from the continuation of lines 612S, 614S in varying amounts depending on their axial position relative to cylinder 625S.

Figures 46, 48:
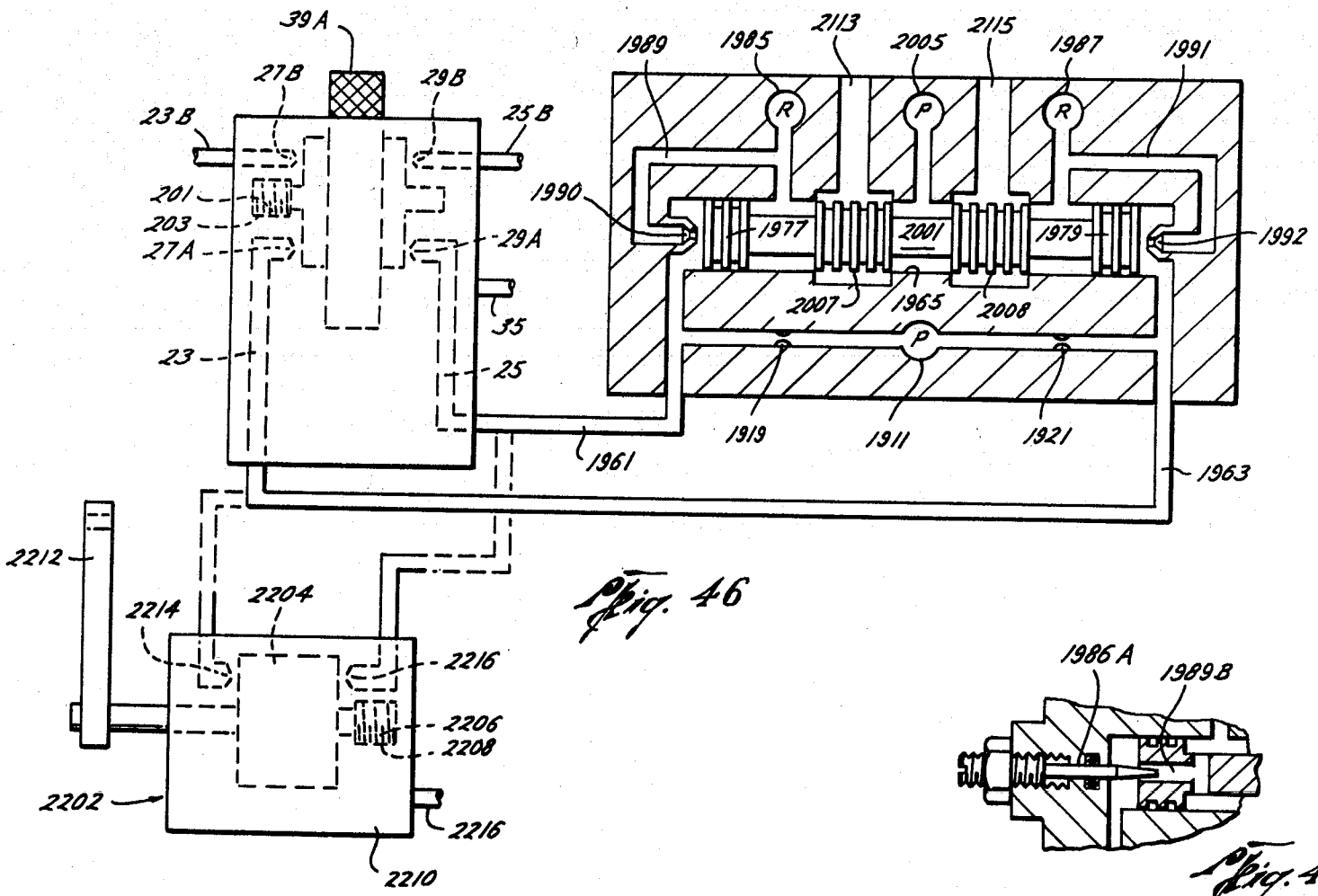
FIG. 46 is a partly sectional view illustrating another form of apparatus according to the invention.
FIG. 48 is a sectional view showing a modification of the amplifier of FIG. 47.

Alternative amplifier feedbacks of the external type which permit grooving of the spool loads for pressure equalization are shown in FIGS. 46, 47, and 48. Basically these amplifiers are the same as those of FIG. 1 and like or analogous parts will be given the same number plus 1900. Instead of vent grooves 89, 91 as in FIG. 1, the FIG. 46 amplifier employs vent passages 1989, 1991 which connect the reservoir passages 1985, 1987 to the ends of the amplifier free piston or spool. Such connection is made via reverse nozzles 1990, 1992 which protrude into the spares at the ends of cylinder 1965. In operation, when the piston or spool 2001 is shifted axially, the ends of the piston approach or recede from the inverse nozzles making flow thereinto easier or more restricted, thereby providing the desired negative feedback.

In the amplifier of FIG. 47 the amplifier is similar to that shown in FIG. 46 except that the inverse nozzles 1990A, 1992A are provided in the piston itself, as are the vent passages 1989A, 1991A. The vent passages include axial portions leading from the nozzles to plural radial passages opening into cylinder 1965. Axially adjustable threaded obstructor pins 1986, 1988 protrude into the ends of cylinder 1965 through O-ring seals. By means of these pins the degree of restriction provided to flow into nozzles 1990A, 1992A can be adjusted. Lock nuts hold the pins in the desired adjusted positions.

FIG. 48 shows a further variation of the amplifier which is similar to the FIG. 47 amplifier except that the nozzles 1990A, 1992A are omitted and the ends of the adjustable obstructor pins, e.g. as shown 1986A, are tapered and extended into the vent passages in the pistons, e.g. the vent passage 1989B. This slows the rate of change of venting versus axial movement of the amplifier piston or spool compared to the arrangements of FIGS. 46 and 47.

Referring once more to FIG. 46, there is also illustrated a dual transmitter. However, instead of the transmitter being of the axially moving type shown in FIG. 44, a transmitter similar to the rotary transmitter of FIGS. 4 and 5 is employed and the same reference numbers are used for the transmitter as in FIGS. 4 and 5. The difference lies in the addition of two extra nozzles 27B, 29B for controlling an additional servo system (not shown) by varying the pressure differential between the additional pair of output lines 23B, 25B.

FIG. 46 also shows a rotary type load feedback means 2202 employing an obstructor body 2204 having a threaded shaft 2206 working in threaded opening 2208 in the feedback housing 2210. The shaft is rotated by lever 2212 connected to the load (not shown) to be turned as the load rotates. Axial travel of obstructor body 2204 caused by its rotation causes it to approach and recede from vent nozzles 2214, 2216, thereby variably to vent passages 1961, 1963 to reservoir return line 2216 and provide the desired system feedback.

Radial Play Neutralization

Figure 7:
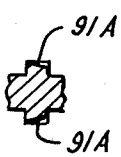
Figure 6:
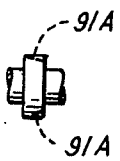

In the previously described systems and apparatus wherein various axially extending feedback grooves were employed in the amplifier spool, such grooves are preferably plural in number and equiazimuthally disposed around each land, as in FIGS. 6–8, or inside each cylinder portion adjacent such land, as in the master amplifier of FIG. 44, in order to neutralize the effect of radial play of the spool within the cylinder. For a like reason, transmitter and feedback venting means, e.g. as in FIG. 26, preferably include plural, equiazimuthally spaced grooves on the valve cores. In a rotary transmitter or feedback the desired result of neutralizing the effect of radial play can be obtained by using plural equiazimuthally spaced ports, as illustrated in FIGS. 49, 50, and 51. The construction there shown also illustrates another form of dual transmitter for simultaneous control of two servo systems from a single actuator.

As shown in FIG. 49, an actuating lever 2301 is fastened by a pin 2302 to a shaft 2303. Lock rings 2304, 2305 hold the shaft against axial motion relative to cylinder body 2320 within which the shaft turns. The lock rings bear against washers adjacent the body 2320 which may be undercut to hold felt seals. However, O-rings 2306, 2307 provide the primary seals between the shaft and the cylinder. The shaft includes a pair of cylindrical bearing lands 2308, 2309 and a plurality of partial cylindrical lands 2313, 2314, separated by cylindrical grooves 2310, 2311, 2312. As seen in FIGS. 50 and 51, lands 2313 and 2314 are undercut below full cylindrical diameter on opposite sides of each land, at 2322-5, over an area of approximately 100 degrees on each side. The undercut portions are of variable depth of undercut, tapering from both ends toward the middle.

Fluid passages 2315, 2316, 2317, 2318 in body 2320 each communicate through two branches, as shown in FIGS. 50 and 51 with ports A, $A^1$, B, $B^1$, C, $C^1$, D, $D^1$, at opposite sides of the inner periphery of the cylindrical bore 2321 in body 2320. Another fluid passage 2319 communicates with the interior of bore 2321 adjacent groove 2211 below the undercut lands 2313, 2314. The branching ends of the passages 2315, 2316, 2317, 2318, are thus placed in communication with return to reservoir fluid passage 2319 in varying amounts according to the rotational position of shaft 2303, thereby to create pressure differentials between the pairs of output lines 2315, 2316 and 2317, 2318 of the dual transmitter. Any radial play between shaft 2303 and bore 2321 will be neutralized since flow through one branch of each of lines 2315, 2316, 2317, 2318 will be increased thereby and the other decreased.

As previously stated, FIG. 44 shows a modification of the apparatus of FIG. 1 suitable for simultaneous control of two servo systems, incorporating two transmitter valves, two amplifier responders with feedback valves, two load pistons and two load feedback valves with a single actuator for the two transmitters, the construction being otherwise the same as the construction previosjly described, e.g. as described in connection with FIG. 26, with the same reference numbers as used in FIG. 26 plus the addition of A or B for the two systems. Also, as previously stated, FIG. 45 shows a master and slave modification of the dual transmitter system of FIG. 44, and FIGS. 46, 47, and 48 show alternative amplifier feedbacks which are basically the same as those of FIG. 1 and given the same reference numbers plus 1900. It has also been stated that FIG. 46 shows another form of dual transmitter employing rotary elements similar to FIGS. 4 and 5 with the same reference numbers as in FIGS. 4 and 5, and a rotary load feedback 2202 operating in a similar manner to the rotary transmitter. Also, as stated above, FIGS. 49–51 show means to eliminate the effect of radial play in a rotary feedback or transmitter, and illustrate a dual transmitter. From this it will be understood that the transmitter (or feedback) construction shown in FIGS. 49–51 is to be employed, e.g. in dual rotary systems such as that of FIG. 46, for the transmitter (and feedback) element thereof.

Figure 46A:
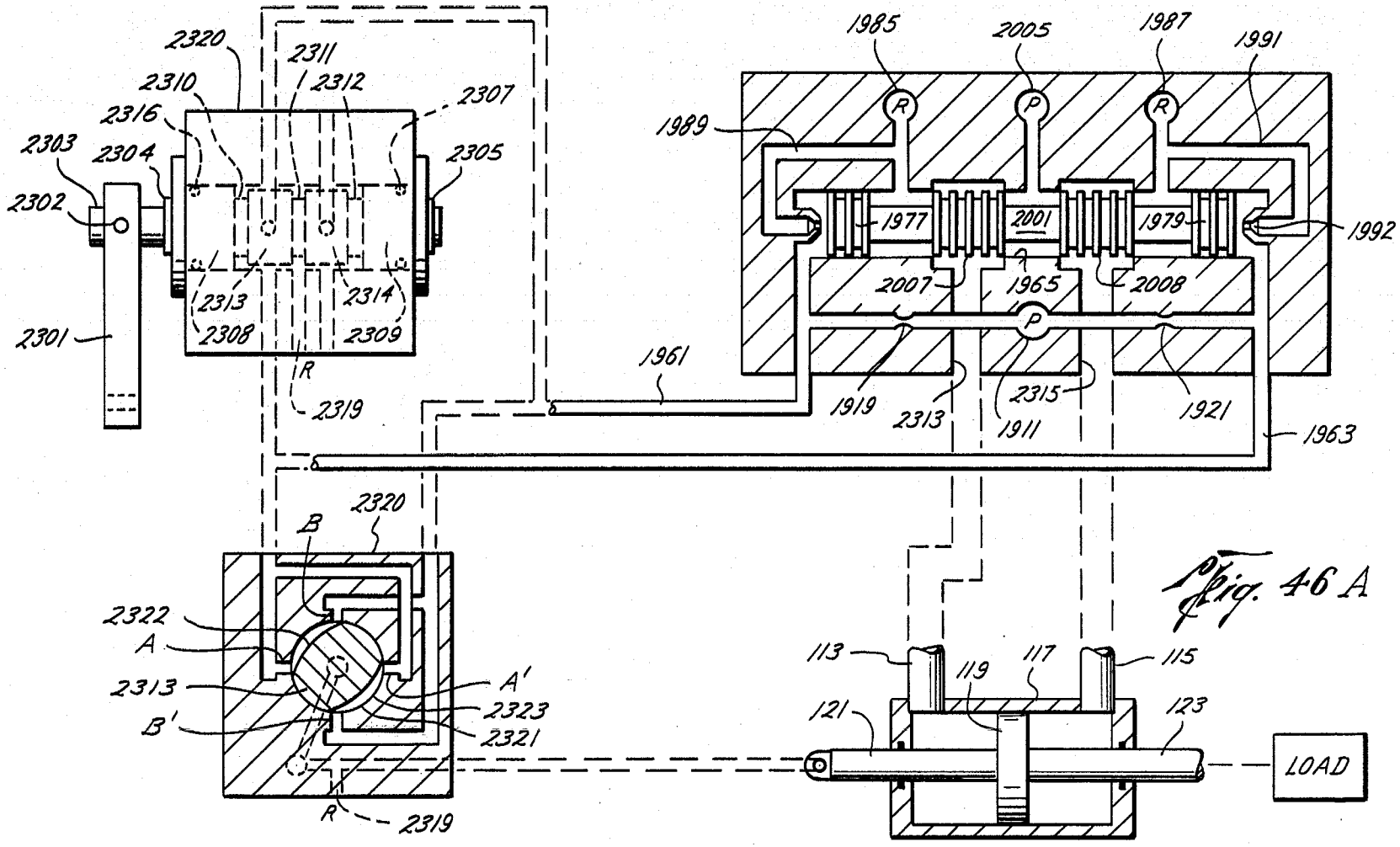
FIG. 46A is a view similar to FIG. 46 showing a modification.

Such a construction is shown in FIG. 46A wherein the dual rotary transmitter 2320 of FIG. 49 is substituted for the dual rotary transmitter 39A etc. of FIG. 46; also a rotary feedback similar to FIG. 49 transmitter 2320 replaces the FIG. 46 rotary feedback 2202 that is similar to transmitter 39A etc., and a load actuator 117 shown previously in FIG. 1 is employed as described previously in connection with FIG. 36.

It will be understood that the pairs of transmitter lines 2315, 2316, and 2317, 2318, will be connected to a source of fluid pressure having a drooping pressure versus fluid flow rate characteristic the same as in FIG. 1 (pump 11, restrictors 19, 21) so that variation of the restriction to flow dependent on the positions of undercut areas 2322-5 on the otherwise cylindrical lands 2308, 2313, 2314, 2309, will effect the desired change in pressure differential between the output lines of the transmitter. The undercut areas on the lands 2313, 2311 are arranged so that after only a slight rotational movement from the neutral position shown, some of the ports A-D, $A^1$-$D^1$ will be blocked completely so that the pressure differential variation caused by further rotation will be due solely to gradual enlargement of the pathways to the other ports. This is believed to work best. However, if desired, the undercut areas could be arranged so that the closure of the ports would be gradual at the same time the other ports are gradually opened.

Two-Line Transmitter That Can Vent One Line At A Time

It has been noted in reference to the embodiment of FIG. 1 and in reference to the embodiment of FIGS. 49–51 that, in connection with a two-line system, i.e. one in which the fluid pressure on both sides of the responder can be varied, it is sometimes preferred to have the transmitter vent the pressure fluid of both lines, but only of one line at a time. Because only one line is vented at the transmitter, the overall pressure of the fluid within the system is higher. Thus, a smaller flow of fluid from the pump is required to produce power making the system more efficient. In FIG. 1, such a transmitter is an axially movable spool. In FIGS. 49–51, such a transmitter is of the rotary type, but the transmitter of FIGS. 49–51 vent both lines when the transmitter is in the neutral position. FIGS. 42–54 illustrate several embodiments of rotary transmitters for two-line systems, such transmitters directly varying the pressure in only one line at a time even while in the neutral position.

1. One Operator Controls Either Line (FIGS. 52 and 52A)

Figures 52, 52A:
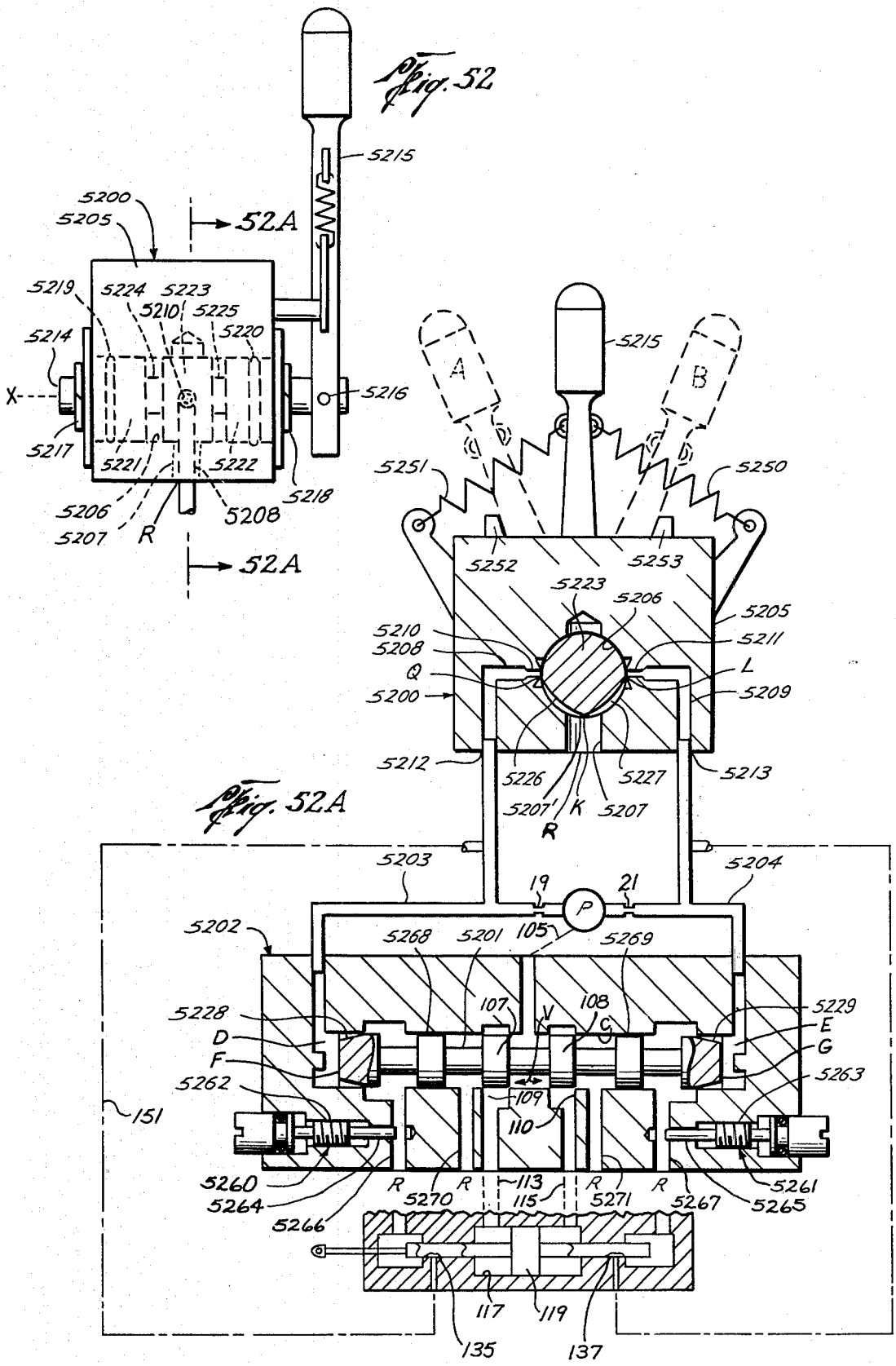
FIG. 52 is a largely schematic view illustrating a rotary transmitter for venting a two-line system one line at a time with a single control lever.
FIG. 52A is a sectional view of the transmitter of FIG. 52 taken along lines 52A and connected to a responder.

As shown in FIGS. 52 and 52A, transmitter 5200 is used to control the axial movement of piston 5201 of responder 5202 by varying the pressure of the fluid in conduits 5203, 5204. Responder 5202 includes a cylinder C in which moves piston 5201 having a left side F and a right side G respectively exposed to the fluid pressure in the left end D and the right end E of the cylinder. Piston 5201 drives valve V comprising lands 107, 108 and ports 109, 110. Valve V controls flow of fluid from pressure source P via passages 105, 113, 115 to load actuating means comprising piston 119 moving in cylinder 117, as in FIG. 2. The load actuating means incorporates feed back grooves 135, 137 controlling venting of lines 5203, 5204 via lines 151, 153, respectively, to reservoir R.

Transmitter 5200 includes cylinder body 5205 having cylindrical bore 5206 therethrough. Outlet conduit 5207 communicates with bore 5206 near the center of bore 5206 and extends radially from bore 5206 to port 5207' at the base of body 5205. Inlet conduits 5208, 5209 communicate with bore 5206 through oppositely facing nozzles 5210, 5211, respectively, at points near the center of bore 5206. As seen in FIG 52A, each nozzle 5210, 5211 is formed by relieving the area of the inner periphery of bore 5206 around the tip of the nozzle. The tips of nozzles 5210, 5211, are tangent to the wall of bore 5206. The axes of nozzles 5210, 5211 are along a diameter of bore 5206 perpendicular to the axis of outlet conduit 5207. Inlet conduits 5208, 5209 extend from nozzles 5210, 5211 to ports 5212 5213, respectively, at the base of body 5205.

Transmitter 5200 also includes shaft 5214 which is disposed within bore 5206 and extends from bore 5206 on either side of body 5205. Actuating lever 5215, which controls transmitter 5200, is fastened to shaft 5214 by pin 5216. Lock rings 5217, 5218 restrict axial motion of shaft 5214 relative to cylinder body 5205 of transmitter 5200. Lock rings 5217, 5218 bear against washers adjacent body 5205. Body 5205 may be undercut adjacent the washers to hold felt seals.

Shaft 5214 also includes cylindrical bearing lands 5221, 5222 and partial cylindrical land 5223. Lands 5221, 5222 are positioned at either end of bore 5207 and have O-rings 5219, 5220 which form the primary seals between shaft 5214 and bore 5206.

Partial cylindrical land 5223 is disposed directly above outlet conduit 5207 and between nozzles 5210, 5211 and is separated from lands 5221, 5222 by cylindrical grooves 5224, 5225. As shown in FIG. 52A, land 5223 is undercut below full diameter at 5226, 5227. When transmitter 5200 is in its neutral or centered position as shown by the solid lines, undercut portion 5226 extends from point K on the periphery of land 5226 through which the axis of outlet conduit 5207 extends to point Q directly beneath nozzle 5210, and undercut portion 5227 extends from point K to point L directly beneath nozzle 5211. The undercut portions are of variable depth of undercut, tapering from both ends of the particular undercut portions toward the middle.

Partial cylindrical land 5223 is biased to the neutral or centered position by means of springs 5250, 5251 attached between cylinder body 5205 and lever 5215. Movement of lever 5215 is limited by stops 5252, 5253 attached to body 5205.

When incorporated into a system as shown in FIG. 52A, inlet conduits 5208, 5209 are connected to conduits 5203, 5204 and outlet conduit 5207 is connected to the system reservoir. When transmitter 5200 is in the neutral position, nozzles 5210, 5211 are completely blocked by land 5223. Thus, neither conduit 5203 nor conduit 5204 is vented by transmitter 5200. Since no venting occurs in either line, piston 5201 of responder 5205 will be centered.

As lever 5215 is moved to position A as shown by the dotted lines of FIG. 52A, land 5223 turns counterclockwise whereby nozzle 5211 comes into communication with undercut portion 5227. As a result, the pressure in conduit 5204 will decrease an amount dependent on the depth of undercut portion 5227 along the axis of nozzle 5211. As such depth increases, the blocking effect of land 5223 decreases, causing increased venting of conduit 5204 and decreased pressure of fluid within conduit 5204. It will be noted that if lever 5215 is moved far enough for point K on land 5223 to move to the edge of port 5207' and tend to block flow over undercut 5226 from nozzle 5210 to port 5207', fluid can flow paraxially along undercut 5226 to annular grooves 5224, 5225, and thence paraxially back along undercut 5277 to port 5207', so that there is no restriction of flow through port 5207'. This is similar to the paraxial flow from the high pressure ports to the low pressure annular groove(s) and port in the FIGS. 49–51 embodiment. At the same time, nozzle 5210 remains completely blocked by land 5223 causing a pressure differential between conduits 5203 and 5204. In response to the pressure differential, piston 5201 moves to the right until the venting by feedback grooves 5228, 5229 in piston 5201 negates the pressure differential. If, when piston 5201 is centered as shown, no venting occurs through feedback grooves 5228, 5229, then the pressure differential is negated when venting through feedback groove 5228 equals that through nozzle 5211.

Although for most purposes, pressure losses along conduits 5203, 5204 may be assumed to be negligible, some loss does occur. Therefore, if the responder and source of pressure fluid are close together but are remote from the transmitter, the pressure in conduits 5203, 5204 adjacent the transmitter will be less than that adjacent the responder. Thus, in order for venting by feedback groove 5228 to equal that through nozzle 5211, piston 5201 has to move farther than it would if there were no losses along conduit 5203, 5204. The resultant distortion of the response is sometimes undesirable. Therefore, responder 5202 may include variable restrictors 5260, 5261 for variably restricting flow from feedback grooves 5228, 5229, respectively, to the reservoir. The variable restrictors are adjusted so as to approximate the differences in conduit pressure losses between the pressure fluid source and the transmitter on the one hand and the pressure fluid source and the responder on the other hand. Variable restrictors 5260, 5261 include set screws 5262, 5263, respectively, having cylindrical restrictor pins 5264, 5265, respectively, attached thereto. As set screws 5262, 5263 are adjusted, pins 5264, 5265 move radially across conduits 5266, 5267 connecting feedback grooves 5228, 5229 to the reservoir thus restricting flow through such conduits.

If, as shown in FIG. 52A, responder 5202 is an amplifier including a valve for controlling the flow of pressure fluid to and from a load, and conduits 5266, 5267 are variably restricted as described supra, it is preferred that the responder piston include lands 5268, 5269 for isolating conduits 5266, 5267 from conduits 5270, 5271 through which fluid from the load drains. Such isolation is preferred because it permits fluid to drain from the load while the load is moving without any unnecessary restriction.

When used with a responder such as that shown in FIG. 52A, transmitter 5200 may be used on farm machinery, such as a tractor, for raising and lowering various trailing equipment such as a plow. The operation is easily effected simply by moving the lever in one direction or the other.

2. One Operator Controls Line Selected By Valve (FIG. 53)

a. Transmitter

Figure 53:
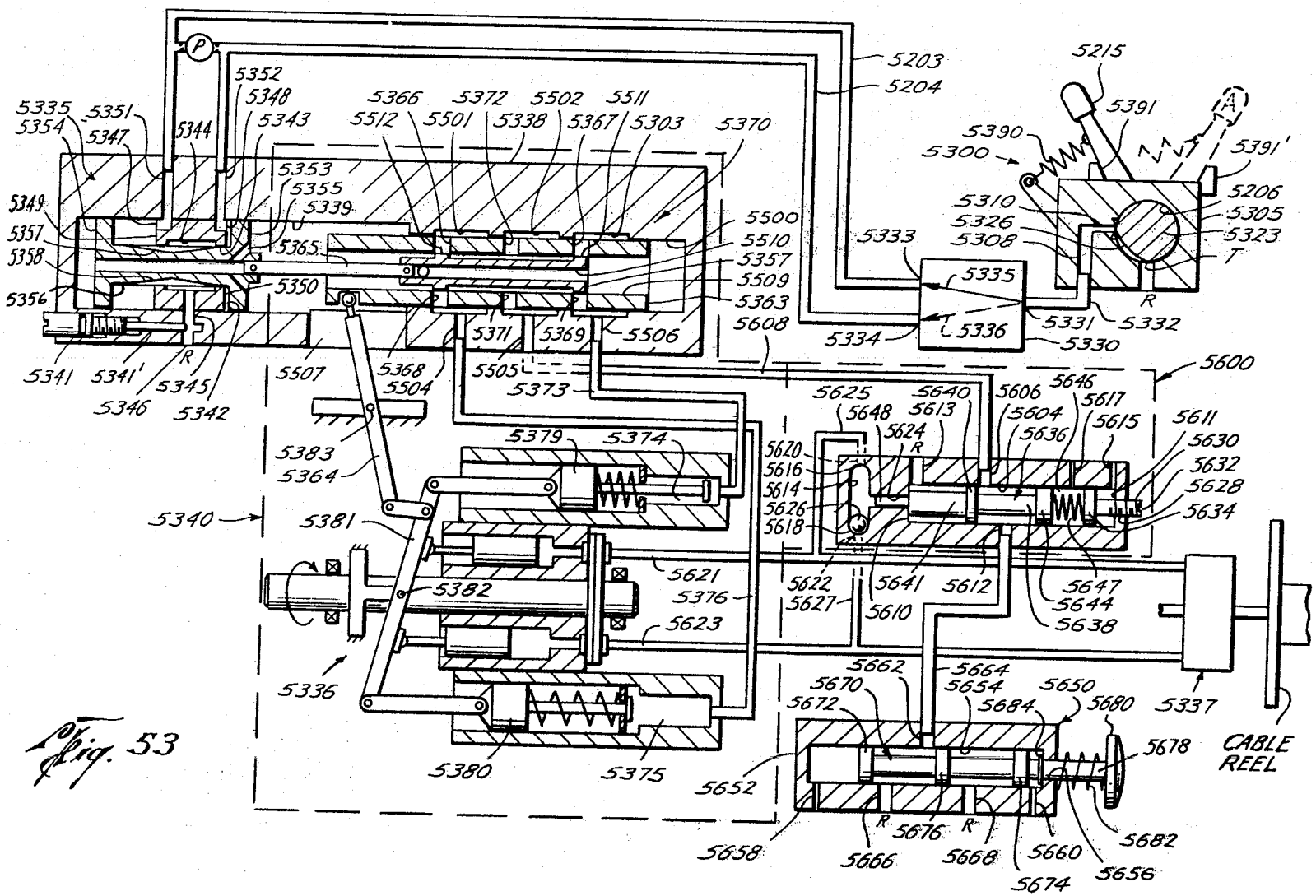
FIG. 53 is a largely schematic sectional view illustrating a rotary transmitter for venting a two-line system one line at a time with a single control lever and a switching valve and a modified responder piston and cylinder.

Referring now to FIG. 53, an embodiment of a transmitter similar to that of FIGS. 52 and 52A is shown. In this embodiment, however, a single inlet conduit 5308 communicates with cylindrical bore 5206 through nozzle 5310. Partial cylindrical land 5323 differs from partial cylindrical land 5223 of FIGS. 52 and 52A in that land 5323 has only a single undercut portion 5326. When actuating lever 5215 is in the neutral position shown in solid lines in FIG. 53, undercut portion 5326 extends from point S directly beneath nozzle 5310 to point T approximately 85 degrees from point S and away from nozzle 5310. Undercut portion 5326 is of variable depth of undercut, tapering from points S and T toward the middle. Land 5323 of transmitter 5300 is biased in the neutral position by means of spring 5390 connected between cylinder body 5305 and lever 5215. Movement of lever 5215 is limited by stops 5391, 5391' connected to cylinder body 5305.

Transmitter 5300 of FIG. 53 further includes three-way, two-position valve 5330. Common port 5331 of valve 5330 is connected to conduit 5308 by means of conduit 5332. Conduits 5203, 5204 are connected to the switching ports 5333, 5334, respectively, of valve 5330.

As described, transmitter 5300 has an operative effect similar to that of transmitter 5200 of FIGS. 52 and 52A. Transmitter 5300, however, requires the operation of a valve in addition to a lever. Thus, with valve 5330 in the position shown by solid line 5335, clockwise rotation of lever 5215 toward position A causes the pressure fluid in conduit 5203 to vent through nozzle 5310 resulting in an appropriate response by the responder. In order to vent the pressure fluid in conduit 5204 with transmitter 5300, valve 5330 must be switched to the position shown by dotted line 5336.

b. Responder With Two Lines Connected to Inside of Piston

Transmitter 5300 may be used in conjunction with responder 5335 as shown in FIG. 53. Responder 5335 is disposed within cylinder body 5338 having generally cylindrical bore 5339 therein Responder 5335 includes a reduced diameter portion, shown as annular flange 5342, extending from the wall of the left-hand portion bore 5339 and forming cylindrical surface 5343. Cylindrical surface 5343 has annular groove 5344 centered thereon. Outlet conduit 5345 extends radially from the center of groove 5344 through flange 5342 and body 5338 to port 5346 which is connected to a system reservoir. Variable set screw restrictor 5341 is disposed in body 5338 perpendicular to conduit 5345 such that restrictor pin 5341' variably obstructs conduit 5345. Flange 5342 further has oppositely opening ports 5347, 5348, at flange side surfaces 5349, 5350, respectively, and adjacent the wall of bore 5339. Inlet conduits 5351, 5352 extend from ports 5347, 5348, respectively, to the outer surface of body 5338 where they are connected to conduits 5203, 5204, respectively.

Responder piston 5353 is slidingly disposed in bore 5339. Piston 5353 is a two-landed spool with lands 5354, 5355 engaging the wall of bore 5339 on either side of flange 5342 and generally cylindrical shaft 5356 slidingly engaging flange cylindrical surface 5343.

The axial position of piston 5353 relative to bore 5339 is dependent on the pressure differential of fluid in conduits 5203, 5204. If pressure is higher in conduit 5203, piston 5353 is moved to the left. If pressure is higher in conduit 5204, piston 5353 is moved to the right.

Shaft 5356 of piston 5353 has identical, diametrically opposed feedback grooves 5357, 5358 extending over approximately 60 percent of the length of shaft 5356. Grooves 5357, 5358 are of variable depth, being deepest at the center of shaft 5356 and decreasing linearly toward either end. The slope of the grooves is the same toward both ends.

Feedback grooves 5357, 5358 provide venting paths from conduits 5203, 5204 to the reservoir through groove 5344 and outlet conduit 5345. The venting through these paths is variably obstructed according to the axial position of piston 5353. As piston 5353 moves to the right, venting of conduit 5203 through the feedback grooves decreases and venting of conduit 5204 increases thus tending to negate the pressure differential causing such movement. Similarly as piston 5353 moves to the left, venting through grooves 5357, 5358 tends to negate the pressure differential causing such movement. When piston 5353 is centered about flange 5342, the venting of conduits 5203, 5204 through the feedback grooves is equal.

As described, supra, the responder of FIG. 53 reacts to pressure differential in conduits 5203, 5204 in a manner similar to that of other responders described. The responder of FIG. 53, however, retains the control system pressure fluid within the piston. As a result, piston 5353 can be connected by mechanical linkage to a load within the same cylinder.

For example, piston 5353 may be connected to a control valve for controlling the angle of the swash plate of a swash plate pump unit as shown in FIG. 53. The particular control valve and swash plate system enclosed within the dotted lines referenced as 5340 is old in the art. Swash plate pump unit 5336 is the same as that described in reference to FIG. 41 and reference may be had to that description for a more detailed understanding of its operator. In general, control valve 5370 controls the flow of pressure to and from cylinders 5374, 5375 of pump unit 5336 which, in turn control the angle of swash plate 5381. Mechanical linkage rod 5364 readjusts control valve 5370 so as to stop the flow of pressure fluid to the cylinders when swash plate 5381 has reached the desired angle.

C. Control Valve-Swash Plate Pump System

Control valve 5370 includes equally spaced annular grooves 5501, 5502, 5503 in right-hand portion 5500 of bore 5339, each groove having the same axial length. The axial length of grooves 5501, 5502, 5503 should be greater than the maximum extent of axial movement of piston 5353. Conduits 5504, 5505, 5506 extend radially from grooves 5501, 5502, 5503, respectively, through cylinder body 5338. Conduit 5505 is connected to a source of fluid under pressure. This source is the one that will supply pressure fluid to swash plate angle control cylinders 5374, 5375. Conduits 5504, 5506 are connected to cylinders 5375, 5374, respectively, by means of conduits 5376, 5373, respectively. Passageway 5507 extends radially through cylinder body 5338 between right-hand portion 5500 of bore 5339 and the portion of bore 5339 in which responder piston 5353 is disposed. Passageway 5507 serves both as a connection to the system reservoir and as a passageway for rod 5364 and, therefore, has a relatively large axial length.

Feedback piston 5363 having cylindrical bore 5509 extending axially therethrough is axially movably disposed in right-hand portion 5500 of bore 5339 and extends in part from right-hand portion 5500 toward responder 5341 and above passageway 5507. Feedback piston 5363 has diametrically opposed ports 5366, 5367 extending radially therethrough and communicating with groove 5504, diametrically opposed ports 5368, 5369 extending radially therethrough and communicating with groove 5506, and diametrically opposed ports 5371, 5372 extending radially therethrough and communicating with groove 5505. The axial spacing of the center of each pair of ports of feedback piston 5363 is equal to the axial spacing of the centers of grooves 5504, 5505, 5506. Thus when ports 5366, 5367 are centered over groove 5504, ports 5368, 5369 are centered over groove 5506 and ports 5371, 5372 are centered over groove 5505. Ports 5366-5369 have equal diameters.

Feedback piston 5363 is connected to swash plate 5381 by means of mechanical linkage rod 5364. Rod 5364 extends through passageway 5507 and connects to feedback piston 5363 at ball-and-socket joint 5508. Rod 5364 rotates about grounded pin 5383 such that as the angle of swash plate 5381 changes, feedback piston 5363 moves axially in bore 5339. According to the configuration shown in FIG. 53, as swash plate 5381 rotates clockwise about pin 5383, feedback piston 5363 moves to the left and as swash plate 5381 rotates counterclockwise about pin 5383, feedback piston 5363 moves to the right. Preferably the orientation of rod 5364 is such that when ports 5367, 5371, 5369 are centered over grooves 5501, 5502, 5503, respectively, swash plate 5381 is in the neutral position wherein the pump output is zero. According to FIG. 53, swash plate 5381 is in the neutral position when it is vertical.

Cylindrical internal piston 5357 having bore 5510 extending axially therethrough is disposed in bore 5509 of feedback piston 5363. Internal piston 5357 has cylindrical bearing lands 5511, 5512, each having axial width equal to the diameters of ports 5366–5369. The spacing between the centers of lands 5511, 5512 is equal to the axial spacing between the centers of ports 5366, 5367 and ports 5368, 5369. According to this design it can be seen that when land 5512 is centered over ports 5366, 5367, land 5511 is centered over ports 5368, 5369. When land 5512 is positioned to the right of ports 5366, 5367, ports 5366, 5367 are in communication with the reservoir through passageway 5507 and ports 5368, 5369 are in communication with the source of pressure fluid through conduit 5505 and ports 5371, 5372. When land 5512 is positioned to the left of ports 5366, 5367, ports 5366, 5367 are in communication with the source of pressure fluid and ports 5368, 5369 are in communication with the reservoir through bore 5510 of internal piston 5359, bore 5509 of feedback piston 5363, and passageway 5507.

Internal piston 5357 is mechanically linked to responder piston 5353 by rod 5365. Rod 5365 is connected to internal piston 5357 at bore 5510 in such a manner that it will not obstruct fluid flow through bore 5510. The length of rod 5365 should be such that when piston 5353 is centered about flange 5343 and swash plate 5381 is in its neutral position, lands 5511, 5512 are centered over ports 5366, 5368, respectively.

Referring to FIG. 53, the operation of control valve 5370 in conjunction with swash plate pump unit having output conduits 5621, 5623 and driving load motor 5337 is as follows. As piston 5353 moves to the right from the position shown, internal piston 5359 is forced to the right by mechanical linkage 5365. As a result, ports 5366, 5367 communicate with conduit 5505 and fluid under pressure flows through conduit 5373 to cylinder 5374 of swash plate pump unit 5336. At the same time, ports 5368, 5369 communicate with the reservoir and fluid under pressure flows from cylinder 5375 of swash plate pump unit 5360 and through conduit 5376 to the reservoir. This fluid flow causes piston 5379 of swash plate pump unit 5336 to move to the left and piston 5380 of swash plate pump unit 5336 to move to the right which, in turn, causes swash plate 5381 to rotate counterclockwise about pin 5382. This forces bar 5364 to rotate clockwise about pin 5383 causing feedback piston 5363 to move to the right until land 5512 is centered over ports 5366, 5367 and land 5511 is centered over ports 5368, 5369 thus substantially stopping further fluid flow to and from cylinders 5374, 5375. This, in turn, stops rotation of swash plate 5381 about pin 5382. It should be noted, however, that even though lands 5511, 5512 are centered over their corresponding ports, they will not completely block the ports. Some leakage of fluid will occur to either side of lands 5511, 5512 which will, in turn, result in some modulation of swash plate 5381 and feedback piston 5363. Thus, even when swash plate 5381 is in a relatively stable position, there is at least some communication between cylinders 5374, 5375 and the source of pressure fluid.

A similar, though opposite, chain of action occurs when responder piston 5353 moves to the left.

The output of pump unit 5336 may be used to drive motor 5337 which, in turn, may be used to drive a piece of rotating equipment such as a cable reel. The connection between motor unit 5337 and pump unit 5336 may be such that (1) when swash plate 5381 is in a vertical position, motor unit 5337 is stopped, (2) as swash plate 5381 rotates from the vertical in a clockwise direction, motor unit 5337 turns in a clockwise direction with increasing speed, and (3) as swash plate 5381 rotates from the vertical in a counterclockwise direction, motor unit 5337 turns in a counterclockwise direction with increasing speed.

The use of transmitter 5300 in conjunction with the responder and load system of FIG. 53 is as follows. When lever 5215 is in the neutral position as shown, neither conduit 5203 nor conduit 5204 is vented by the transmitter regardless of the position of valve 5330. Therefore, pressure exerted by fluid in conduits 5203, 5204 against lands 5354, 5355 of piston 5353 is equal and piston 5353 will be centered about flange 5342 so that feedback venting of conduits 5203, 5204 is equal. Thus, swash plate 5381 will be vertical and motor 5337 will be stopped.

If valve 5330 is in the position shown by solid line 5335 and lever 5215 is moved toward position A, conduit 5203 will be vented partially by transmitter 5300 causing responder piston 5353 to move to the right. The amount of such movement will depend on the distance lever 5215 is moved and will increase until the center of undercut 5326 is positioned at the axis of nozzle 5310. As described, supra, the rightward movement of responder piston 5353 will cause swash plate to rotate counterclockwise whereby the shaft of motor 5337 will rotate counterclockwise. Because the distance moved by piston 5353 increases with the distance moved by lever 5215 until the maximum is reached, the extent of counterclockwise movement of swash plate 5381 increases with the distance moved by lever 5215. Therefore, the rate of rotation of the shaft of motor 5337 is essentially directly proportional to the distance moved by lever 5215.

If valve 5330 of transmitter 5300 is in the position shown by dotted line 5336 and lever 5215 is moved toward position A, the ultimate position of responder piston 5353 will be to the left of center causing swash plate 5381 to rotate clockwise from the vertical and, in turn, causing the shaft of motor 5337 to rotate in a clockwise direction. Again, the speed of rotation of the shaft of motor 5337 is essentially directly proportional to the distance moved by lever 5215.

Because the same control and the same restrictor, e.g., land 5323, are used for venting both lines, the rate of clockwise rotation of the shaft of motor 5337 is substantially the same as the rate of counterclockwise rotation for a particular position of lever 5215.

Load control valve 5370 as described, supra, is designed for operation under ideal circumstances in which the response delay is negligible. As a result, such a load control valve renders a system wherein the angle of the swash plate follows closely the position of transmitter lever 5215. Furthermore, such an embodiment of a load control valve is simple enough to permit an easy understanding of the operation of the swash plate in respect to the present invention. Practically speaking, however, such an embodiment of a load control valve is not preferred because it is unstable and causes excessive modulation of the swash plate after each position change of the transmitter lever. The preferred embodiment is different from the above described embodiment in that the axial distance between the axial centers of lands 5511, 5512 is less than rather than equal to, the axial distance between the centers of ports 5366, 5368, preferably, 1/16 inch less. As a result, when the midpoint between the lands is positioned over port 5371, i.e. centered, the axial center of land 5512 is positioned 1/32 inch to the right of the center of ports 5366, 5367 and the axial center of land 5511 is positioned 1/32 inch to the left of the center of ports 5368, 5369 (using the orientation of FIG. 53). In such position, the inner portions of lands 5511, 5512 overlap the mouths of the corresponding ports whereas the outer portions of lands 5511, 5512 underlap the mouths of the corresponding ports. This creates a dead region, or dwell, in the neutral position, i.e., initial movement of the transmitter causes no effective response by the responder. Also there is a slight leak to reservoir in the centered position.

In this preferred configuration, internal piston 5353 will be centered only when the system is in neutral. In the centered position cylinders 5374, 5375 will both be in communication with the reservoir whereby, if the neutral position is maintained, the pressure in both cylinders will be at the reservoir level. Furthermore, if piston 5353 is moved less than 1/32 in either direction by operation of the transmitter, pump unit 5336 will not move from the neutral position because neither cylinder 5374 nor cylinder 5375 will be in communication with the source of pressure fluid. Once piston 5353 has been moved more than 1/32 inch off its neutral position, however, the pump unit output will follow the movement of the transmitter.

It should be noted that by virtue of the orientation of lands 5511, 5512 of the preferred embodiment, whenever swash plate 5381 has assumed a substantially steady, non-neutral position, the ports connected to the swash plate angle control cylinder having the higher fluid pressure will be substantially blocked, and the ports connected to the swash plate angle control cylinder having the lower fluid pressure will be in communication with the reservoir. Swash plate 5381, however, is held in a relatively stable position by virtue of a hydraulic lock. Even when this preferred embodiment of the load control valve is incorporated in the system, however, there is some leakage to either side of the land that is substantially blocking its corresponding ports. This leakage results in minimal modulation of the swash plate and the feedback piston. Thus, even when swash plate 5381 is in a relatively stable, non-neutral position, there is at least some communication between the swash plate angle control cylinder having the higher fluid pressure and the source of pressure fluid.

d. Pressure Override Control

For many applications, the pressure produced by swash plate pump unit 5336 must be limited below its actual capacity in order to prevent damage to motor 5337 or some other portion of the load, or to prevent the creation of a dangerous situation such as excessive load speed. Therefore, the system may include pressure override control 5600 for detecting pump output pressure and automatically shutting off the supply of pressure fluid to cylinders 5374, 5375 of swash plate pump unit 5336 before the pressure becomes excessive. The shut off pressure is referred to herein as the critical pressure.

The override control as shown in FIG. 53 and enclosed in dotted lines 5600 is old in the art. Control 5600 includes cylinder body 5602 having cylindrical bore 5604 therein. Bore 5604 has ends 5610, 5611. Passageway 5606 extends radially through body 5602 from the wall of bore 5604 at a point near the center of bore 5604. Passageway 5606 is connected to conduit 5505 of load control valve 5370 by means of conduit 5608.

Passageway 5612 extends radially through body 5602 from the wall of bore 5604 at a point spaced axially from passageway 5606 toward end 5611 of bore 5604. Passageway 5612 is connected to a source of fluid under pressure. This source will become the source to which conduit 5370 of the controller is connected which, in turn, is the source of pressure fluid for pistons 5374, 5375 of swash plate pump unit 5336.

Passageway 5613 extends radially through body 5602 from the wall of bore 5604 at a point adjacent end 5610 of bore 5604. Passageway 5613 is connected to the system reservoir.

Cylinder body 5602 also has narrow relief conduit 5615 extending radially through body 5602 from end 5611 of bore 5604.

Cylinder body 5602 further includes ball check valve chamber 5614. Chamber 5614 has a generally cylindrical shape with hemispherical ends 5616, 5618. The axis of chamber 5614 is perpendicular to that of bore 5604.

Passageways 5620, 5622 extend through body 5602 from hemispherical ends 5616, 5618, respectively, along the axis of chamber 5614. Passageway 5620 is connected to swash plate output conduit 5621 by means of conduit 5625. Passageway 5622 is connected to swash plate output conduit 5623 by means of conduit 5627.

Ball 5626 having a diameter slightly less than that of chamber 5614 is disposed in chamber 5614 such that it may move from one hemispherical end to the other. When ball 5626 is positioned in a hemispherical end as shown, it effectively isolates chamber 5614 from the passageway extending from such hemispherical end. Thus, when pressure of fluid in output conduit 5621 is greater than that in output conduit 5623, ball 5626 is forced into hemispherical end 5618 whereby output conduit 5623 is isolated from chamber 5614. The pressure within chamber 5614 then will be equal to that of conduit 5621. If the pressure of conduit 5623 is greater than that of 5621, ball 5626 is forced into hemispherical end 5616 and the pressure within chamber 5614 will be equal to that of conduit 5623. Thus, the pressure within chamber 5614 generally is that of the output conduit having the greatest pressure.

Body 5602 also has cylindrical piston passageway 5624 which extends axially from end 5610 of bore 5604 to the center of ball check valve chamber 5614.

Cylinder body 5602 further has threaded passageway 5628 extending axially from end 5611 of bore 5604 through the wall of body 5602. Set screw 5630 having slot 5632 at its outer end is threadingly disposed in threaded passageway 5628. Cylindrical land 5634 is attached to the inside end of screw 5630.

Spool 5636 having shaft 5638 and cylindrical bearing lands 5640, 5644 is disposed in bore 5604 and piston passageway 5624. Lands 5640, 5644 are each in sealing, sliding engagement with bore 5604. Land 5644 is positioned at the end of shaft 5638 nearest land 5634 attached to set screw 5630 and is separated from land 5634 by spring 5646 forming a variable length spring chamber 5647. Cylinder body 5602 has bleed passageway 5617 extending radially therethrough from the general center of spring chamber 5647. Land 5640 is positioned at the other end of shaft 5638.

Spool 5636 also includes stop cylinder 5641 attached axially to land 5640 on the side opposite shaft 5638. Stop cylinder has a diameter greater than that of piston bore 5634 but substantially less than that of bore 5604. The axial length of stop cylinder 5641 is such that when it rests against end 5610 of bore 5604, land 5640 is positioned between passageways 5613, 5606, preferably as close as possible to passageway 5606 without interfering with fluid flow between passageway 5606 and bore 5604.

The arrangement of lands 5640, 5644 and cylinder stop 5641, therefore, permits axial movement of spool 5636 within bore 5604. Piston stop 5641 limits movement of spool 5636 in one direction and land 5644, in combination with land 5634 and spring 5646, limits movement of spool 5636 in the other direction.

Spool 5636 further includes piston 5648 extending axially from the end of stop cylinder 5641 and into piston bore 5624 which it slidingly and sealingly engages. Preferably, the axial length of piston 5648 is such that when spool 5636 has moved toward land 5634 to the maximum extent, a portion of piston 5648 remains within piston bore 5624.

The axial position of spool 5636 relative to bore 5604 depends on the force differential of the pressure within chamber 5614 which acts against one end of spool 5636 and the force of spring 5646 which acts against the other end of spool 5636. As mentioned supra, the pressure within chamber 5614 generally will be equal to the pressure within the pump output conduit having the higher pressure. The force exerted by spring 5646 against spool 5636 will vary according to the axial position of land 5634, such position being variable by set screw 5630. In general, set screw 5630 should be adjusted such that when chamber 5614 is at reservoir pressure, piston stop 5641 rests firmly against bore end 5610, and such that when the pressure within chamber 5614 is at the critical pressure, land 5640 completely isolates passageway 5604 from passageway 5612. If, for some reason, the critical pressure changes, set screw 5630 can be readjusted accordingly.

As described, pressure override control 5600 will operate as follows. If the controller and swash plate pump unit are stable in the position shown in FIG. 53, the pressure in pump output conduit 5621 is greater than that in pump output conduit 5623 whereby the pressure in chamber 5614 is equal to that in conduit 5621. Assuming the pressure in conduit 5621 is much less than the critical pressure, cylinder stop 5641 of control 5600 will rest against bore end 5610. Thus, land 5640 does not obstruct groove 5605 and controller conduit 5505 is in full communication with the source of pressure fluid.

If the transmitter is adjusted so as to cause internal cylinder 5359 to move to the left, fluid will flow from the source of pressure fluid, through conduit 5505 and into cylinder 5375 whereby the angle of swash plate 5381 from vertical increases and the pressures in pump output conduit 5621 and in chamber 5614 increase. If the pressure in chamber 5614 becomes sufficiently high, the force exerted against piston 5624 will exceed that against land 5644 causing spool 5636 to move axially. Land 5640 will then partially obstruct groove 5605.

If the output pressure continues to increase to the critical pressure, spool 5636 will move axially until land 5640 completely blocks groove 5605 thus cutting off the flow of pressure fluid to controller conduit 5370 and connecting conduit 5505 to the reservoir. As a result fluid will flow from cylinder 5375 to the reservoir and swash plate 5381 will rotate counterclockwise. The pressure in conduit 5621 will be reduced causing land 5640 to move toward end 5610 and reconnecting conduit 5505 to the pressure fluid source. If the position of responder 5335 remains unchanged, land 5640 will modulate between either side of passageway 5604. Although such modulation does occur, the output of pump unit 5336 is maintained fairly constant at a pressure level just under the critical pressure. The pressure in conduit 5621 thus remains near the critical level until the transmitter is adjusted so as to cause swash plate 5381 to rotate about pin 5382 in a counterclockwise direction and causing the pressure in pump output conduit 5621 to decrease.

A similar reaction occurs if the pressure within pump output conduit 5323 is greater than that in conduit 5321.

It should be noted that pressure override control 5600 is to prevent the output pressure of swash plate pump unit 5336 from exceeding a certain level. Control 5600 does not stop pump unit 5336.

e. Emergency Stop Control

The system of FIG. 53 further includes emergency stop control 5650. Stop control 5650 is designed to return pump unit 5336 to neutral when, for some reason, it is desirable to stop the equipment being driven by the pump quickly and when the pump unit cannot otherwise be returned to neutral due to some malfunction within the transmitter or responder. Furthermore, emergency stop control 5650 can be implemented to return the pump to neutral when the pressure override control fails. The effect of stop control 5650 is to connect both swash plate angle control cylinders 5374, 5375 to the reservoir quickly.

Referring to FIG. 53, stop control 5650 includes cylinder body 5652 having cylindrical bore 5654 therein. Cylindrical shaft passageway 5656 extends axially from one end of bore 5654 through cylinder body 5652. Relief conduits 5658, 5660, extend radially from either end of bore 5654 through cylinder body 5652. Conduit 5662 extends radially from near the center of bore 5654 through body 5652. Conduit 5662 is connected to conduit 5664 which may be connected either directly or indirectly to controller conduit 5505. As shown in FIG. 53, conduit 5664 is connected indirectly to controller conduit 5505 through pressure override controller 5600. Such an indirect connection is used when both the pressure limiting feature of the pressure override controller is desired in addition to the emergency stop feature.

Conduits 5666, 5668 extend radially from bore 5654 through body 5652. Conduits 5666, 5668 are axially spaced equidistant to either side of conduit 5664. Conduit 5668 is connected to the system reservoir. Conduit 5666 is connected to a source of fluid under pressure. This source will become the source to which conduit 5505 of the controller is connected which, in turn, is the source of pressure fluid for pistons 5374, 5375 of swash plate pump unit 5336.

Emergency stop unit 5650 also includes three-landed spool 5670 disposed in bore 5654. Cylindrical bearing lands 5672, 5674 are positioned at either end of spool 5670 with land 5674 nearest shaft passageway 5656. Land 5676 is positioned at the center of spool 5670. Lands 5672, 5674, 5676 all form sliding seals with bore 5654.

Stop unit 5650 further includes shaft 5678 extending axially from spool 5670 and through shaft passageway 5656. Button 5680 is attached to the outer end of shaft 5678. Spring 5682 is disposed about shaft 5678 and bears at one end against cylinder body 5652 and at the other end against button 5680 thus tending to bias button 5680 away from body 5652 and to pull spool 5670 toward the end of bore 5654 from which shaft passageway 5656 extends. Shaft 5678 has annular stop 5684 positioned between land 5674 and body 5652 for limiting movement of spool 5670 so that land 5674 does not bear against the end of bore 5654.

The length of shaft 5678 and the position of annular stop 5684 should be such that when shaft 5678 is biased to its normal position as shown such that stop 5684 bears against the end of bore 5654, land 5676 is positioned between conduits 5662 and 5668, and such that when button 5680 is moved as close as possible to body, land 5676 is positioned between conduits 5662 and 5666.

Operation of emergency stop unit 5650 as described is as follows. When the unit is in its normal position as shown, conduit 5662 is in full communication with conduit 5666 and therefore controller conduit 5370 is in communication with the source of pressure fluid. If button 5680 is fully depressed, conduit 5662 is no longer in communication with conduit 5666 but, instead, is in full communication with conduit 5668. Thus the pressure at controller conduit 5370 is dropped to that of the system reservoir.

If the output pressure of the pump unit is changing, one of the cylinders 5374, 5375 is in communication with the source of pressure fluid and the other cylinder is in communication with the system reservoir. Furthermore, as noted supra, even when the angle of swash plate 5381 is in a relatively stable, non-neutral position there is some communication between the swash plate angle control cylinder having the higher fluid pressure and the source of pressure fluid. In either case, the other cylinder is simultaneously in communication with the reservoir. Therefore, if button 5680 is depressed, both cylinders will immediately come into communication with the reservoir and the force of the springs bearing against pistons 5379, 5380 will tend to return swash plate 5381 to its neutral position.

f. Adjustable Nulling Responder (FIGS. 53A and B)

As noted, supra, it is preferred that the length of rod 5365 be such that swash plate 5381 is vertical when responder piston 5353 is centered. This preference is based on the assumption that when transmitter 5300 is in the neutral position, piston 5353 is centered, which, in turn, is based on the assumption that the pressure of the fluid in conduits 5203, 5204 at ports 5347, 5348, respectively, is equal when transmitter 5300 is in the neutral position and that the venting of conduits 5203, 5204 through the feedback grooves is equal when piston 5353 is centered. Thus, when the transmitter is in the neutral position, swash plate 5381 is vertical and, as desired, the shaft of motor 5337 does not rotate. Whether these assumptions hold true, however, depends on numerous contingencies. If a minor leak exists, or if the fixed restrictions at the source are slightly different, or if there is a kink in a conduit, the assumptions may not hold true, and pistons 5353 will not be centered when transmitter 5300 is in the neutral position. If it is critical for a particular application that swash plate 5381 be absolutely vertical when the transmitter is in its neutral position, slight deviance from these assumptions may produce undesirable results.

Figure 53A:
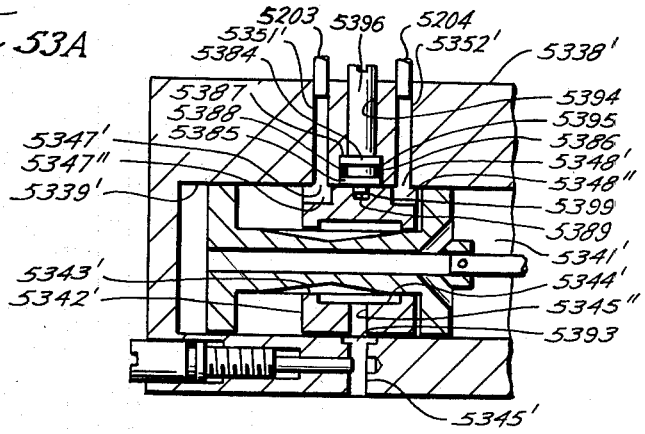
FIG. 53A is a sectional view of an alternative embodiment of the responder of FIG. 53.
Figure 53B:
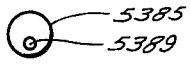
FIG. 53B is an end view of the cam pin of FIG. 53A.

In FIGS. 53A and 53B, an alternative embodiment of the responder is shown. In this alternative embodiment the reduced diameter portion is shown as axially movable annulus 5342' rather than annular flange 5342. Because annulus 5342' forms a part of the feedback venting path, axial movement of annulus 4342' causes axial movement of piston 5353 even though the position of the transmitter is not varied. Thus, even though piston 5353 does not "center" when the transmitter is in the neutral position, annulus 5342' may be adjusted so that swash plate 5381 is in the vertical position when transmitter 5300 is in the neutral positon.

Referring now to FIG. 53A, responder 5335' has axially aligned ports 5347', 5348'. Inlet conduits 5351', 5352' extend radially through body 5338' from ports 5347', 5348', respectively, and connect to conduits 5203, 5204, respectively. Bore 5339' further has port 5393 located on the circumference of the wall of bore 5339' centered between ports 5347', 5348'. Outlet conduit 5345' extends radially from port 5393 through body 5338' and connects to the reservoir. Outlet conduit 5345' is enlarged at port 5393.

Also positioned on the circumference of the wall of bore 5339' centered between ports 5347', 5348' is cam pin bore 5394 extending radially through body 5338'. Cam pin bore 5394 has enlarged diameter portion 5395 opening into bore 5339'. Cam pin 5396 is disposed in cam pin bore 5394. Cylindrical control shaft 5397 of cam pin 5396 extends through the entire length of cam pin bore 5394 and extends just above the outer surface of body 5338'. The portion of control shaft 5397 extending above the outer surface of body 5338' has slot 5398 so that control shaft 5397 can be rotated using a slot-head screwdriver.

Control shaft 5397 includes cylindrical bearing lands 5384, 5385 separated by groove 5386. Land 5384 abuts shoulder 5387 formed at the junction of enlarged diameter portion 5395 of cam pin bore 5394 with the remainder of bore 5394. Land 5386 is tangent to the surface of bore 5339. O-ring 5388 is disposed in groove 5386.

Cylindrical cam pin 5389 is attached to land 5385 and extends a short distance into bore 5339'. As shown in FIG. 53B, cam pin 5389 is arranged eccentrically on land 5385.

Annulus 5342' is sealingly and slidingly disposed in bore 5339'. Annulus 5342' has sufficient axial length to extend beyond ports 5347', 5348' at either end when centered about ports 5347', 5348'. Internal cylindrical surface 5343' of annulus 5342' is recessed over much of its length forming axially centered groove 5344'. Annulus outlet conduit 5345" extends radially through annulus 5342' from the center of groove 5344' such that when annulus 5342' is centered about ports 5347', 5348', annulus outlet conduit 5345" is aligned with outlet conduit 5345'. Because outlet conduit 5345' is enlarged at port 5393, conduit 5345" will be in full communication with conduit 5345" even when annulus 5342' is not centered about ports 5347', 5348'.

Annulus 5342' has grooves 5347", 5348" on either side and communicating with inlet conduits 5351', 5352', respectively, to permit flow of fluid from conduits 5351', 5352' to either side of annulus 5342'. The depth of grooves 5347", 5348" toward the axial center of annulus 5342' should be such that when annulus 5342' is centered about ports 5347', 5348', grooves 5347", 5348" extend a short distance beyond ports 5347', 5348".

Annulus 5342' also has slot 5339 at its axial center for accommodating cam pin 5389. Slot 5399 is sufficiently long and wide to permit cam pin 5389 to move within slot 5399 as control shaft 5396 is rotated.

Operation of the null adjustment of the alternative embodiment shown in FIGS. 53A and 53B is as follows. If, when transmitter 5300 is in the neutral position, swash plate is turned counterclockwise from the vertical, it is clear that feedback piston is positioned too far to the right. This, in turn, would be caused because internal piston 5359 and piston 5353 are positioned too far to the right when the transmitter is in the neutral position. By rotating control shaft 5396 clockwise so that cam pin 5389 moves to the left, annulus 5342' is forced to the left due to the action of cam pin 5389 against the side of slot 5399. Such movement causes feedback venting of conduit 5203 to decrease and the feedback venting of conduit 5204 to increase. As a result, the pressure of the fluid to the left of annulus 5342' increases and the pressure of the fluid to the right of annulus 5342' decreases and piston 5353 moves to the left. As piston 5353 moves to the left, internal piston 5359 moves to the left causing swash plate 5381 to rotate clockwise about pin 5383 toward the vertical. Rotation of cam pin control shaft is continued until swash plate 5381 is vertical.

If swash plate 5381 is positioned clockwise from vertical when the transmitter is in the neutral position, piston 5353 is positioned too far to the left. Cam pin control shaft is then rotated counterclockwise causing annulus 5342' to move to the right. Piston 5353 then moves to the right causing swash plate 5381 to move toward the vertical.

3. Separate Operator for Each Line (FIG. 54)

Figure 54:
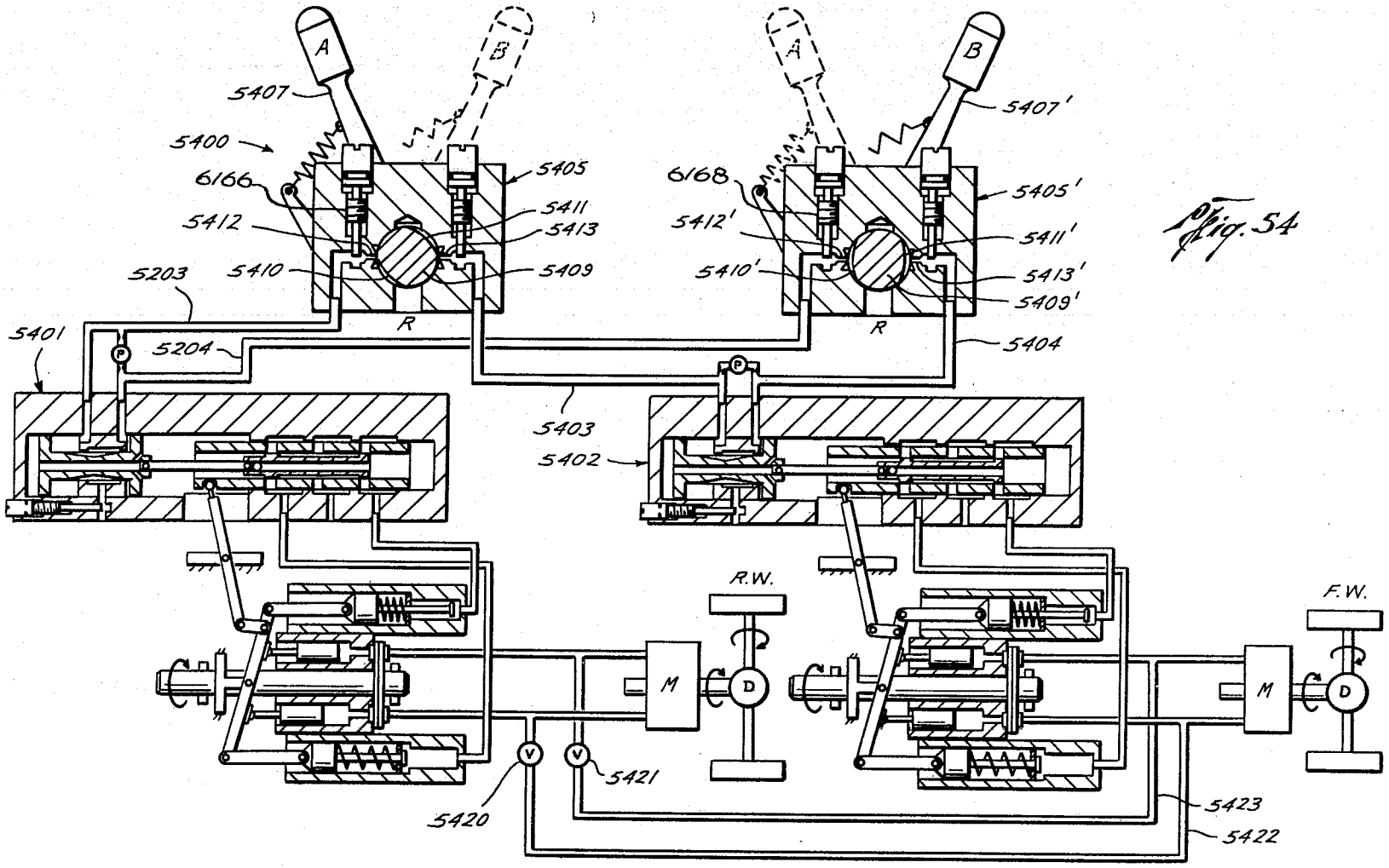
FIG. 54 is a largely schematic sectional view illustrating a rotary transmitter for venting two-line systems, each system vented one line at a time by two control levers, and switching a modified responder piston and cylinder like that of FIG. 53.

Referring now to FIG. 54, a system is shown that may be used for rotating the shafts of two motors at the same speed and in either a clockwise or a counterclockwise direction. Such a system may be incorporated into the truck described in reference to FIG. 43 such that clockwise rotation of the motor shafts results in movement of the truck in a forward direction and counterclockwise rotation of the motor shafts results in movement of the truck in a reverse direction.

Transmitter 5400 of the system is used for controlling two receivers precisely the same as those described in respect to FIG. 53. Therefore, the response of receiver 5401 is proportional to the pressure differential between the fluid in conduit 5203 and the fluid in conduit 5204; and the response of receiver 5402 is proportional to the pressure differential between the fluid in conduit 5403 and the fluid in conduit 5404. Because the system is to be used to drive the wheels of a single truck, it is desirable that the response of receiver 5401 be identical to the response of receiver 5402 at any given time. This is best accomplished by keeping the pressure of fluid in conduit 5203 essentially equal to the pressure of fluid in conduit 5403, and the pressure of fluid in conduit 5204 essentially equal to the pressure of fluid in conduit 5404.

Transmitter 5400 is well adapted for this purpose. Transmitter 5400 includes reverse unit 5405 and forward unit 5405'. Forward unit 5405 controls the pressure of fluid in conduits 5203, 5403 and reverse unit 5405' controls the pressure in conduits 5404, 5204.

Unit 5405 is substantially identical to transmitter 5200 of FIGS. 52 and 52A with only the following differences. Lever 5407 is biased to positon A, referred to as the neutral position, by spring 5414. Movement of lever 5407 is limited by stops 5415, 5416. Partial cylindrical land 5409 has diametrically opposed undercuts 5410, 5411 each covering an area of approximately 40 degrees. When unit 5405 is in the neutral position, lever 5407 is in position A, undercut 5410 extends from a point just beneath nozzle 5412 which connects to conduit 5203 to a point near the center of the outlet conduit, and undercut 5411 extends from a point near the center of the outlet conduit to a point just above nozzle 5413 which connects to conduit 5403.

Unit 5405' is in all essential respects identical to unit 5405, with like parts having like reference numbers with the addition of a prime (').

Operation of transmitter 5400 is as follows. When the levers of units 5405, 5405' are both in position A, conduits 5203, 5204, 5403, 5404 are all blocked at the transmitter resulting in no pressure differential and no rotation by the motors. As lever 5407' of unit 5405' is moved toward position B, pressure fluid in conduits 5204, 5404 is vented. The extent of venting of each conduit is identical since the undercuts are identical and diametrically opposed. As a result, both responder pistons move to the left an identical amount causing the motors to rotate in a clockwise direction at an equal speed. The truck will then move forward at a speed proportional to the extent of movement of lever 5414 from the neutral position. Maximum forward speed occurs with the lever in position B whereby the center of undercuts 5410' and 5411' of land 5409' are aligned with the axis of the nozzles and with lever 5407 in of unit 5405 in neutral position A.

Reverse movement of the truck may be effected similarly by moving lever 5407 toward position B while lever 5407' is in neutral positon A. Because unit 5405 is identical to unit 5405', the speed of reverse movement of the truck will be the same as the speed of forward movement of the truck for equivalent movement of lever 5407.

Clearly, the system of FIG. 54 is designed such that, for most purposes, only one of the levers of transmitter 5400 should be moved from neutral position A at a time. Movement of both levers will result in a hybrid response of the receiver which is determinable only through a consideration of the relative movement of the levers.

Although transmitter 5400 serves to make the responses of receivers 5401, 5402 very nearly identical, it is possible that the output of the pump unit of receiver 5401 is not identical to that of receiver 5402. In such a case, the front wheels of the truck would tend to turn at a different rate than the rear wheels when the truck is on the highway. This could cause excessive wear of the tires and could damage the steering. This problem is solved in the truck of FIG. 54 by attaching lines 5422, 5423 across the outputs of the pump units so that the outputs are connected in parallel. In this way, the pump outputs will be essentially identical.

Valves 5420, 5421 are disposed in lines 5422, 5423, respectively, so that the outputs of the pump units can be separated. Thus, if individual drive of the front and rear wheels is necessary, such as on rough terrain to prevent spinout, valves 5420, 5421 can be closed.

Figure 55:
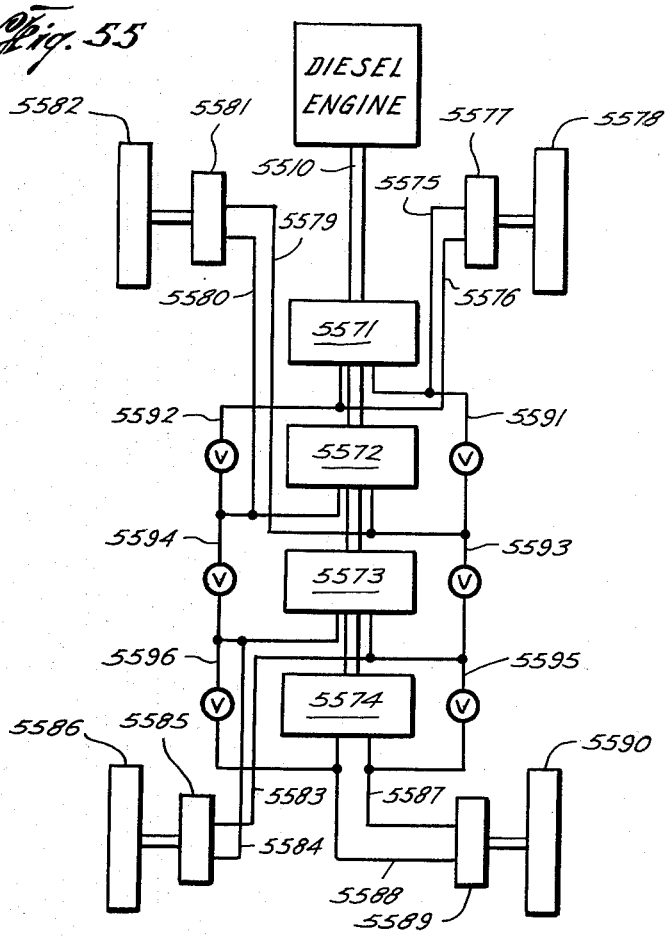
FIG. 55 is a schematic plan view of a four-wheel vehicle wherein the wheels may be selectively driven individually or in unison.

FIG. 55 shows a truck configuration similar to that of FIG. 54. Each wheel of the truck of FIG. 55, however, is driven by a separate motor. The motors, in turn, are driven by the output of four pump units. In the configuration of FIG. 55, the outputs of the pumps may be selectively connected such that each pump drives a separate motor; such that two pumps together drive two motors; such that three pumps together drive three motors; and such that all four pumps together drive all four motors. In this way, the motors can be driven together so that they turn at the same rate for highway driving and they can also be driven separately in order to prevent spinout.

Referring to FIG. 55, shaft 5570 of the diesel engine drives pump units 5571, 5572, 5573, 5574. Output conduits 5575, 5576 of pump unit 5571 are connected to motor 5577 which, in turn drives front wheel 5578. Output conduits 5579, 5580 of pump unit 5572 are connected to motor 5581 which, in turn, drives front wheel 5582. Output conduits 5583, 5584 of pump unit 5573 are connected to motor 5585 which, in turn, drives rear wheel 5586. Output conduits 5587, 5588 of pump unit 5574 are connected to motor 5589 which, in turn, drives rear wheel 5590.

The outputs of pumps 5571, 5572 are connected in parallel by conduit 5591 connected between conduits 5575, 5579 and conduit 5592 connected between conduits 5576, 5580. The outputs of pumps 5572, 5573 are connected in parallel by conduit 5593 connected between conduits 5579, 5583 and conduit 5594 connected between conduits 5580, 5584. The outputs of pumps 5573, 5574 are connected in parallel by conduit 5595 connected between conduits 5583, 5587 and conduit 5592 connected between conduits 5584, 5588.

Conduits 5591–5596 each has a valve V for selectively shutting off or permitting fluid flow through the corresponding conduit. If each wheel is to be driven individually, all the valves are closed so that there is no communication between the output of one pump and the output of another pump unit. If it is desirable that all four wheels rotate at the same rate, all the valves are opened completely. If it is desirable that each of the front wheels rotate at the same rate and that each of the rear wheels rotate at the same rate, but that the front wheels rotate independently of the rear wheels, the valves in conduits 5591, 5592, 5595, 5596 are opened and the valves in conduits 5593, 5594 are closed.

The technique of tying the outputs of the pump units in parallel was first conceived by the applicant on June 12, 1970. No claim to such technique is made since such technique is believed to have been in public use by another more than one year before the present application. Such use was in conjunction with the load control valve and swash plate pump unit as described (enclosed in line 5340 of FIG. 53). The load control valve was connected by rod 5365 to a WABCD (Westinghouse) servo motor which controlled the load control valve.

From the foregoing description, it will be apparent that a typical embodiment of the invention includes a transmitter, amplifier, and a load piston and cylinder means, with feedback means actuated by both the amplifier and by the load piston and cylinder. Sometimes the load piston and cylinder have been called a receiver, reflecting the fact that the system can be used for remote control. Depending on its position as being adjacent the transmitter or adjacent the load piston and cylinder means, the amplifier may be said to be part of the transmitter or receiver, using these terms in a broader sense. Since the element referred to as an amplifier can in some cases be replaced by a similarly functioning device which does not amplify, it has sometimes been called merely a responder. This also reflects the fact that the responder can be used directly as an indicator or load actuator rather than as a valve to control a load piston and cylinder means or servo motor. Sometimes the word responder is used more broadly to refer to all of that which follows the transmitter, in which case the amplifier or first stage following the transmitter may be called a primary piston and cylinder means and the second stage a secondary or load piston and cylinder means.

The variable pressure line or lines from the transmitter may be called its output, in that the transmitter produces a variable pressure signal that is sent out to the next stage of the system. In like manner, the fluid flow lines controlled by the valve that constitutes the amplifier or responder may be called the output of the amplifier or responder.

The foregoing explanation of the terminology used in the description and the claims will help correlate the claim language with that of the description of the preferred embodiments.

I claim:

1. In a fluidic repeater comprising a source of pressure fluid, a reservoir of fluid at lower pressure than said source, a responder including means forming a first chamber and a first movable member movable in the chamber, e.g. a cylinder and a piston movable in the cylinder, a first fluid passage for connecting the source of pressure fluid to a first portion of the first chamber at one side of the first movable member, a first flow restrictor in said flow passage, a part of said flow passage downstream of said first restrictor together with said first portion of said first chamber providing a transmitter controlled volume, transmitter means for variably venting said transmitter controlled volume to vary the fluid pressure in said first portion of said first chamber according to the degree of venting by said transmitter means.

a second fluid passage for connecting the source of pressure fluid to a second portion of the first chamber on a side of said first movable member opposite to said one side, a second flow restrictor in said second flow passage, a part of said second flow passage downstream of the last said flow restrictor together with said second portion of said first chamber providing a feedback controlled volume, feedback means for variably venting said feedback controlled volume to vary the fluid pressure in said second portion of said first chamber according to the degree of venting by said feedback means, load actuating means comprising second means forming a second chamber having a second movable member movable therein, e.g. a piston and cylinder, passage means for supplying pressure fluid to and receiving pressure fluid from opposite sides of said second chamber at opposite sides of said second movable member, and valve means controlling said passage means, said first movable member being connected to said valve means, the improvement as follows:

said transmitter means comprising a fixed stator and a rotor rotatably mounted relative to the stator, said stator having a plurality of stationary fluid passages each terminating in a stationary port at a surface of the stator opposite the rotor, one of said stationary ports communicating with said transmitter controlled volume and an other of said stationary ports communicating with said reservoir, flow path means including passage means over the surface of the rotor for communicating said one stationary port, that communicates with said transmitter controlled volume, with said other stationary port, that communicates with said reservoir, with varying degrees of restriction according to the angular position of said rotor relative to said stator about the axis of rotation of said rotor, said feedback means comprising variable flow restriction means variably communicating said feedback controlled volume with said reservoir in accordance with the extent of displacement of said second movable member and hence in response to the position of said second movable member, the fluid path through said feedback means being independent of said transmitter means in that the fluid flowing through said transmitter means' stator and rotor does not flow through said variable restriction means of said feedback means in the flow of the fluid from said source to said reservoir through said transmitter means' stator and rotor, said feedback means restoring said movable member of said responder to its initial position following its displacement in response to angular displacement of said transmitter means' rotor, whereby the displacement of said load actuating means is proportional to the angular displacement of said transmitter means' rotor relative to said stator without any angular displacement of said stator.

2. Fluidic repeater according to claim 1, said stator having a third stationary fluid passage therein terminating in a third stationary port at a surface of the stator opposite said rotor, said third port providing means to vent a line connected through one of said restrictors to said source of pressure, and second flow path means including second passage means over the surface of the rotor for communicating said third port with said third port connected to said reservoir with varying degrees of restriction according to the angular position of the rotor relative to said stator about the axis of rotation of the rotor, said third port being coaxial with said one port, the last said ports being oppositely directed toward said rotor, the common axis of the last said ports intersecting the axis of rotation of said rotor.

3. Fluidic repeater according to claim 2, said third port being connected to said one port, whereby both said one port and third port simultaneously control venting of said transmitter controlled volume and the effects of play between said rotor and stator in varying the venting will be balanced out.

4. Fluidic repeater according to claim 1, said passage means over the surface of the rotor comprising an area undercut below the otherwise cylindric surface of the adjacent portion of the rotor, the depth of the undercut varying continuously from a minimum to a maximum and back to minimum at different azimuthal positions about the axis of the rotor whereby when said rotor is positioned with said undercut area over said one of said ports in the stator flow through the last said port is variably restricted according to the azimuthal position of the rotor, thereby to vent said transmitter controlled volume and cause movement of the responder movable member and of the load actuating means movable member until said feedback means responsive to the position of said movable member of the load actuating means vents said feedback controlled volume sufficiently to balance the forces on said movable member of said responder, whereby load actuation means movable member displacement is proportional to transmitter rotor angular displacement.

5. In a fluidic repeater comprising:

a first line for transmitting pressure signals, a second line for transmitting pressure signals, means including a source of pressure fluid for supplying pressure fluid to said lines, a reservoir of fluid at lower pressure than said source for receiving pressure fluid discharged from said lines, a responder including means forming a first chamber and a first movable member movable in the chamber, said first line connecting to a first portion of the first chamber at one side of the first movable member, transmitter means including a first variable flow restrictor connected in said first line between one end thereof and said first portion of the first chamber, a first part of said first line between said first restrictor and said first portion of the first chamber together with said first portion of said first chamber providing a transmitter controlled volume, said transmitter means creating a variable pressure difference between upstream and downstream of the first flow restrictor, thereby to vary the fluid pressure in said transmitter controlled volume and vary the fluid pressure in said first portion of said first chamber according to the degree of restriction by said transmitter means, said second line connecting to a second portion of the first chamber on a side of said movable member opposite to said one side, feedback means including variable flow restriction means connected in said second line between one end thereof and said second portion of the first chamber, a part of said second line between said variable flow restriction means and said second portion of the first chamber together with said second portion of said first chamber providing a feedback controlled volume, said feedback means creating a variable pressure difference between upstream and downstream of said variable flow restriction means, thereby to vary the fluid pressure in said feedback controlled volume and vary the fluid pressure in said second portion of said first chamber according to the degree of restriction by said feedback means, load actuating means comprising second means forming a second chamber having a second movable member movable therein, passage means for supplying pressure fluid to and receiving pressure fluid from opposite sides of said second chamber at opposite sides of said second movable member, and valve means controlling said passage means, said first movable member being connected to said valve means, the improvement as follows:

said transmitter means comprising a fixed stator and a rotor rotatably mounted relative to the stator, said stator having a plurality of stationary fluid passages each terminating in a stationary port at a surface of the stator opposite the rotor, one of said stationary ports communicating with said transmitter controlled volume, and an other of said stationary ports communicating with a second part of said first line on an opposite side of said first restrictor from said first part, flow path means including passage means over the surface of the rotor for communicating said one stationary port, that communicates with said transmitter controlled volume, with said other stationary port, that communicates with said second part of said first line, with varying degrees of restriction according to the angular position of said rotor relative to said stator about the axis of rotation of said rotor, said feedback means comprising a second flowpath means including said variable flow restriction means communicating said feedback controlled volume with said reservoir in accordance with the extent of displacement of said second movable member and hence in response to the position of said second movable member, said second flow path means through said feedback means being independent of said transmitter means in that the fluid flowing through said transmitter means' stator and rotor does not flow through said variable restriction means of said feedback means in the flow of the fluid from said source to said reservoir through said transmitter means stator and rotor, said feedback means restoring said movable member of the responder to its initial position following its displacement in response to angular displacement of said transmitter means' rotor, whereby the displacement of said load actuating means is proportional to the angular displacement of said transmitter means' rotor relative to said stator without any angular displacement of said stator.

6. Fluidic repeater according to claim 1 or 5, said flow path means from said one stationary port to said other stationary port including a portion having a resolution component parallel to the axis of rotation of said rotor.

7. Fluidic repeater according to claim 5:

said feedback means including further flow path means including further variable restriction means communicating said transmitter controlled volume with said reservoir in accordance with the extent of displacement of said second movable member and hence in response to the position of said second movable member, a third line for transmitting pressure signals, said means for supplying pressure fluid supplying pressure fluid to said third line, said third line connecting to said feedback controlled volume, said stator having a third passage therein terminating in a third stationary port at a surface of the stator opposite said rotor, said third passage communicating with said third line, and additional flow path means including second passage means over the surface of the rotor for communicating said third port with said second port with varying degrees of restriction according to the angular position of the rotor relative to said stator about the axis of the rotor, said third port being coaxial with said one port, the last said ports beign oppositely directed toward said rotor, the common axis of the last said ports intersecting the axis of rotation of said rotor.

8. Fluidic repeater according to claim 3 or 7, said stator including a body having a generally cylindrical/opening concentric with the axis of rotation of the rotor, said rotor including a plug rotatably mounted in said opening and having a generally cylindrical outer periphery correlative to the inner periphery of said opening and concentric with the axis of rotation of said rotor, the relative angular position of the plug and body being independent of the position of said movable member of said responder.

9. Fluidic repeater according to claim 8, said plug of said rotor having an annular groove therearound communicating in all angular positions of the rotor with said other stationary port connected to said reservoir, said plug having an undercut portion communicating with variable restriction between zero and maximum with said one stationary port connected to said transmitter controlled volume.

10. Fluidic repeater according to claim 9, each end of said plug of said rotor having a cylindrical outer peripheral surface and said opening in the stator body having inner peripheral surfaces each concentric with one of said outer peripheral cylindrical surfaces at the ends of said rotor, an annular groove in each of said cylindrical outer peripheral surfaces at said ends of said rotor and an O-ring in each said groove sealing between said plug and body forming a seal therebetween, said other port through said body communicating with the inner periphery of said opening at a position that is in between said O-rings and that is azimuthally stationary with respect to the axis of rotation of said rotor.

11. Fluidic repeater according to claim 8, the inner periphery of said opening in said body being relieved around said one port in the stator forming thereat a nozzle having a tip tangent to the generally cylindrical opening in said stator body.

12. Fluidic repeater according to claim 8, said one port in the stator body being disposed paraxially relative to the rotor, being directed toward one end of said plug, said plug being rotatably mounted by lead screw means to cause said plug to move axially toward and away from said port as the plug is rotated.

13. Fluidic repeater according to claim 7, said load feedback means comprising a rotary construction the same as set forth for the transmitter means, whereby angular motion of the feedback means produces the same effect as an equal angular motion of the transmitter means.

14. Fluidic repeater according to claim 1 or 5, said load feedback means comprising a rotary construction the same as set forth for the transmitter means, whereby angular motion of the feedback means produces the same effect as an equal angular motion of the transmitter means.

15. Fluidic repeater according to claim 5, said stator comprising a shaft having radially extending arms, said one port being at the end of one of said arms, said rotor comprising a head around said shaft having an inner peripheral annular groove of variable radial depth overlying said one port variably restricting flow therefrom according to the angular position of the rotor relative to the arms.

16. Fluidic repeater according to claim 5, said passage means over the surface of the rotor comprising an area undercut below the otherwise cylindric surface of the adjacent portion of the rotor, the depth of the undercut varying continuously from a minimum to a maximum and back to a minimum at different azimuthal positions about the axis of the rotor, whereby when said rotor is positioned with said undercut area over said one of said ports in the stator, flow through the last said port is variably restricted according to the azimuthal position of the rotor, thereby to vary the fluid pressure in said transmitter controlled volume and cause movement of the responder movable member and of the load actuating means movable member until said feedback means responsive to the position of said movable member of the load actuating means varies the fluid pressure in said feedback controlled volume sufficiently to balance the forces on said movable member of said responder, whereby load actuation means movable member displacement is proportional to transmitter rotor angular displacement.

17. Fluidic repeater according to claim 5, said stator having a third stationary fluid passage therein terminating in a third stationary port at a surface of the stator opposite said rotor, and further flow path means including second passage means over the surface of the rotor for communicating said third port with said second port with varying degrees of restriction according to the angular position of the rotor relative to said stator about the axis of rotation of the rotor, said third port being coaxial with said one port, the last said ports being oppositely directed toward said rotor, the common axis of the last said ports intersecting the axis of rotation of said rotor, said third port being connected to said one port whereby both said one port and said third port simultaneously control fluid pressure of said transmitter controlled volume and the effects of play between said rotor and stator in varying the fluid pressure in said transmitter controlled volume will be balanced out.

18. Fluidic repeater according to claim 5, said load feedback means comprising a rotary construction the same as set forth for the transmitter, whereby angular motion of the feedback produces the same effect as an equal angular motion of the transmitter, said load actuating means being a rotary motor having a shaft to which is connected the rotor of said feedback means.

* * * * *

UNITED STATES PATENT AND TRADEMARK OFFICE

CERTIFICATE OF CORRECTION

PATENT NO. : 4,335,645

DATED : June 22, 1982

INVENTOR(S) : Willie B. Leonard

It is certified that error appears in the above—identified patent and that said Letters Patent is hereby corrected as shown below:

Column 1, line 61; change "swasn" to -swash-.

Column 4, line 50; delete "If" and insert -As-.

Column 7, line 20; change "There" to -These-.

Column 10, line 61; change "2" to -1-.

Column 11, line 39; change "loan" to -load-

Column 12, line 38; change "passaage" to -passage-.

Column 18, line 12; change "815" to -813 and change "817" to -815-.

Column 22, line 53; delete "on" and insert -are-.

Column 23, line 65: change "tods" to -rods-

Column 25, line 40; change "equilibrian" to -equilibrium-.

UNITED STATES PATENT AND TRADEMARK OFFICE

CERTIFICATE OF CORRECTION

PATENT NO. : 4,335,645

DATED : June 22, 1982

INVENTOR(S) : Willie B. Leonard

It is certified that error appears in the above—identified patent and that said Letters Patent is hereby corrected as shown below:

Column 27, line 68; change "previos;ly" to -previously-.

Column 28, line 64; change "42" to -52-.

Column 30, line 9; change "5205" to -5202-.

Column 31, line 56; change "therein" to -therein.-.

Column 32, line 52; change "operator" to -operation-.

IN THE CLAIMS

Column 45, line 12; change "means." to -means,-.

Column 48, line 45; change "beign" to -being-.

Column 48, line 48; change "3" to -2-.

Signed and Sealed this

*Twenth-eighth* Day of *September 1982*

[SEAL]

*Attest:*

GERALD J. MOSSINGHOFF

*Attesting Officer*

*Commissioner of Patents and Trademarks*